US007524014B2

(12) United States Patent
Izuo

(10) Patent No.: US 7,524,014 B2
(45) Date of Patent: Apr. 28, 2009

(54) IMAGE FORMING APPARATUS AND IMAGE FORMING METHOD

(75) Inventor: Seiji Izuo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 223 days.

(21) Appl. No.: 11/515,757

(22) Filed: Sep. 6, 2006

(65) Prior Publication Data

US 2007/0052745 A1 Mar. 8, 2007

(30) Foreign Application Priority Data

| | | |
|---|---|---|
| Sep. 6, 2005 | (JP) | 2005-257953 |
| Sep. 30, 2005 | (JP) | 2005-287220 |
| Sep. 30, 2005 | (JP) | 2005-287221 |
| Jul. 11, 2006 | (JP) | 2006-190812 |

(51) Int. Cl.
*B41J 29/393* (2006.01)

(52) U.S. Cl. ..... 347/19; 347/14; 347/101; 347/106

(58) Field of Classification Search ..... 347/19
See application file for complete search history.

(56) References Cited

U.S. PATENT DOCUMENTS 6,513,901 B1 * 2/2003 Walker ..... 347/19
2006/0256352 A1 * 11/2006 Kogure et al. ..... 358/1.1

FOREIGN PATENT DOCUMENTS

EP 895867 A2 * 2/1999
JP 2001-096874 A 4/2001

* cited by examiner

*Primary Examiner*—Luu Matthew
*Assistant Examiner*—Brian J Goldberg
(74) *Attorney, Agent, or Firm*—Sughrue Mion, PLLC

(57) ABSTRACT

An ink jet printer 20 of the present invention can carry out a head check on whether or not ink is normally ejected from nozzles 23, by having a voltage detection circuit 54 detect electrical change resulting from ejecting of charged ink droplets onto an ink receiving area 52. When instructed to do borderfree printing, the ink jet printer 20 has a voltage application circuit 50 to charge ink in the print head 24, and ejects ink onto an area within the ink receiving area 52 where a recording sheet S is present and an area where a recording sheet is not present. The ink jet printer 20 also carries a print head 24 and determines a front edge of the recording sheet S based on a position where a voltage detection circuit no longer detects voltage. Thus, the ink jet printer 20 determines a front edge, side edges, and rear edge of the recording sheet S by directly using ink. Determination of a position of the edge of the print medium is thus secured with greater accuracy than with any method in which anything other than print recording liquid is used and in which the position is indirectly determined.

20 Claims, 28 Drawing Sheets

IMAGE FORMING APPARATUS AND IMAGE FORMING METHOD

BACKGROUND OF THE INVENTION

1. Field of the Invention

The present invention relates to an image forming apparatus and an image forming method.

2. Description of the Related Art

One proposed printer includes a light source and a light-receiving device provided in a print head, and moves the print head in a main scanning direction orthogonal to a transport direction of a recording sheet and ejects ink in order to print an image on a recording sheet. When a printing is performed, the proposed printer emits light from the light source, detects the reflected light from the recording sheet by the light-receiving device, thereby determining a position of a rear edge of the recording sheet, and controls the eject and stop of ejection of ink based on the determined position of the rear edge (e.g., refer to JP 2001-96874 A, FIG. 2).

SUMMARY OF THE INVENTION

However, the printer described in JP 2001-96874 A could not necessarily determine a position of an end of a recording sheet precisely, because the position was determined in such an indirect manner that uses reflections of light, instead of in a direct manner that uses ink droplets to detect a landing of the ink droplets on the recording sheet. Therefore, in the above printer, a wide area is required over which ink can be ejected, running off the edge of the recording sheet so as to avoid leaving a blank space, for instance, when borderfree printing is performed.

The present invention has been made in light of such a drawback, and it is an object of the invention to provide an image forming apparatus, an image forming method and a program thereof that allow for determination of an end section of a print medium more precisely than ones that determine a position of an end section of a print medium indirectly by use of anything other than a print recording liquid. It is another object of the invention to provide an image forming apparatus, an image forming method and a program that controls consumption of print recording liquid at an end section of a print medium.

In order to achieve at least part of the above objects, the present invention is constructed as follows.

The present invention is directed to an image forming method for forming an image on a print medium by use of an image forming apparatus including a print head that ejects a print recording liquid from a plurality of nozzles onto the print medium, a print head drive module that causes the print head to eject the print recording liquid from one of the nozzles, and a print recording liquid receiving area over which the print medium passes and which the print recording liquid ejected from the nozzles can reach. The image forming method includes steps of: (a) generating a predetermined potential difference between the print recording liquid receiving area and the print head, and controlling the print head drive module so that the print head ejects the print recording liquid, which is charged in advance of ejection, from the nozzles to a specific area of the print recording liquid receiving area, which includes an exterior range outside an edge of the print medium and an interior range over the print medium, and then detecting electrical change in the print recording liquid receiving area or the print head; and (b) determining position of the edge of the print medium based on the electrical change detected in step (a).

According to the image forming method of the invention, any electrical change in a print recording liquid-receiving area or a print head is detected, when a print head drive module is controlled so that the print head ejects from nozzles a print recording liquid to the specific area of the print recording liquid receiving area, which includes the exterior range outside an edge of the print medium and the interior range over the print medium, while a predetermined potential difference is generated between the print recording liquid-receiving area and the print head and the print recording liquid charged in advance of ejection. In this manner, a position of an edge of a print medium can be determined by using the print recording liquid ejected from the nozzles directly. Thus, by means of this method a position of an edge of the print medium can be determined with a greater degree of precision than with a method by which an end section of a print medium is determined indirectly by use of anything other than a print recording liquid. Here "the print head ejects from the nozzles the print recording liquid to a specific area of the print recording liquid receiving area, which includes an exterior range outside an edge of the print medium and an interior range over the print medium," includes a process of ejecting the print recording liquid onto the respective areas at varying times, in addition to ejecting the print recording liquid onto the appropriate areas simultaneously.

The image forming method of the present invention may also include the step of: (c) setting a non-ejecting nozzle that does not eject the print recording liquid based on the electrical change detected in step (a), and controlling the print head drive module based on the setting. Here, "setting a non-ejecting nozzle that does not eject the print recording liquid" can include the deliberate setting of a non-ejecting nozzle, as well as designating as non-ejecting nozzle any nozzle other than the nozzle that has already been set for ejecting the print recording liquid.

In one modified structure of the image forming method of the invention, step (a) generates the predetermined potential difference between the print recording liquid receiving area and the print head, and detects electrical change when the print head ejects the print recording liquid, which is charged in advance of ejection, from the nozzles to a predetermined area of the print recording liquid receiving area, which includes an immediate exterior range adjacent to a front edge of the print medium and the interior range over the print medium; and step (b) determines position of the front edge of the print medium based on the electrical change detected in step (a). Here, "the front edge of the print medium" refers to the front edge of the print medium in a transport direction.

In the image forming method of this modified structure, the print head may include a nozzle array in which the plurality of nozzles is arranged in a transport direction of the print medium, and step (a) may control to fix the print medium in a state that the print recording liquid ejected from the nozzles included in the nozzle array can reach the predetermined area, which includes the immediate exterior range adjacent to the front edge of the print medium and the interior range over the print medium, and control the print head drive module to sequentially switch the nozzles in the nozzle array, from which the print recording liquid is ejected, in the direction from a nozzle above the immediate exterior range adjacent to the front edge of the print medium to a nozzle above the interior range over the print medium, and to eject the print recording liquid onto the fixed print medium. And step (b) may determine the position of the front edge of the print medium based on position where electrical change has ceased to be detected in the control in step (a).

In the image forming method of this modified structure, the image forming apparatus may include a transport unit capable of carrying the print medium in a transport direction, and step (a), in the course of controlling the print head drive module so that the print head ejects the print recording liquid from the nozzles to the predetermined area, which includes the immediate exterior range adjacent to the front edge of the print medium and the interior range over the print medium, may control the transport unit to carry the print medium toward a position where a print recording liquid ejected from a specific nozzle among the plurality of nozzles reaches the print recording liquid receiving area, and controls the print head drive module to eject the print recording liquid from the specific nozzle. And step (b) may determine the position of the front edge of the print medium based on position where electrical change has ceased to be detected in the control in the step (a).

The image forming method of this modified structure may further include a step of: (d) determining a first point on the front edge of the print medium by controlling the print head drive module so that the print head ejects the print recording liquid from the nozzles to the predetermined area, which includes the immediate exterior range adjacent to the front edge of the print medium and the interior range over the print medium, determining a second point on the front edge of the print medium by controlling the print head drive module so that the print head ejects the print recording liquid from the nozzles to a preset area, which does not include the first point and includes the immediate exterior range adjacent to the front edge and the interior range over the print medium, and determining an inclination of the print medium based on the determined first and second points.

In another modified structure of the image forming method of the invention, step (a) generates a predetermined potential difference between the print recording liquid receiving area and the print head, and detects electrical change when the print head ejects the print recording liquid, which is charged in advance, from the nozzles to a predetermined area of the print recording liquid receiving area, which includes an immediate exterior range adjacent to a side edge of the print medium and the interior range over the print medium, in either direction of from the immediate exterior range toward the interior range and from the interior range toward the immediate exterior range, and step (b) determines position of a side edge of the print medium based on the electrical change detected in step (a).

In the image forming method of this modified structure, the print head may includes at least two arrays of nozzles in each of which the plurality of nozzles is arranged in a transport direction of the print medium, and step (b) may determine the position of the side edge of the print medium based on position where electrical change has ceased to be detected in step (a) when the print recording liquid is ejected from a nozzle included in a front array of nozzles in a main scanning direction orthogonal to the transport direction of the print medium, while controlling the print head drive module so that the print head ejects the print recording liquid to the predetermined area of the print recording liquid receiving area, in the direction from the immediate exterior range toward the interior range. In this case, the image forming method may further include a step of: (e) controlling the print head drive module so that the print recording liquid is ejected from nozzles included in other nozzle array, based on the position of the side edge of the print medium determined in step (b). In the image forming method of the above modified structure, the print head may include at least two arrays of nozzles in each of which the plurality of nozzles is arranged in a transport direction of the print medium, and step (b) may determine the position of the side edge of the print medium based on position where electrical change has started to be detected in step (a) when the print recording liquid is ejected from the nozzle included in a front array of nozzles in a main scanning direction orthogonal to the transport direction of the print medium, while controlling the print head drive module so that the print head ejects the print recording liquid to the predetermined area of the print recording liquid receiving area, in the direction from the interior range toward the immediate exterior range. In this case, the image forming method may further include a step of: (e) controlling the print head drive module so that no print recording liquid is ejected from the nozzles included in the front array or the nozzles included in other nozzle array, based on the position of the side edge of the print medium determined in step (b).

The image forming method of the above modified structure may further include a step of: (f) setting the determined position of the side edge of the print medium as a position of a side edge of a following print medium to be subsequently printed on, and controlling the print head drive module in the subsequent printing so that the print head ejects the print recording liquid from the nozzles based on the set position of the side edge of the following print medium.

In still another modified structure of the image forming method of the invention, step (a) detects electrical change when the print head ejects the print recording liquid from the nozzles to a predetermined area of the print recording liquid receiving area, which includes the interior range over the print medium and an immediate exterior range adjacent to a rear edge of the print medium, and step (b) determines position of the rear edge of the print medium based on the detected electrical change. Here, "the rear edge of the print medium" refers to the rear edge of the print medium in a transport direction.

The image forming method of this modified structure may further include a step of: (g) switching between a normal print method of ejecting the print recording liquid to any area other than a rear area of the print medium based on the electrical change detected in step (a) and a rear area print method of ejecting the print recording liquid onto the rear area of the print medium, in order to control the print head drive module.

The image forming method of the invention may further include a step of: (h) controlling the print head drive module so that the print head ejects the print recording liquid from the nozzles based on the electrical change detected in step (a), so as to allow borderfree printing on the print medium.

In the image forming method of the invention, the print head may accommodate the print recording liquid in a variety of colors, and step (a) may control the print head drive module so that the print head ejects the print recording liquid of a specific color that is not easy to view, when ejecting the print recording liquid from the nozzles to the specific area of the print recording liquid receiving area, which includes the exterior range outside the edge of the print medium and the interior range over the print medium.

The present invention is further directed to an image forming method for forming an image on a print medium by use of an image forming apparatus including a print head that ejects a print recording liquid from a plurality of nozzles onto a print medium, a print head drive module that causes the print head to eject the print recording liquid, and a print recording liquid receiving area over which the print medium passes and which the print recording liquid ejected from the nozzles can reach, the image forming method including steps of: (a) generating a predetermined potential difference between the print recording liquid receiving area and the print head, and controlling the drive head drive module so that the print head ejects the print recording liquid, which is charged in advance of ejection, from the nozzles to a specific area of the print recording liquid receiving area, which includes an exterior range outside an edge of the print medium and an interior range over the print medium, and then detecting electrical change in the print recording liquid receiving area or the print head; and (b) setting a non-ejecting nozzle that does not eject the print recording liquid based on the electrical change detected in step (a), and controlling the print head drive module based on the setting. In one modified structure of this image forming method of the invention, step (a) generates the predetermined potential difference between the print recording liquid receiving area and the print head, and detecting electrical change when the print head ejects the print recording liquid, which is charged in advance of ejection, from the nozzles to both of an immediate exterior range adjacent to a rear edge of the print medium and the interior range over the print medium, and step (b) sets the non-ejecting nozzle that does not eject the print recording liquid based on the electrical change detected in step (a) and controls the print head to eject the print recording liquid from the nozzles onto the print medium based on the setting. In this modified structure, in response to detection of electrical change when nozzles other than the non-ejecting nozzle ejects the print recording liquid to both of an immediate exterior range adjacent to a rear edge of the print medium and the interior range of the print medium, step (b) may set at least one nozzle other than the non-ejecting nozzle in the uppermost stream in the transport direction of the print medium as non-ejecting nozzle. In this image forming method of the modified structure, step (a) may control the print head drive module so that the print head ejects the print recording liquid from the nozzles to both of an immediate exterior range adjacent to a rear edge of the print medium and the interior range of the print medium, and step (b), each time that electrical change is detected at the time of controls in step (a), may set at least one group of nozzles that are not the non-ejecting nozzles and are arranged in a main scanning direction, which is orthogonal to a transport direction, in the uppermost stream of a transport direction, as the non-ejecting nozzle. In this image forming method of the modified structure, furthermore, the image forming apparatus may include a transport unit that carries the print medium in a transport direction, step (a) may control the print head drive module so that the print head ejects the print recording liquid from the nozzles, while controlling the transport unit to carry the print medium, and step (b) may set at least a group of nozzles that are not the non-ejecting nozzles and are arranged in a main scanning direction, which is orthogonal to the transport direction, in the uppermost stream of the transport direction, as the non-ejecting nozzles, and controls the transport unit the print head drive module to carry a print medium and eject the print recording liquid for the subsequent printing based on the setting. The arrangement in connection with the setting a non-ejecting nozzle may be applicable to the image forming method described above with arrangements of determining an edge of a print medium.

The present invention is further directed to an image forming apparatus including: a print head that ejects print recording liquid from a plurality of nozzles onto a print medium; a print recording liquid receiving area over which the print medium passes and which the print recording liquid ejected from the nozzles can reach; a print head drive module that controls the ejection of the print recording liquid from the nozzles; an electrical change detection module that detects electrical change in the print recording liquid receiving area or in the print head; and a control module. The control module in the image forming apparatus generates a predetermined potential difference between the print recording liquid receiving area and the print head, controls print head drive module so that the print head eject the print recording liquid, which is charged in advance of ejection, from the nozzles to a specific area of the print recording liquid receiving area, which includes an exterior range outside an edge of the print medium and an interior range over the print medium, and controls the electrical change detection module to detect electrical change, and determines position of an edge of the print medium based on the detected electrical change.

When controlling the print head drive module, the image forming apparatus detects any electrical change in such a way that, in the course of generating a predetermined potential difference between the print recording liquid-receiving area and the print head and charging the print recording liquid in advance of ejection, the print head ejects from the nozzles a print recording liquid to a specific area of the print recording liquid receiving area, which includes an exterior range outside an edge of the print medium and an interior range over the print medium, and that then determines a position of the end section of the print medium on the basis of the electrical change detected. In this manner, the image forming apparatus determines a position of an edge of a print medium by using directly a print recording liquid ejected from the nozzles. Thus, a position of the edge of the print medium can be determined with greater degree of precision than by the use of a method in which an edge of a print medium is determined indirectly by use of anything other than a print recording liquid.

Instead of or in addition to, determining the position of the edge of the print medium based on the electrical change detected by the electrical change detection module, the control module may also set a non-ejecting nozzle that does not eject the print recording liquid based on the electrical change detected and control the print head drive module on the basis of the setting.

In one modified structure of the image forming apparatus of the invention, the control module generates the predetermined potential difference between the print recording liquid receiving area and the print head, and detects electrical change when the print head ejects the print recording liquid, which is charged in advance of ejection, from the nozzles to a predetermined area of the print recording liquid receiving area, which includes an immediate exterior range adjacent to a front edge of the print medium and the interior range over the print medium, and determines position of the front edge of the print medium based on the detected electrical change.

In the image forming apparatus of the invention of this modified structure, the print head may include a nozzle array in which the plurality of nozzles is arranged in a transport direction of the print medium. In this case, in the course of controlling the print head drive module so that the print head ejects the print recording liquid to the predetermined area, which includes the immediate exterior range adjacent to the front edge of the print medium and the interior range over the print medium, the control module may control the print head drive module to sequentially switch the nozzles in the nozzle array, from which the print recording liquid is ejected, in the direction from a nozzle above the immediate exterior range adjacent to the front edge of the print medium to a nozzle above the interior range over the print medium and to eject the print recording liquid onto the print medium, which is fixed in the state that the print recording liquid ejected from the nozzles included in the nozzle array can reach, and may determine the position of the front edge of the print medium based on position where electrical change has ceased to be in the control. The position of the front edge of the print medium may be determined as a position where electrical change has ceased to be detected, or the last position where electrical change is detected.

The image forming apparatus of the above modified structure may further include a transport unit capable of carrying the print medium in a transport direction. In this case, in the course of controlling the print head drive module so that the print head ejects the print recording liquid from the nozzles to the predetermined area, which includes the immediate exterior range adjacent to the front edge of the print medium and the interior range over the print medium, the control module may control the transport unit to carry the print medium toward a position where a print recording liquid ejected from a specific nozzle among the plurality of nozzles reaches the print recording liquid receiving area, and controls the print head drive module to eject the print recording liquid from the specific nozzle, and may determine the position of the front edge of the print medium based on position where electrical change has ceased to be detected. The position of the front edge of the print medium may be determined as a position where electrical change has ceased to be detected, or the last position where electrical change is detected. The specific nozzle may be the most downstream nozzle in the transport direction of the print medium among the plurality of nozzles.

In the image forming apparatus of the above modified structure, the control module may control the print head drive module so that the print head ejects the print recording liquid from the nozzles based on the detected electrical change, so as to allow borderfree printing on the print medium. In the control for borderfree printing, the control module may control the print head drive module so that the print recording liquid is ejected from a nozzle, which is in the immediate exterior range adjacent to the front edge and is the closest to the front edge, and from a nozzle in the interior range over the print medium, while no print recording liquid is ejected from the other nozzles. Alternatively, the control module may control the print head drive module so that the print recording liquid is ejected from the nozzle in the interior range over the print medium, while no print recording liquid is ejected from a nozzle in the exterior range adjacent to the front edge.

In the image forming apparatus of the above modified structure, the control module may determine a first point on the front edge of the print medium by controlling the print head drive module so that the print head ejects the print recording liquid from the nozzles to the predetermined area, which includes the immediate exterior range adjacent to the front edge of the print medium and the interior range over the print medium, determine a second point on the front edge of the print medium by controlling the print head drive module so that the print head ejects the print recording liquid from the nozzles to a preset area, which does not include the first point and includes the immediate exterior range adjacent to the front edge and the interior range over the print medium, and determine an inclination of the print medium based on the determined first and second points. In this case, in the course of determining the first and second points, the print head drive module may cause the print head to move in the main scanning direction, which is orthogonal to the transport direction, and the control module may control the print head drive module, after the first point is determined, to cause the print head to move to a specific position where the second point is to be determined in the main scanning direction. The print head may include at least two arrays of nozzles in each of which the plurality of nozzles is arranged in a transport direction of the print medium, and the control module uses an array of nozzles, which is different from an array of nozzles used to determine the first point, in the course of determining the first and second points.

In another modified structure of the image forming apparatus of the invention, the control module generates a predetermined potential difference between the print recording liquid receiving area and the print head, and the electrical change detection module detects electrical change when the print head ejects the print recording liquid, which is charged in advance, from the nozzles to a predetermined area of the print recording liquid receiving area, which includes an immediate exterior range adjacent to a side edge of the print medium and the interior range over the print medium, in either direction of from the immediate exterior range toward the interior range and from the interior range toward the immediate exterior range, and the control module determines position of a side edge of the print medium based on the detected electrical change.

In the image forming apparatus of this modified structure, the print head may include at least two arrays of nozzles in each of which the plurality of nozzles is arranged in a transport direction of the print medium, and the control module may determine the position of the side edge of the print medium based on position where electrical change has ceased to be detected, when the print recording liquid is ejected from a nozzle included in a front array of nozzles in a main scanning direction orthogonal to the transport direction of the print medium, while controlling the print head drive module so that the print head ejects the print recording liquid to the predetermined area of the print recording liquid receiving area, in the direction from the immediate exterior range toward the interior range. And, the control module may control the print head drive module so that the print recording liquid is ejected from nozzles included in other nozzle array, based on the determined position of the side edge of the print medium. Here, "a front array of nozzles in a main scanning direction" refers to the array positioned in the front in the main scanning direction. In the course of controlling the ejection of ink from nozzles included in other nozzle array, the control module may control so that the print recording liquid is ejected from nozzles in the exterior range adjacent to the side edge.

In the image forming apparatus of the above modified structure, the print head may include at least two arrays of nozzles in each of which the plurality of nozzles is arranged in a transport direction of the print medium, and the control module may determine the position of the side edge of the print medium based on position where electrical change is detected when the print recording liquid is ejected from the nozzle included in a front array of nozzles in a main scanning direction orthogonal to the transport direction of the print medium, while controlling the print head drive module so that the print head ejects the print recording liquid to the predetermined area of the print recording liquid receiving area, in the direction from the interior range toward the immediate exterior range. And, the control module may control the print head drive module so that no print recording liquid is ejected from the nozzles included in the front array or the nozzles included in other nozzle array, based on the determined position of the side edge of the print medium.

In the image forming apparatus of the invention, the control module may control ejection and non-ejection of a print recording liquid from nozzles based on the electrical change detected by the electrical change detection module when the print recording liquid is ejected from nozzles included in a second array of nozzles, when the nozzles included in the front array are prohibited to eject print recording liquid. Here, "when the nozzles included in the front array are prohibited to eject print recording liquid" refers to, for example, a case where print data does not include a color that the nozzles in the front array eject.

In the image forming apparatus of the above modified structure, the control module may set the determined position of the side edge of the print medium as a position of a side edge of a following print medium to be subsequently printed on, and control the print head drive module in the subsequent printing so that the print head ejects the print recording liquid from the nozzles based on the set position of the side edge of the following print medium.

In still another modified structure of the image forming apparatus of the invention, the electrical change detection module detects electrical change when the print head ejects the print recording liquid from the nozzles to a predetermined area of the print recording liquid receiving area, which includes the interior range over the print medium and an immediate exterior range adjacent to a rear edge of the print medium, and sets a non-ejecting nozzle that does not eject the print recording liquid based on the detected electrical change and controls the print head drive module based on the setting.

Instead of or in addition to, determining the position of the rear edge of the print medium based on the electrical change detected by the electrical change detection module, the control module may also control to switch between a normal print method of ejecting the print recording liquid to any area other than a rear area of the print medium based on the detected electrical change and a rear area print method of ejecting the print recording liquid onto the rear area of the print medium, in order to control the print head drive module. Here, "a rear area of the print medium" refers to a rear area including the rear edge of the print medium.

In the image forming apparatus of the invention, in the course of setting the non-ejecting nozzle based on the electrical change, when electrical change is detected when the print recording liquid is ejected to both the immediate exterior range adjacent to the rear edge and the interior range over the print medium, the control module may set, as the non-ejecting nozzle, at least the uppermost stream nozzle in the transport direction of the print medium of any nozzles other than the non-ejecting nozzle. The control module may control the print head drive module so that the print head ejects the print recording liquid from the nozzles to both of an immediate exterior range adjacent to a rear edge of the print medium and the interior range of the print medium, and, each time that electrical change is detected, may set at least one group of nozzles that are not the non-ejecting nozzles and are arranged in a main scanning direction, which is orthogonal to a transport direction, in the uppermost stream of a transport direction, as the non-ejecting nozzle. The image forming apparatus may include a transport unit that carries the print medium in a transport direction, and the control module may control the print head drive module so that the print head ejects the print recording liquid from the nozzles, while controlling the transport unit to carry the print medium, and set at least a group of nozzles that are not the non-ejecting nozzles and are arranged in a main scanning direction, which is orthogonal to the transport direction, in the uppermost stream of the transport direction, as the non-ejecting nozzles, and controls the transport unit the print head drive module to carry a print medium and eject the print recording liquid for the subsequent printing based on the setting.

In the image forming apparatus of the invention, the control module may control the print head drive module so that the print head ejects the print recording liquid from the nozzles to the immediate exterior range adjacent to the rear edge and the interior range over the print medium, and may set the number of nozzles to be set as the non-ejecting nozzle based on electrical change detected by the electrical change detection module. Here, the control module may set the number of nozzles to be set as the non-ejecting nozzle so that the number of non-ejecting nozzles increases as electrical change detected by the degree of electrical change detection module increases.

In one modified structure of the image forming apparatus of the invention, the electrical change detection module detect electrical change when the print recording liquid is ejected to a specific area of the print recording liquid receiving area, which includes an immediate exterior range adjacent to the rear edge of the print medium and an interior range over the print medium, and the control module determines position of a rear edge of the print medium based on the detected electrical change. In the image forming apparatus of this modified structure, the print head may include a nozzle array in which the plurality of nozzles is arranged in a transport direction of the print medium, and, in the course of controlling the print head drive module so that the print head ejects the print recording liquid to the predetermined area, which includes the immediate exterior range adjacent to the rear edge of the print medium and the interior range over the print medium, the control module may control the print head drive module to sequentially switch the nozzles in the nozzle array, from which the print recording liquid is ejected, in the direction from a nozzle above the immediate exterior range adjacent to the rear edge of the print medium to a nozzle above the interior range over the print medium and to eject the print recording liquid onto the print medium, which is fixed in the state that the print recording liquid ejected from the nozzles included in the nozzle array can reach, and determine the position of the rear edge of the print medium based on position where electrical change has ceased to be detected.

In the image forming apparatus of the invention, the print head drive module may cause the print head to move in the main scanning direction, and the control module may control the print head drive module so that the print recording liquid is ejected while the print head is moving over the immediate exterior range adjacent to the rear edge of the print medium and the interior range over the print medium in the main scanning direction.

In the image forming apparatus of the invention, the control module may control the print head drive module so that the print head ejects the print recording liquid from the nozzles based on the electrical change detected by the electrical change detection module, so as to allow borderfree printing on the print medium.

In the image forming apparatus of the invention, the control module may perform an examination as to whether or not the print recording liquid is ejected from the nozzles in a normal manner, based on electrical change detected by the electrical change detection module when the print head is controlled to eject print recording liquid from each of the plurality of nozzles to the print recording liquid receiving area.

In the image forming apparatus of the invention, the print head may accommodate the print recording liquid in a variety of colors, and the control module may control the print head drive module so that the print head ejects the print recording liquid of a specific color that is not easy to view, when ejecting the print recording liquid from the nozzles to the specific area of the print recording liquid receiving area, which includes the exterior range outside the edge of the print medium and the interior range over the print medium. Here, "the print recording liquid of a specific color that is not easy to view" is, for example, a print recording liquid of yellow, light cyan, or light magenta, water, or a transparent and colorless clear ink for gloss and shininess.

In the image forming apparatus of the invention, the print recording liquid receiving area may be defined as an area extending over almost the entire printable area on a platen, and the electrical change detection module may detect electrical changes over almost the entire printable area of the platen.

The image forming apparatus of the invention may further include a potential difference generation module that generates a predetermined potential difference between the print head and the print recording liquid receiving area and charges the print recording liquid in advance of ejection from the nozzles, and when the control module controls the print head drive module so that the print head ejects from the nozzles the print recording liquid to the specific area of the print recording liquid receiving area, which include the exterior range outside the print medium and the interior range over the print medium, the control module may control the potential difference generation module to generate the predetermined potential difference between the print head and the print recording liquid receiving area, and charge the print recording liquid in advance of ejection from the nozzles.

In the image forming method of the invention described above, various aspects of the image forming apparatus described above may be adopted or any step of implementing each function of the image forming apparatus described above may be added.

A program of the present invention is designed to have one or more computers execute each step of any of the image forming methods described above. The program may be recorded in a computer readable recording medium (e.g., a hard disk, a ROM, a FD, a CD, a DVD) or may be delivered from one computer to another via a transmission medium (a communication network such as the Internet or a LAN), or may be given or received in any other form. Having one or more computers execute the program, respective steps of the image forming method described above are executed, thereby achieving similar effects to those of the image forming methods.

BRIEF DESCRIPTION OF THE DRAWINGS

FIG. 9 (a) is a view before ink is ejected, FIG. 9 (b) is a view immediately after ink has been ejected, and FIG. 9 (c) is a view when ink lands.

FIG. 11 (a) is a view illustrating a ejecting nozzle that is offset from the front edge by a distance of three nozzles. FIG. 11 (b) is a view illustrating a ejecting nozzle that is offset from the front edge by a distance of two nozzles. FIG. 11 (c) is a view illustrating a ejecting nozzle that is offset from the front edge by a distance of one nozzle. FIG. 11(*d*) is a view illustrating a ejecting nozzle situated on the front edge.

FIG. 15 (a) is a view illustrating a ejecting nozzle that is offset from the front edge by a distance of three nozzles. FIG. 15 (b) is a view illustrating a ejecting nozzle that is offset from the front edge by a distance of two nozzles. FIG. 15 (c) is a view illustrating a ejecting nozzle that is offset from the front edge by a distance of one nozzle. FIG. 15 (d) is a view illustrating a ejecting nozzle on the front edge.

FIG. 17 (a) is a view illustrating a ejecting nozzle that is offset from the first point by a distance of three nozzles. FIG. 17 (b) is a view illustrating a ejecting nozzle that is on the first point. FIG. 17 (c) is a view showing the ejecting nozzle that is offset from the second point by a distance of three nozzles. FIG. 17 (d) is a view illustrating a ejecting nozzle situated on the second point.

FIG. 19 (a) is a view illustrating a print head 24 in a position separated from the right edge. FIG. 19 (b) is a view illustrating a print head adjacent to the right edge. FIG. 19 (c) is a view illustrating an array of nozzles 43Y that has reached the right edge. FIG. 19 (d) is a view illustrating an array of nozzles 43M that has reached the right edge.

FIG. 20 (a) is a view illustrating a print head 24 on the recording sheet S. FIG. 20(*b*) is a view illustrating an array of nozzles 43Y in a position separated from the left edge. FIG. 20 (c) is a view illustrating an array of nozzles 43M separated from the left edge. FIG. 20 (d) is a view illustrating an array of nozzles 43C separated from the left edge.

FIG. 21 (a) is a view illustrating a print head 24 separated from the right edge. FIG. 21 (b) is a view illustrating a nozzle 23D adjacent to the right edge. FIG. 21 (c) is a view illustrating a nozzle 23D that has reached the right edge. FIG. 21 (d) is a view illustrating an array of nozzles 43M that has reached the right edge.

FIG. 23 (a) is a view before a non-ejecting nozzle 23*ph* is set. FIG. 23 (b) is a view illustrating a group of nozzles where n=180 is set to the non-ejecting nozzle 23*ph*. FIG. 23 (c) is a view illustrating a group of nozzles where n=178 is set to the non-ejecting nozzle 23*ph*. FIGS. 23 (d) and (e) illustrating a group of nozzles where n=177 is set to the non-ejecting nozzle 23*ph*.

FIG. 24 (a) is a view before a non-ejecting nozzle 23*ph* is set. FIG. 24 (b) is a view illustrating a group of nozzles where n=180 is set to the non-ejecting nozzle 23*ph*. FIG. 24 (c) is a view illustrating a group of nozzles where n=179 is set to the non-ejecting nozzle 23*ph*.

FIG. 25 (a) is a view before the non-ejecting nozzle 23*ph* is set. FIG. 25 (b) is a view illustrating a group of nozzles where n=180, 179 is set to the non-ejecting nozzle 23*ph*. FIG. 25 (c) is a view illustrating a group of nozzles where n=178 is set to the non-ejecting nozzle 23*ph*. FIG. 25 (d) is a view illustrating a group of nozzles where n=177 is set to the non-ejecting nozzle 23*ph*.

FIG. 27 (a) is a view illustrating the ejecting nozzle being offset from the rear edge by a distance of three nozzles. FIG. 27 (b) is a view illustrating the ejecting nozzle being offset from the rear edge by a distance of one nozzle. FIG. 27 (c) is a view illustrating the ejecting nozzle on the rear edge. FIG. 27 (d) is a view in which the non-ejecting nozzle 23*ph* is set.

DESCRIPTION OF THE PREFERRED EMBODIMENT

The best embodiment for implementing the present invention will be described with reference to the drawings.

Figure 1:
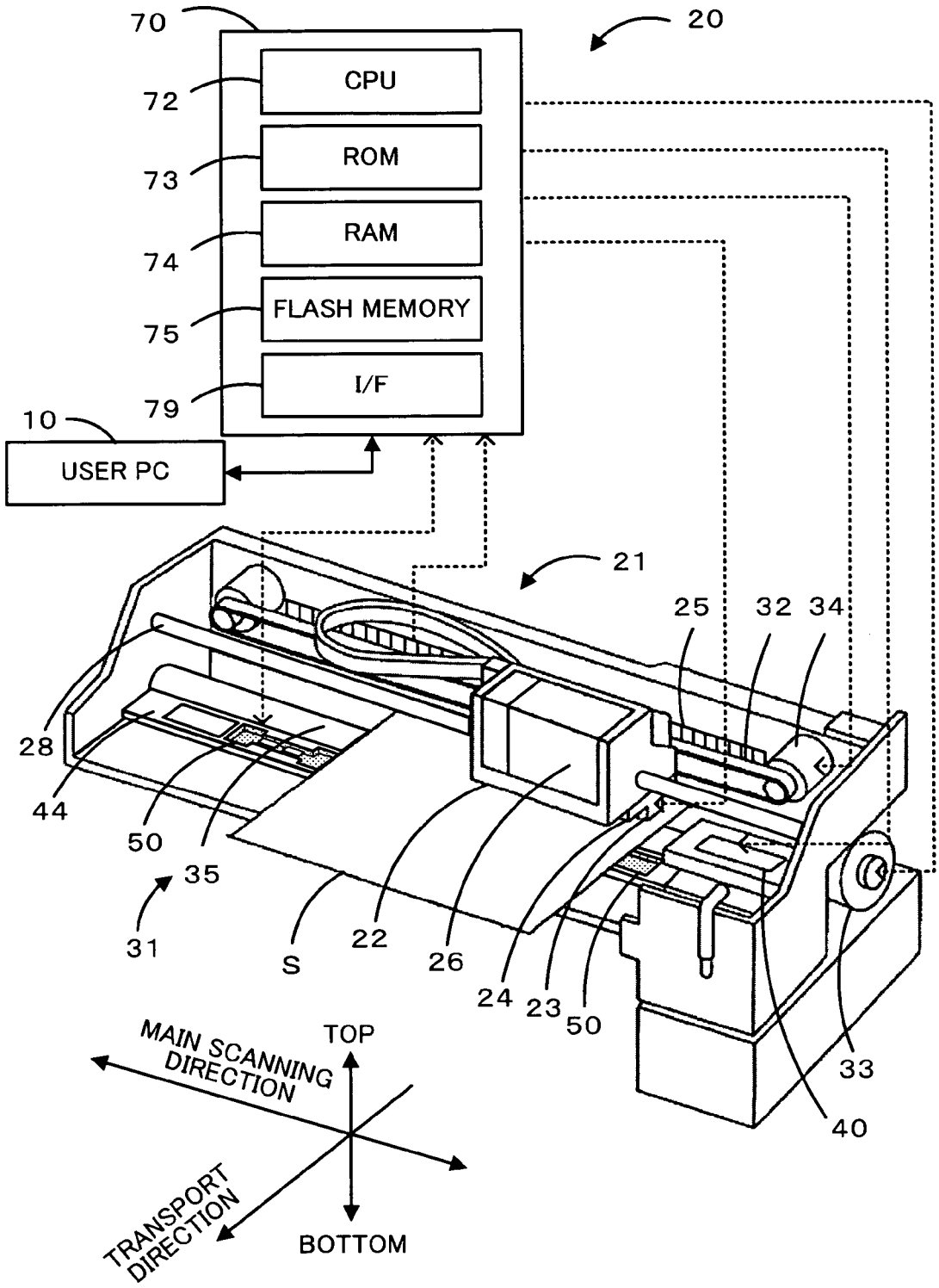
FIG. 1 is a block diagram of an ink jet printer 20.
Figure 2:
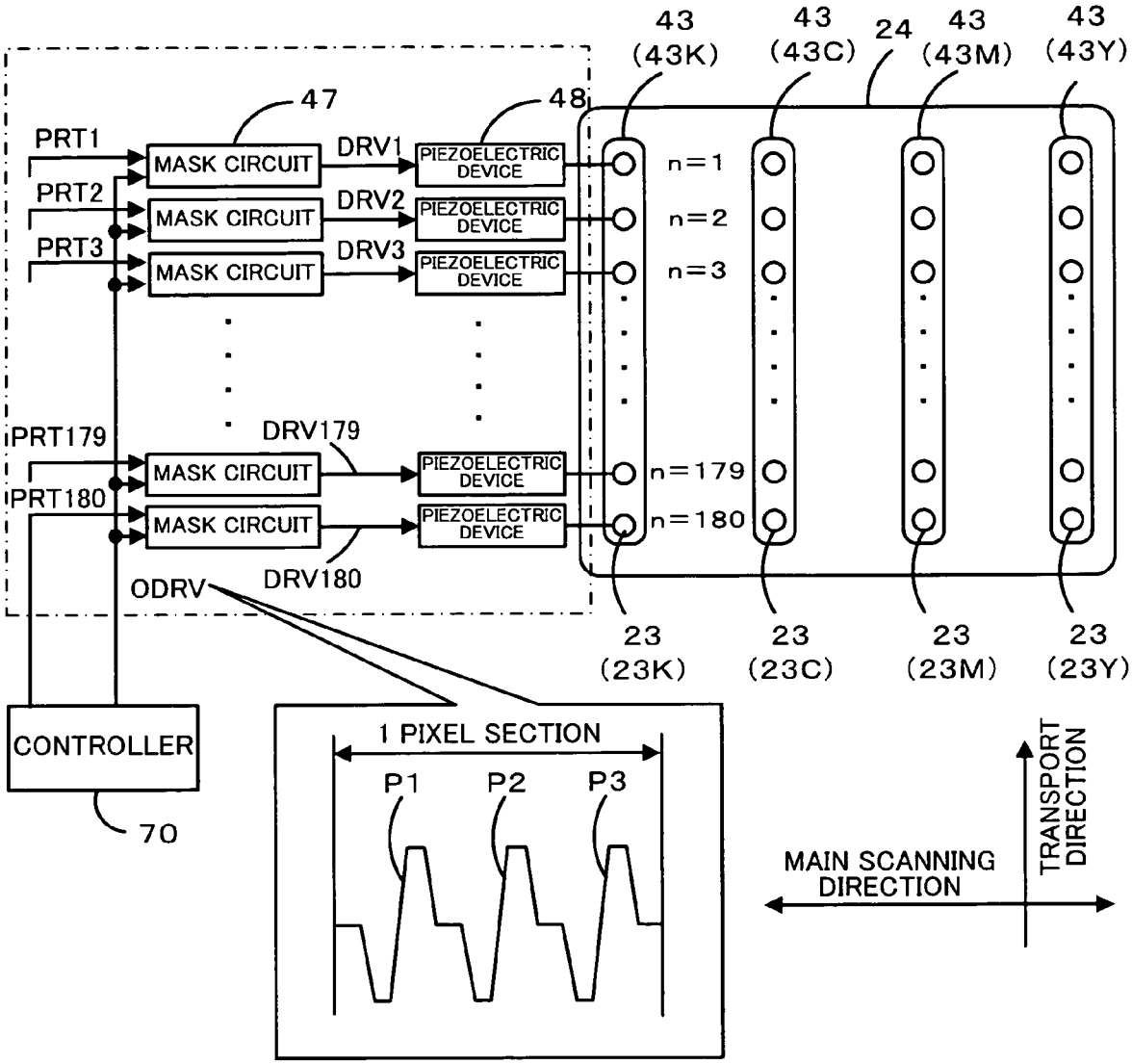
FIG. 2 is an illustrative diagram of a print head 24.
Figure 3:
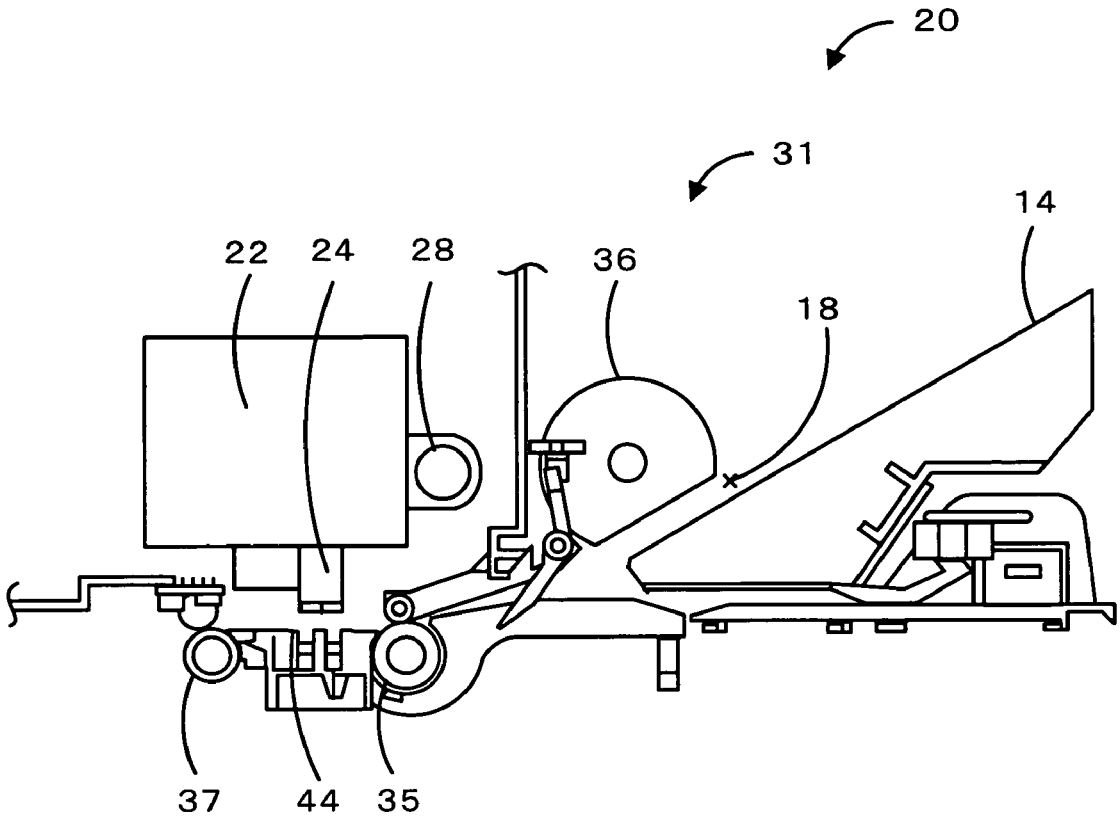
FIG. 3 is an illustrative diagram of a paper feed mechanism 31.
Figure 4:
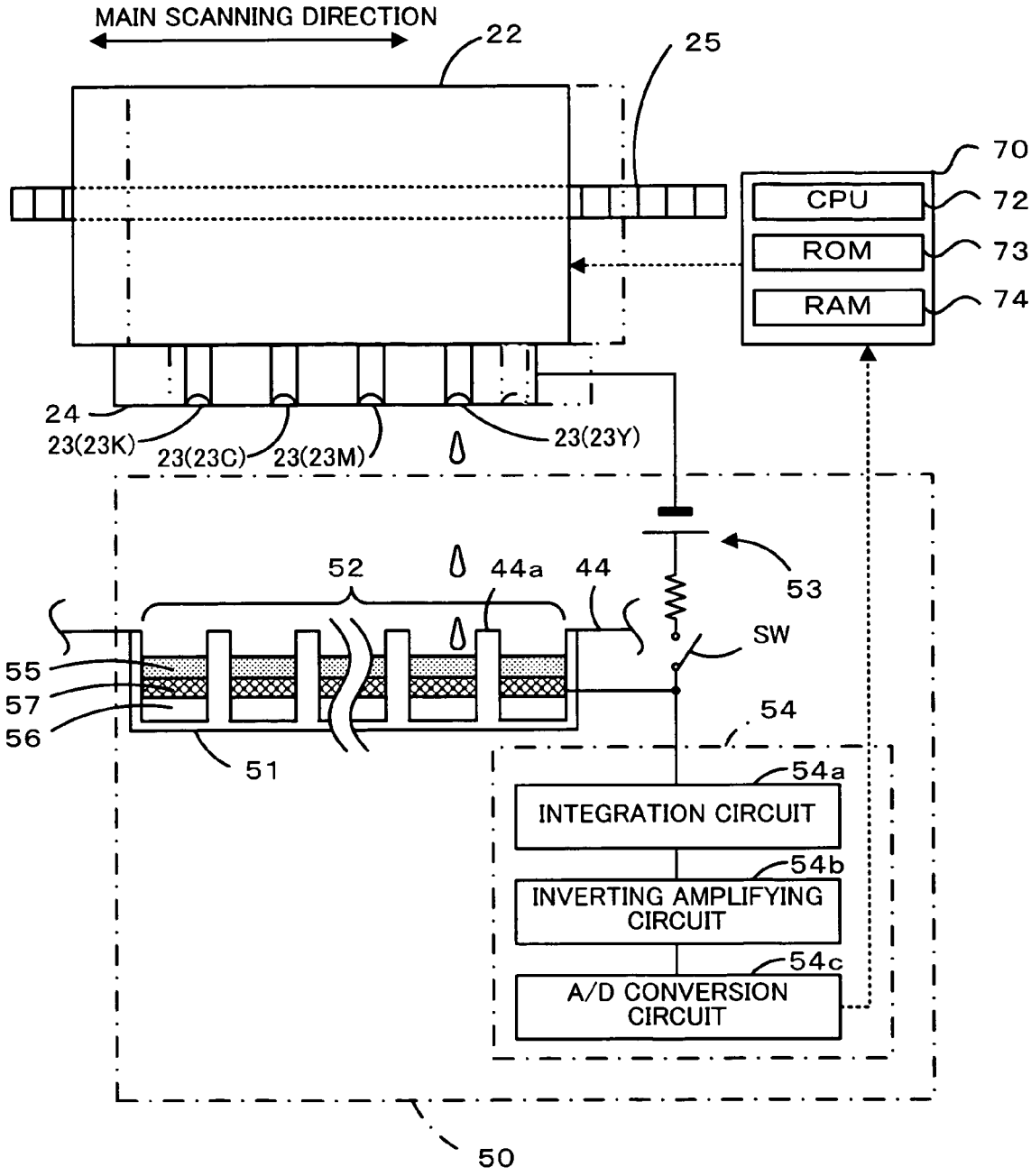
FIG. 4 is a block diagram illustrating an outline of a configuration of a recording sheet edge detection unit 50.
Figure 5:
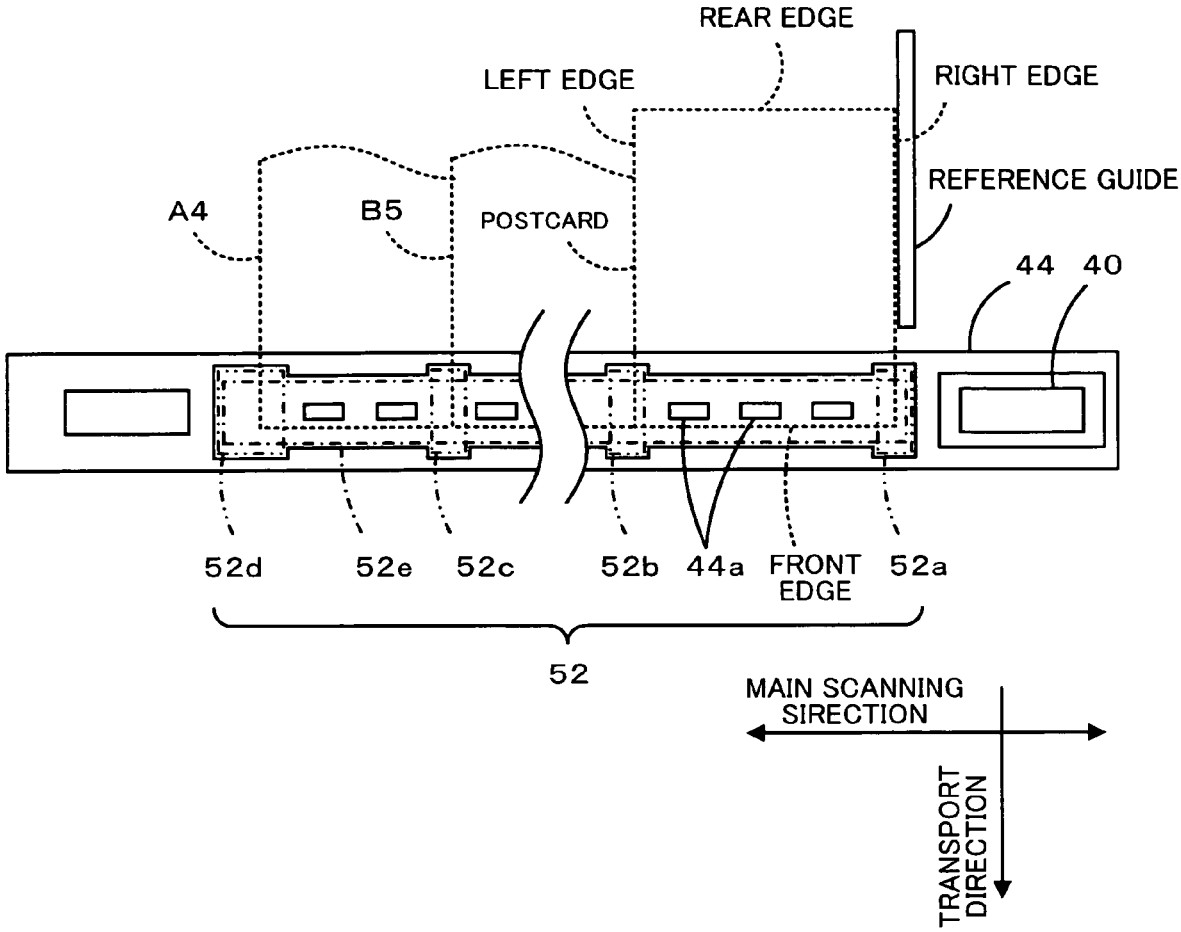
FIG. 5 is a top view of a platen 44.

FIG. 1 is a block diagram schematically illustrating a configuration of an ink jet printer 20 including a recording sheet edge detection unit 50 that is one embodiment of the invention. FIG. 2 is an illustrative diagram of a print head 24. FIG. 3 is an illustrative diagram of a paper handling mechanism 31. FIG. 4 is a block diagram schematically illustrating a configuration of the recording sheet edge detection unit. FIG. 5 is a top view of a platen 44.

As shown in FIG. 1, the ink jet printer 20 of this embodiment includes a printer mechanism 21, which includes the print head 24 and a carriage 22, etc., the paper handling mechanism 31 including a line feed roller 35 driven by a drive motor 33, the recording sheet edge detection unit 50 that is formed over almost the entire area of a printable area on the platen 44 and that detects an edge of a recording sheet S on the basis of whether or not any ink droplets have landed, a cap unit 40 formed adjacent to the right edge of the platen 44, and a controller 70 for controlling the overall ink jet printer 20. Although the configuration constituting the core of the present invention is the recording sheet edge detection unit 50 and the print head 24, other components will be explained in order.

In the present embodiment, for convenience of description, as shown in FIG. 5, a print side of a recording sheet is referred as a top face, the edge on the side of the cap unit 40, which is a home position of the print head 24, is referred as the right edge of the recording sheet S, the edge on the other side is referred as the left edge of the recording sheet S, the head in the transport direction is referred as the front edge of the recording sheet S, and the tail in the transport direction is referred as the rear edge of the recording sheet S.

The printer mechanism 21 further includes a carriage 22 that reciprocates in a horizontal direction, which is the main scanning direction, alongside a guide 28, by means of a carriage belt 32 and a carriage motor 34; ink cartridges 26 mounted on the carriage 22 and containing separately inks colored yellow (Y), magenta (M), cyan (C), and black (K); a print head 24 for applying pressure to each ink supplied from the respective ink cartridges 26, a nozzle 23 for ejecting onto a recording sheet S ink droplets pressurized by the print head 24, and a platen 44 that serves as a support member for supporting a recording sheet S that is being printed. In the vicinity of the carriage 22 is positioned a linear type encoder 25 for detecting a position of the carriage 22, and use of the linear type encoder enables the position of the carriage 22 to be managed. The ink cartridges 26 are constructed as containers (not shown) that contain respectively inks as print recording liquids, such as cyan (C), magenta (M), yellow (Y) and black (K) in which water acting as a solvent contains dyes or pigments as colorants and that are detachably attached to the carriage 22.

As many components (such as the carriage 22) of the print mechanism 21 are well known, an elaborate description of those components will be omitted, and only a print head closely associate a with the present invention will be described. As shown in FIG. 2, the print head 24 includes an array of nozzles 43 in each of which a plurality of nozzles 23 is arranged for ejecting ink of the respective colors of cyan (C), magenta (M), yellow (Y) and black (K). Herein, all nozzles will be collectively referred as nozzles 23, and every array of the nozzles will be referred to as an array of nozzles 43. Nozzles of cyan ink, and the array of nozzles of cyan as nozzles 23C and the array of nozzles 43C, nozzles of magenta ink, and the array of nozzles of magenta ink, are respectively referred to as the nozzles 23M and the array of nozzles 43M, and nozzles of yellow ink, and the array of nozzles of yellow ink, are respectively referred as the nozzle 23Y and the array of nozzles 43Y, and nozzles of black ink, and the array of nozzles of black ink, as respectively referred to as the nozzles 23K and the array of nozzles 43K. In the following description, nozzle 23K will be used as an example. In the print head 24, 180 nozzles 23K, arranged along the transport direction of a recording sheet S, make up the array of nozzles 43K. The nozzles 23K has a piezoelectric device 48 for ejecting ink droplets. Application of voltage to the piezoelectric device deforms the piezoelectric device 48 and pressurizes ink, and thus the ink is ejected from the nozzle 23K.

The print head 24 includes a plurality of mask circuits 47 provided to correspond to a plurality of piezoelectric devices that respectively drive the respective nozzles 23K. An original signal ODRV, or a print signal PRTn, generated at the controller 70 is inputted into the mask circuits 47. The character n at the end of the print signal PRTn is a number used to specify a nozzle included in an array of nozzles, and since in this embodiment the array of nozzles is comprised of 180 nozzles, n can be any integer of between 1 and 180. As shown in the lower part of FIG. 2, the original signal ODRV consists of three drive waveforms of a first pulse P1, a second pulse P2, and a third pulse P3 in a section of one pixel (within the time in which the carriage 22 traverses a spacing of one pixel). In this embodiment, as one segment, the original ODRV having the three drive waveforms is described as a unit of repetition. When the original signal ODRZ or print signal PRTn is entered, the mask circuit 47 outputs towards the piezoelectric device 48 of the nozzle 23K a pulse that is required, from among the first pulse P1, the second pulse P2, and the third pulse P3, as a drive signal DRVn ("n" means the same as that of the print signal PRTn) based on the entered signals. More specifically, when the mask circuit 47 outputs to the piezoelectric device 48 only the first pulse P1, the nozzle 23K ejects one shot of ink droplets, thus forming a small-sized dot (a small dot) on a recording sheet S. When the mask circuit 47 outputs to the piezoelectric device 48 the first pulse P1 and the second pulse P2, the nozzle 23K ejects two shots of ink droplets, thus forming a medium-sized dot (a medium dot) on a recording sheet S. Furthermore, when the mask circuit 47 outputs to the piezoelectric device 48 the first pulse P1, the second pulse P2, and the third pulse P3, the nozzle 23K ejects three shots of ink droplets, thus forming a large-sized dot (a large dot) on a recording sheet S. Thus, by adjustment of the amount of ink ejected in one pixel section the ink jet printer 20 can form three sizes of dots. As in the case of the nozzle 23K, or the array of nozzles 43K described above, the same process can also be applied to the nozzles 23C, 23M, 23Y, or to the arrays of nozzles 43C, 43M and 43Y. The method of deforming the piezoelectric device 48 and pressurizing ink has been adopted herein, however, ink may be heated and pressurized by air bubbles generated by applying voltage to a heat element (such as a heater).

As shown in FIG. 3, the paper handling mechanism 31 comprises a recording sheet insertion port 18 through which recording sheets S placed on a paper feed tray 14 are inserted; a paper feed roller 36 for supplying to the print head 24 recording sheets S placed on the paper feed tray 14; a line feed roller 35 for carrying recording sheets S to the print head; and a paper eject roller 37 for ejecting printed recording sheets S. The paper feed roller 36, the line feed roller 35, and the paper eject roller 37 are driven by the drive motor 33 (see FIG. 1) by way of a gear mechanism (not shown). The line feed roller 35 and the paper feed roller 36 are configured so as to be reversibly driven by the drive motor 33. For instance, when a recording sheet S is fed at an angle, they can feed it back to the paper feed tray 14. Further, a rotating drive force of the paper feed roller 36 and a frictional resistance of a separating pad (not shown) prevent more than one recording sheet S from being fed.

As shown in FIG. 4, the recording sheet edge detection unit 50 comprises a detection box 51 onto which ink droplets jetted from the nozzles 23 of the print head 24 can land; an ink receiving area 52 provided in the detection box 51 and positioned at a determined distance from the print head 24; a voltage application circuit 53 for applying voltage between the ink receiving area 52 and the print head 24; and a voltage detection circuit 54 for detecting voltage of the ink receiving area 52. The detection box 51 is an open-topped case provided across the printable area defined from the left end to the right end of the platen 44 so that recording sheets ranging from a postcard-sized recording sheet to an A-4 sized recording sheet can be printed. The ink receiving area 52 serves to absorb ink droplets ejected on any area other than a recording sheet when borderfree printing is performed, and serves to detect any induced voltage caused by electrostatic induction that results from the ejecting of ink droplets from the print head. As shown in FIG. 5, when borderfree printing takes place, first to fourth edge ink absorbing areas 52*a* to 52*d* are formed for absorbing any overflow ink from the edges of recording sheets of various sizes; front/rear edge ink absorbing areas 52*e* are formed for absorbing any ink overflowing from a front or a rear edge of a recording sheet when borderfree printing takes place; and a plurality of supporting columns 44*a* is formed for supporting recording sheets that pass through the ink receiving area 52. In this embodiment, it is assumed that three types of recording sheet, i.e., postcard size, B5 size, and A4 size can be accommodated. Moreover, the first edge ink absorbing area 52*a* is defined in such a way that when it is placed along a reference guide provided adjacent to the cap unit 40 the right edge of a recording sheet of every size can pass above it. Further, the second to fourth edge ink absorbing areas 52*b* to 52*d* are defined in such a way that the left edge of recording sheets of postcard size, B5 size and A4 size, respectively, can pass above it. Lengths of the first to fourth edge ink absorbing areas 52*a* to 52*d* in the transport direction are designed to be greater than those of the array of nozzles 43. In addition, the front/rear edge ink absorbing area 52*e* is designed to be at a size greater than the horizontal width A4 size, which represents the largest of the recording sheets, and the supporting column 44*a* is provided in any area other than the first to fourth edge ink absorbing areas 52*a* to 52*d* within the ink receiving area 52, in such a manner that it does not prevent ink from reaching the edge.

As shown in FIG. 4, the ink receiving area 52 is provided within the detection box 51, and comprised of a upper ink absorber 55 on which ink droplets land directly, a lower ink absorber 56 for absorbing ink droplets that penetrate down after landing on the upper ink absorber 55, and a mesh-like electrode member 57 arranged between the upper ink absorber 55 and the lower ink absorber 56. The upper ink absorber 55, whose surface serves as the ink receiving area 52, is formed of conductive sponge so as to have the same potential as the electrode member 57. The sponge should have a high degree of permeability so that ink droplets that have landed can promptly move down, and an ester-type urethane sponge (product name: Ever Light SK-E, manufactured by Bridgestone Corporation) may be used herein. The upper ink absorber 55 may be made of any non-conductive material that can become conductive when being wet with liquid. The lower ink absorber 56 has capability of retaining more ink than the upper ink absorber 55, and is manufactured with a nonwoven fabric such as felt. A nonwoven fabric (product name: Kinocloth manufactured by OJI KINOCLOTH CO., LTD.) is used herein. The electrode member 57 is formed as a grid-like mesh made of stainless metal (e.g., SUS). Thus, ink that has been absorbed by the upper ink absorber 55 passes through gaps of the mesh-like electrode member 57, and is absorbed and retained in the lower ink absorber 56.

The voltage application circuit 53 electrically connects the electrode member 57 and the print head 24 by way of a direct-current power source (e.g, 400V) and a resistance element (e.g., 1 M ohm) so that the former will be a positive electrode and the latter a negative electrode. As the electrode member 57 is in contact with the upper ink absorber 55, the surface of the upper ink absorber 55, namely, the entire ink receiving area 52 also has the same potential as the electrode member 57. The voltage application circuit 53 has a switch SW for making and breaking a circuit. The switch is turned ON when a print process routine and a head inspection routine, which will be described below, are executed. Otherwise the switch is turned OFF. The voltage detection circuit 54 is connected so that it can detect voltage of the electrode member 57 that is considered the same as that of the ink receiving area 52. The voltage detection circuit 54 comprises an integration circuit 54*a* that integrates and outputs a voltage signal of the electrode member 57, an inverting amplifying circuit 54*b* that inverts, amplifies, and outputs the signal outputted from the integration circuit 54*a*, and an A/D conversion circuit 54*c* that A/D converts the signal outputted from the inverting amplifying circuit 54*b* and outputs it to the controller. Since a degree of changes in voltage resulting from jetting and landing of one ink droplet is small, the integration circuit 54*a* outputs a large degree of change in voltage by integrating voltage changes caused by the jetting and landing of a plurality of ink droplets ejected from the same nozzles 23. The inverting amplifying circuit 54*b* inverts the positive and negative of voltage changes and amplifies and outputs signals outputted from the integration circuit, at a predetermined amplification factor that depends on the circuit configuration.

The A/D conversion circuit 54*c* converts an analog signal outputted from the inverting amplifying circuit 54*b* into a digital signal and outputs the digital signal to the controller 70.

As shown in FIG. 1, the cap unit 40 is used to seal off the nozzles 23 to prevent the nozzles 23 from being dried during periods when printing is halted. The cap unit 40 is operated to cover a nozzle forming surface of the print head 24 when the print head 24 travels with the carriage 22 to the right end (referred to as a home position). Furthermore, a suction pump (not shown) is connected to the cap unit 40. When ink blockage in a nozzle is detected by the recording sheet edge detection unit 50, the suction pump causes negative pressure that acts on the nozzle forming surface of the print head 24 sealed by the cap unit 40, and thus ink that has been blocked is drawn out and ejected from the nozzles 23. Any discarded ink that is thus sucked and ejected is accumulated in a waste liquid tank.

As shown in FIG. 1, the controller 70 is constructed as a microprocessor centered on a CPU 72, and comprises a ROM 73 that contains various types of processing programs, a RAM 74 that temporarily stores or saves data, a flash memory 75 into and from which data can be written or erased, an interface (I/F) 79 for exchanging information with external devices, and an input/output port (not shown). The ROM 73 stores various process programs, such as a main routine or a head inspection routine, and a print process routine, and of which will be discussed below. The RAM 74 includes a print buffer area that stores print data to be transmitted from a user PC 10 through I/F 79. The controller 70 inputs a voltage signal from the voltage detection circuit 54 of the recording sheet edge detection unit 50, and a position signal from a linear type encoder 25, etc. through an unillustrated input port, as well as a print job from a user PC 10, through the I/F 79. The controller outputs control signals to the print head 24 (including the mask circuit 47 and the piezoelectric device 48) and the drive motor 33, a drive signal to the carriage motor 34, an operation control signal to the cap unit 40, etc. through an unillustrated output port, a well as print status information to the user PC through the I/F 79.

Figure 6:
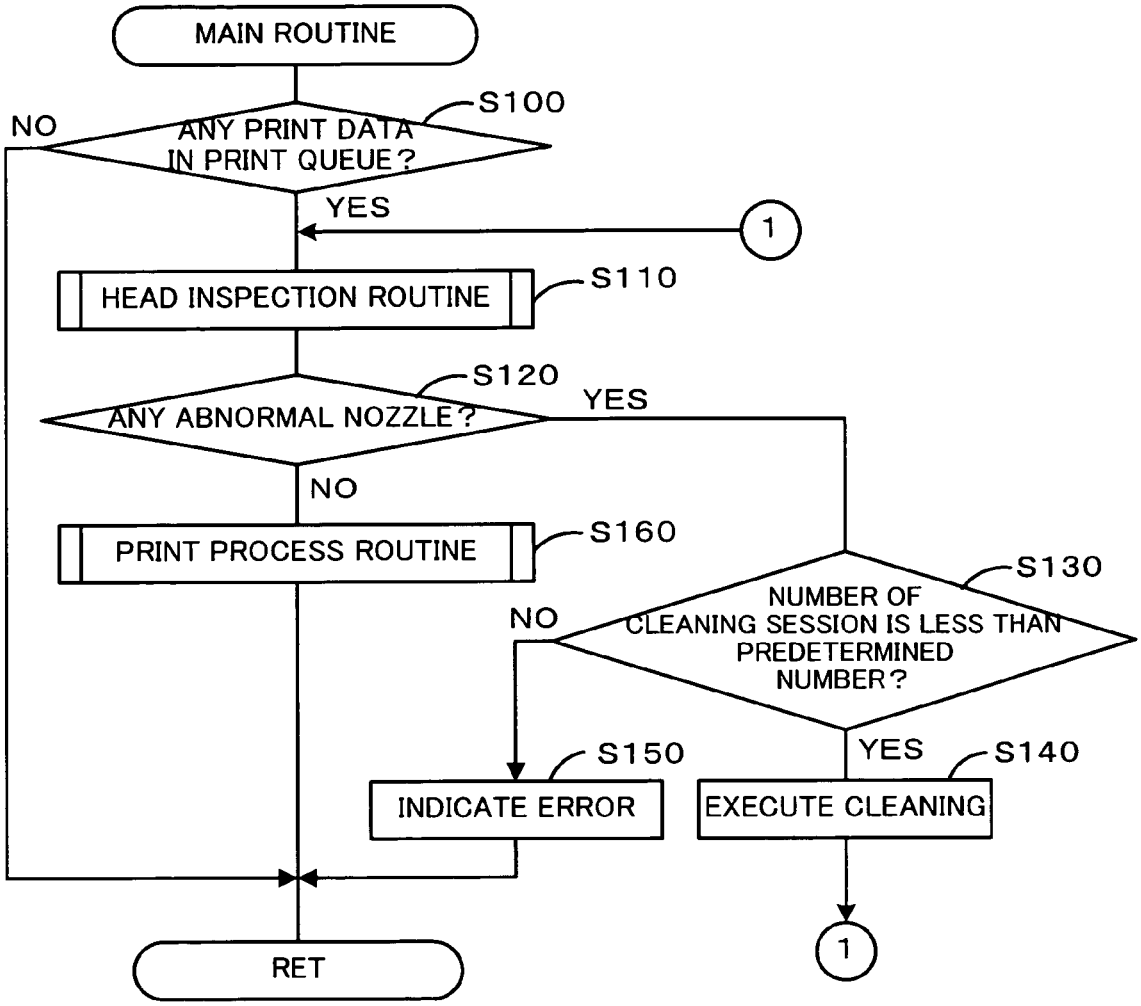
FIG. 6 is a flow chart of a main routine.

Next, an operation of the ink jet printer 20 of the embodiment that is thus been configured will be described. First, an operation of a main routine will be described. FIG. 6 is a flow chart of a main routine that is executed by the CPU 72 of the controller 70. The routine is stored in the ROM 73 and executed by the CPU 72 at predetermined timings (for instance, every few msecs) after the ink jet printer 20 has been turned ON. After the routine has been started, the CPU 72 determines first whether or not there is any print data in print queue (Step S100). Any print data received from the user PC 10 is stored in a print buffer area of the RAM 74 and is put in a print queue. When print data is received, the received print data is put in a print queue when the ink jet printer 20 is under operation of printing, and when the print data is immediately printable. When no print data awaits printing in step S100, the routine just ends. On the one hand, when there is a print data in print queue, a head inspection routine is subsequently executed (Step S110).

Figure 7:
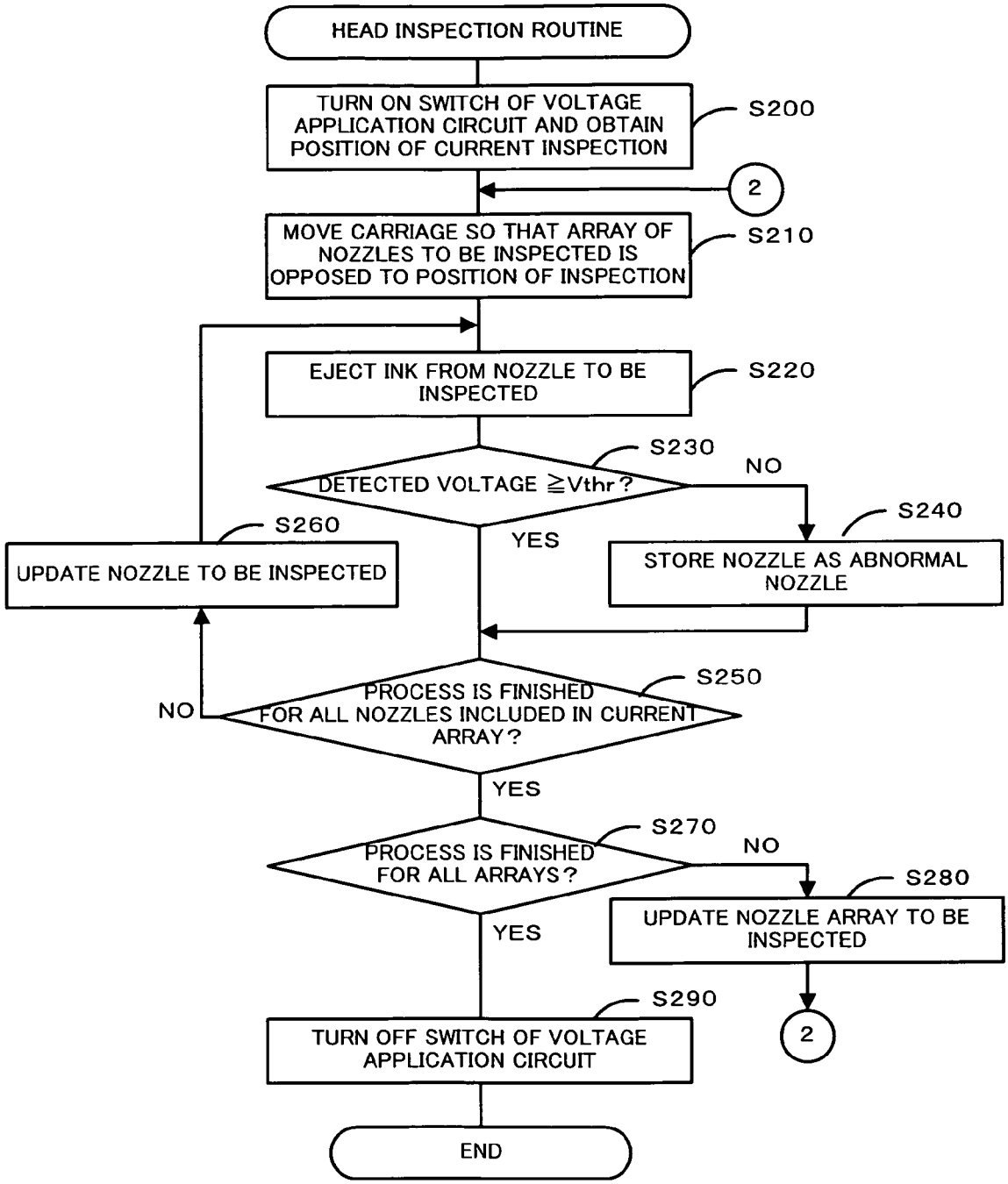
FIG. 7 is a flow chart of a head inspection routine.
Figure 8:
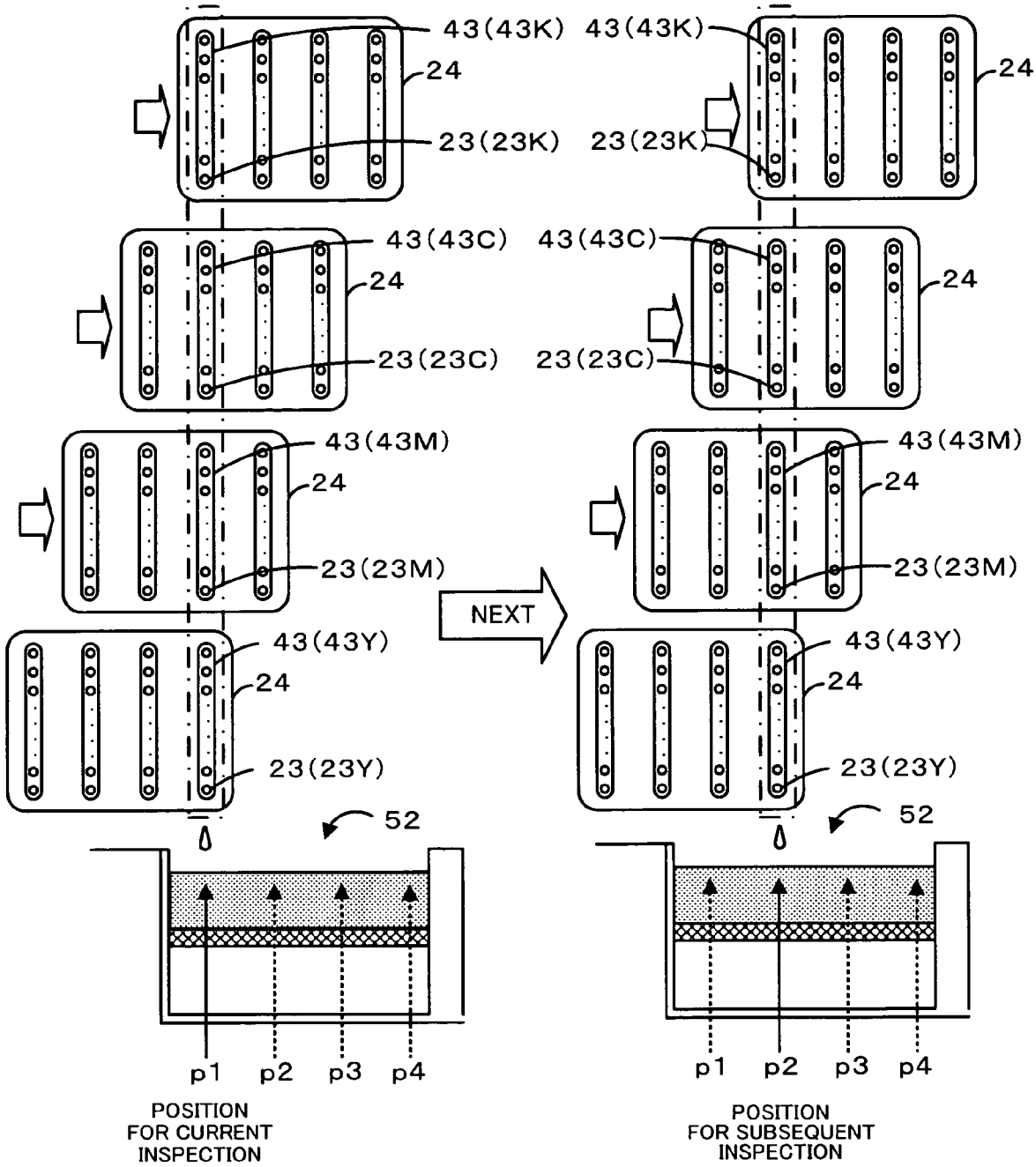
FIG. 8 is an illustrative diagram of an inspection position in head inspection process.

Next, the head inspection routine will be described. As shown in FIG. 7, the routine is a process stored in the ROM 73 and the purpose is to inspect whether or not there is any blockage in any of the nozzles 23 arranged in the print head 24. When the routine is started, the CPU 72 turns on the switch SW of the voltage application circuit 53, and acquires an inspection position for the current inspection, that is a position in the ink receiving area onto which the nozzles 23 eject ink (step S200). The inspection position is set in the first to fourth edge ink absorbing areas 52*a* to 52*d* within the ink receiving area 52, however, the positions vary for each inspection because any solid matter contained in ink, which is ejected for an inspection, may deposit on the surface of the ink receiving area 52. FIG. 8 is an illustrative diagram of inspection positions in the head inspection process. In FIG. 8, a plurality of inspection positions p1, p2, p3, and p4 is set, and ink is ejected to the same inspection positions within the respective arrays of nozzles 43 for one inspection, in order to avoid possible variations in detected values of induced voltage caused by any differences in the inspection positions. Further, a subsequent inspection position is different from the current inspection position, so that solid matter in the ink does not deposit on any one specific inspection position.

The CPU 72 moves the carriage 22 by driving the carriage motor 34, in such a way that among the arrays of nozzles 43 of the print head, the array of nozzles 43 to be inspected is opposed to the current inspection position (step S210). From one nozzle 23 in the array of nozzles 43, charged ink droplets is ejected through the mask circuit 47 and the piezoelectric device 48 (see FIG. 2) (Step S220).

Figure 9:
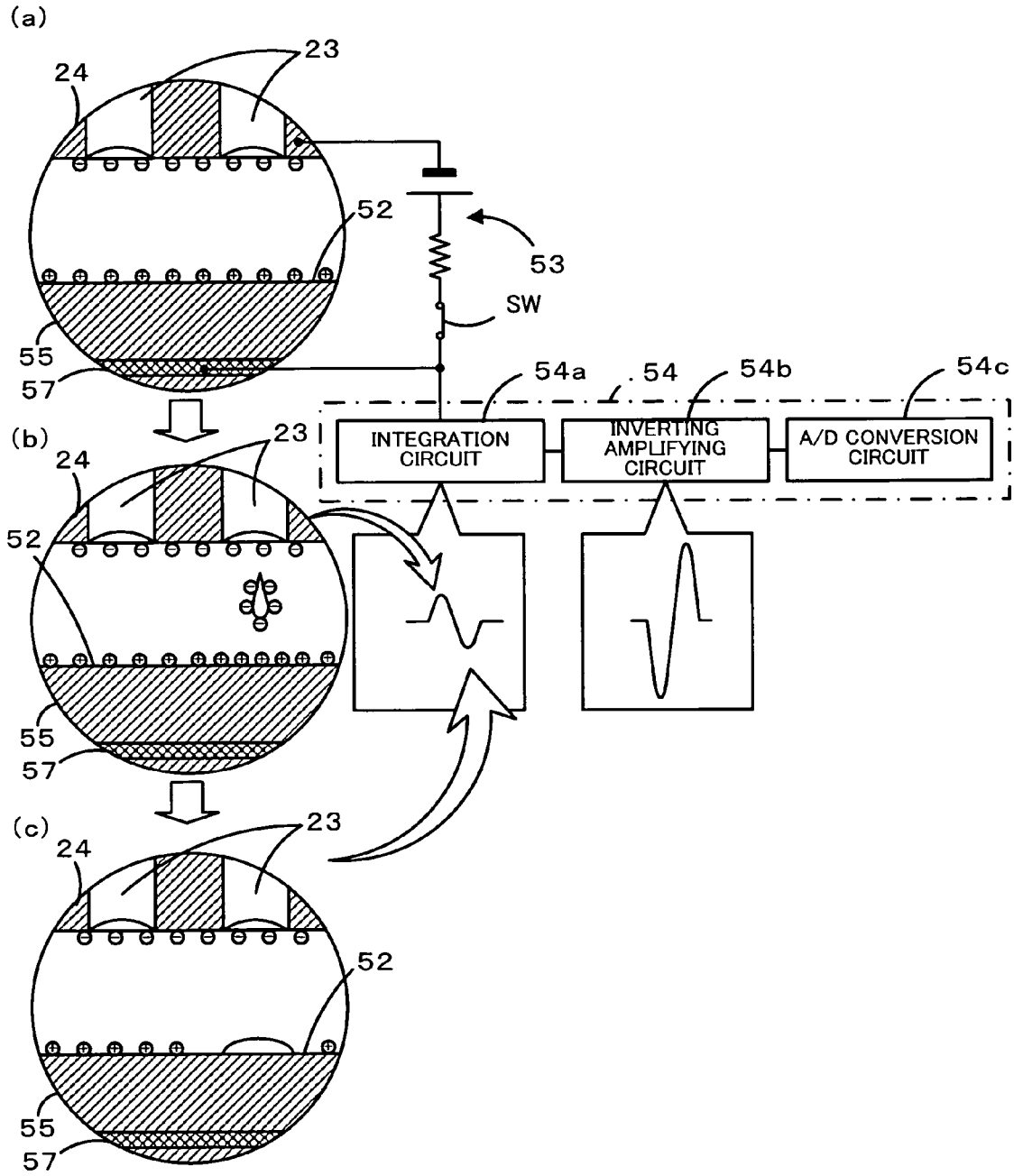
FIG. 9 is an illustrative diagram of the principle that voltage change is generated when ink is ejected.

With reference to FIG. 9, a description will now be given of a possible transition in voltage in the electrode member 57 when charged ink droplets are jetted from the nozzle 23 of the print head 23 and reach the upper ink absorber 55 on the ink receiving area 52. FIG. 9 is an illustrative diagram of the principle that voltage change occurs when ink is ejected. FIG. 9 (a) is an illustrative diagram before ink droplets are jetted from the nozzles 23. FIG. 9 (b) is an illustrative diagram of a time when ink droplets are being jetted from the nozzles 23. FIG. 9 (c) is an illustrative diagram of a time when ink droplets land on the ink receiving area 52. It can be assumed that voltage change in the ink receiving area is caused by what is described below. As shown in FIG. 9 (a), ink droplets before being jetted from the nozzles 23 in the print head 24 are negatively charged by the voltage application circuit 53. Furthermore, a predetermined electric field strength exists between the print head 24 and the ink receiving area 52 because they are spaced at a distance and a predetermined potential difference is generated between them. Thus, as shown in FIG. 9 (b), as the negatively charged ink droplets are jetted from the nozzles 23 and approach the upper ink absorber 55, electrostatic induction reinforces the positive electric charge on the surface of the upper ink absorber 55. As a result, due to the induced voltage caused by the electrostatic induction, voltage between the print head 24 and the electrode member 57 should be higher than the initial voltage value. Then, as shown in FIG. 9 (c), when the negatively charged ink droplets reach the upper ink absorber 55, the positive charge on the upper ink absorber 55 should be neutralized by the negative charge of the ink droplets. Consequently, the voltage between the print head 24 and the electrode member 57 should drop below the initial voltage value. Subsequently, the voltage between the print head 24 and the electrode member 57 will return to the value of voltage being applied. At that time, amplitude of an output signal will depend on whether or not there are any jetted ink droplets, and the numbers and sizes thereof, as well as the distance from the print head 24 to the upper ink absorber 55 (ink receiving area 52). Thus, in cases where no ink droplets are jetted because of blocked nozzles 23, or when ink droplets are larger or smaller than a predetermined size, the amplitude of an output signal will become smaller than the amplitude during normal operations. Thus, on the basis of the amplitude of the output signal, it is possible to judge whether or not there is any blockage in the nozzles 23. In this embodiment, since the amplitude of an output signal caused by one shot of ink droplets is extremely small, even though the ink droplets have a predetermined size, one nozzle ejects 24 shots of ink droplets by executing on eight different occasions output of all of the first to third pulses P1, P2, and P3 of one segment representative of a drive waveform. This causes an output signal to be an integration value based on the 24 shots of ink droplets, and a sufficiently large output waveform can thus be obtained from the voltage detection circuit 54. In addition, amplitude of a signal outputted from the voltage detection circuit 54 will be inverted because it runs through the inverting amplifying circuit 54*b* (see FIG. 9).

After the charged ink droplets are ejected from the nozzle 23 of the array of nozzles 43 through the mask circuit 47 or piezoelectric device 48 in step S220, the CPU 72 judges whether or not a maximum value of voltage outputted from the voltage detection circuit 54 exceeds a threshold Vthr (step S230). The threshold Vthr is empirically determined so that the amplitude of the output signal exceeds the value when the 24 shots of ink droplets are ejected normally. When the amplitude of the output signal is less than the threshold Vthr in step S230, it is determined that an abnormality such as blockage of the current nozzles 23 has occurred, and information that specifies the nozzle 23 (e.g., information showing what number of which array of nozzles the nozzle is) is stored in a predetermined area of the RAM 74 (step S240).

After step S240, or when the amplitude of the output signal exceeds the threshold Vthr in step S230 (that is, when the current nozzle 23 is normal), the CPU 72 judges whether or not all the nozzles in the array of nozzles 43 currently being inspected have been examined (step S250). When any unexamined nozzle 23 exists among the array of nozzles being inspected at the time, the nozzle to be inspected is updated to an nozzle that is not examined (step S260), and the processes of steps S220 to S260 are repeated. On the other hand, when all the nozzles 23 included in the array of nozzles at the time under inspection have been examined in step S250, the CPU 72 judges whether or not all the arrays of nozzles included in the print head 24 have been examined (step S270). When there is any unexamined array of nozzles exists, the array of nozzles to be inspected is updated to the array of nozzles that is unexamined (step S280), and then the processes of steps S210 to S280 are repeated. On the other hand, when it is judged that all the arrays of nozzles 43 included in the print head have been examined in step S270, the switch SW of the voltage application circuit 53 is turned OFF (step S290) and the routine ends. In this head inspection routine, when any abnormal nozzle 23 exists among all the nozzles 23 arranged in the print head, information specifying the nozzle 23 is stored in a predetermined area of the RAM 74, and when no abnormal nozzle 23 exists no information is stored.

Returning to the main routine of FIG. 6, after executing of the head inspection routine in step S110, the CPU 72 judges whether or not any abnormal nozzle 23 exists among all the nozzles arranged in the print head 24 based on the data, as the result of the head inspection routine, stored in the predetermined area in the RAM 74 (step S120). When any abnormal nozzle 23 exists, the CPU 72 determines whether or not the number of cleaning sessions of the print head 24 prior to the abnormality is less than a predetermined number (e.g., 3 times) (step S130). Then, when the number of cleaning sessions is less than the predetermined number, the print head 24 is cleaned (step S140). More specifically, the carriage motor 34 is driven so as to move the carriage 22 until the print head 24 reaches a home position that is opposed to the cap unit 40. After the cap unit 40 is operated and covers the nozzle forming surface of the print head 24, negative pressure of the suction pump (not shown) acts on the nozzle forming surface, thereby sucking and ejecting from the nozzles 23 ink that has been blocked. After the cleaning is finished, the process returns to step S110, in order to check whether or not the abnormality in the nozzle 23 has been eliminated. In this step S110, although it is acceptable to reexamine only the abnormal nozzle 23, all the nozzles 23 in the print head 24 need to be reexamined as nozzles 23 that were normal at the time of cleaning may for some reason or another have been blocked. On the one hand, when the number of cleaning sessions exceeds the predetermined number in step S130, it is determined that the abnormal nozzle 23 is not normal even after the cleaning, and an error message is displayed on an operation panel (not shown) (step S150), and the main routine ends. When no abnormal nozzle 23 exists in step S120, the print process routine is executed (step S160) and the main routine is terminated.

The print process routine is a control that is central to the present invention and includes control of ejection of the ink at the front edge, the side edges and the rear edge of a recording sheet S in borderfree printing. In this embodiment, for convenience of description, respective controls of ink ejection around the front edge, side edges and rear edge of a recording sheet S are described separately. First, as a first embodiment, control of ink ejection at the front edge of a recording sheet S is described.

First Embodiment

Figure 10:
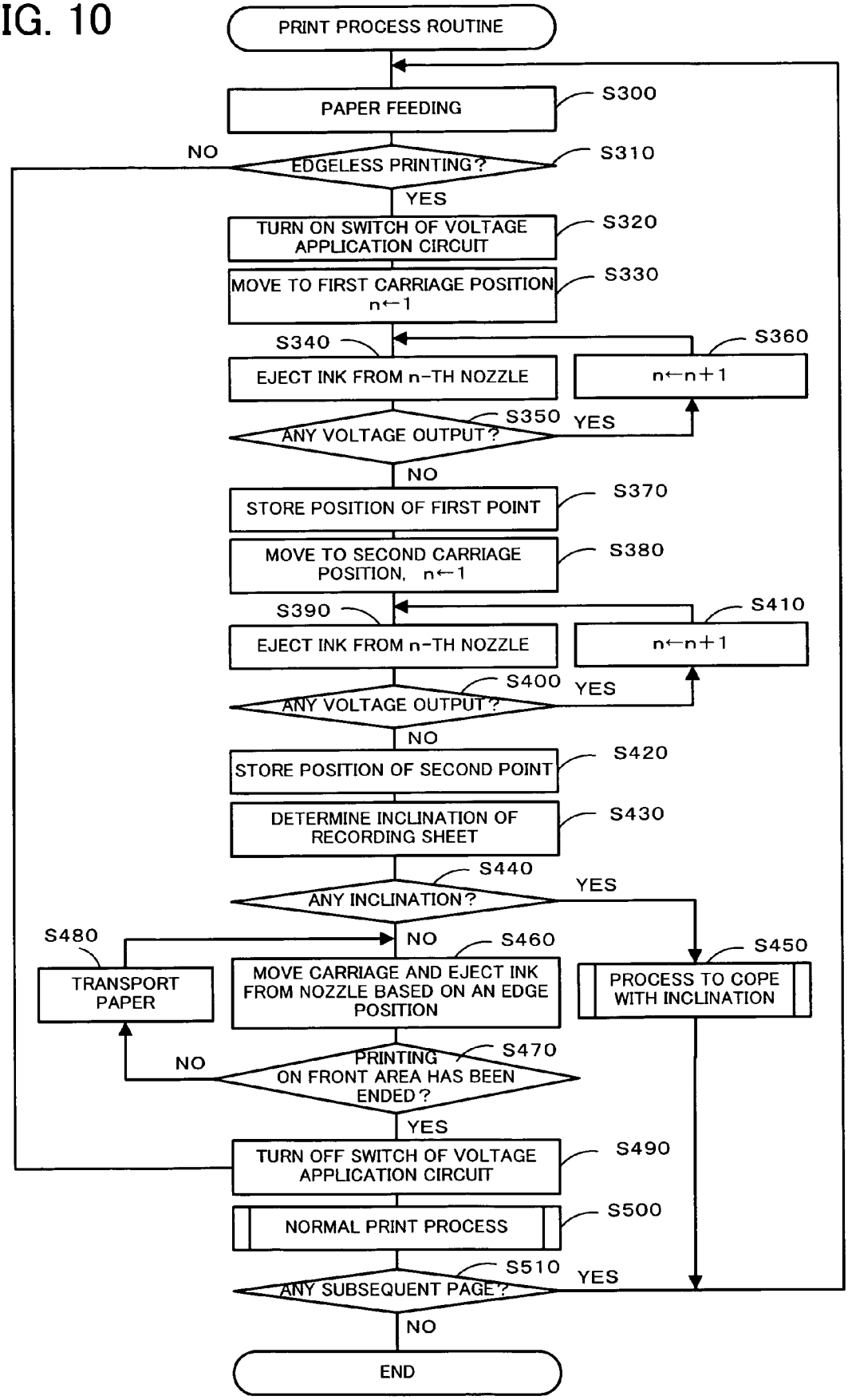
FIG. 10 is a flow chart of a print process routine of a first embodiment.

FIG. 10 is a flow chart of a print process routine for detecting a front edge of a recording sheet S. The case in which a user selects borderfree printing of a recording sheet S of postcard size will be mainly describe. When the print process routine has been started, the CPU 72 executes first the paper feed process (step S300). In the paper feed process, the drive motor 33 rotates and drives the paper feed roller 36 (see FIG. 3) so as to carry a recording sheet S placed on the paper feed tray 14 and position it on the front/rear edge ink absorbing area 52*e* of the platen 44. Next, the feed amount of the paper feed roller 36 is empirically determined so that the recording sheet S is positioned on the front/rear edge ink absorbing area 52*e*, and the paper feed roller 36 is driven so that the amount fed will be the determined amount. When the recording sheet is positioned on the front/rear edge ink absorbing area 52*e*, ink droplets ejected from the nozzle 23 included among the array of nozzles 43 can now reach the area separated from the front edge of the recording sheet and the area covered by the recording sheet S within the front/rear edge ink absorbing area 52*e*.

Then, the CPU 72 determines whether or not the print data is data for borderfree printing (step S310). A determination on whether or not the print data is data for borderfree printing should be made on the basis of information on printing conditions contained in the print data. As a slight deviation in a position of the recording sheet S may occur as a result of a slip of the paper feed roller when paper is fed, when a user selects borderfree printing, the user PC 10 should execute an upsizing process of the image data into image data that larger in size than the size of the recording sheet so that there will be no border on a recording sheet S, and the user PC 10 transmits to the ink jet printer 20 print data containing the image data and information that is data for borderfree printing.

Then, when the print data is not data for borderfree printing in step S310, the CPU 72 executes a normal print process (step S500). Next the normal print process will be described. In the normal print process, the CPU 72 moves the carriage 22 to an ink eject position on the recording sheet that has been fed (a position on the side of the home position in an initial state), and then ejects ink onto the recording sheet S by driving the piezoelectric device 48 on the basis of the print data and moves the carriage 22 in the main scanning direction (direction from the right end towards the left end of the recording sheet). Then, a judgment is made as to whether or not the existing pass has ended. Here a "pass" means one stroke of the print head 24, from one end (for instance, the end on the side of the home position) to the other end of a recording sheet S on the platen 44 in FIG. 1. When the existing pass has been completed, a judgment is then made as to whether or not data exists on a subsequent pass to be printed. When data does exist on the subsequent pass, processing is undertaken to rotate and drive the line feed roller 35, execute a transport process by which a recording sheet S is carried for a predetermined distance, and then execute the process described above so as to drive the piezoelectric device 48, and then eject ink on the recording sheet S based on the print data. When no data exists on a subsequent pass, on the other hand, the CPU 72 executes a paper ejection process whereby the paper eject roller is rotated and driven so as to eject a recording sheet S onto a catch tray. Then, after the normal printing process at step S500, the CPU 72 judges whether or not there is any subsequent page to print (step S510). When any subsequent page for printing exists in step S300 a new recording sheet S is fed. When a judgment is made that the print data is not for borderfree printing in step S310, the normal printing process is executed in step S510 to eject ink onto a recording sheet S. When no subsequent page to print exists in step S510, the print process routine is terminated.

When the print data is for borderfree printing, on the other hand, by turning on the switch SW of the voltage application circuit 53 (step S320) in step S310, the CPU 72 causes the voltage application circuit 53 to generate a predetermined potential difference between the print head 24 and the ink receiving area 52. The CPU 72 causes the carriage motor 34 to move the carriage 22 to a first carriage position where a position of a first of a recording sheet S can be detected and sets to 1 the number of a nozzle n that ejects ink (step S330). When the recording sheet S is positioned along the reference guide (see FIG. 13 to be described later), the first carriage position is set in the vicinity (in the first edge ink absorbing area 52*a*) of the right edge of the recording sheet S. The CPU 72 moves the carriage 22 to the first carriage position on the basis of a value of the linear type encoder 25. Then, the nozzle 23 to eject ink droplets is set to be the nozzle 23Y of yellow ink that is not easily visible, and the nozzle 23Y, the first to eject ink, is set to be nozzle 23Y (the nozzle of n=1) that is in the lowermost stream in the transport direction of the recording sheet S. Then, after moving the carriage 22 to the first carriage position, the CPU 72 ejects ink from the nth nozzle 23Y (step S340). The number of ink droplet ejects is set to 24 shots (8 segments). The number of ink ejects may be the number of ejects for which landing of the ink droplets on the ink receiving area 52 can be detected accurately, and should be lower than 24 shots.

Then, the CPU 72 judges whether any voltage output resulting from electrostatic induction has been caused when ink droplets reach the front/rear edge ink absorbing area 52*e* of the ink receiving area 52 (step S350). The judgment as to whether or not voltage output has been made by electrostatic induction is made on the basis of whether or not a maximum value of the voltage outputted from the voltage detection circuit 54 exceeds a predetermined threshold. In this context a decision was made to use, as a predetermined threshold, the threshold Vthr that is same as the head inspection routine. When a judgment is made that voltage output has been caused by electrostatic induction in step S350, the CPU 72 adds 1 to the nozzle number n, on the assumption that the nozzle 23Y that ejected ink is not above the front edge of the recording sheet S (step S360). When the nozzle 23Y is changed, the existing nozzle is supposed to be the nozzle 23 which is one nozzle upstream from the final nozzle 23Y in the transport direction of the recording sheet S. Then, CPU 72 causes the nth nozzle 23Y to eject ink droplets (step S340), and repeats the processes of steps S340 to S360 until in step S350 no voltage output is caused by electrostatic induction. When a judgment is made that no voltage output has been caused by electrostatic induction in step S350, an assumption is made that the existing nozzle 23 that ejected ink droplets this time is located above the front edge of the recording sheet S, and that the recording sheet S prevented the ink droplets from reaching the ink receiving area 52. Thus, the RAM 74 stores as a position of the first front edge of the recording sheet S the number n of the nozzle 23Y that this time ejected the ink droplets (step S370).

Figure 11:
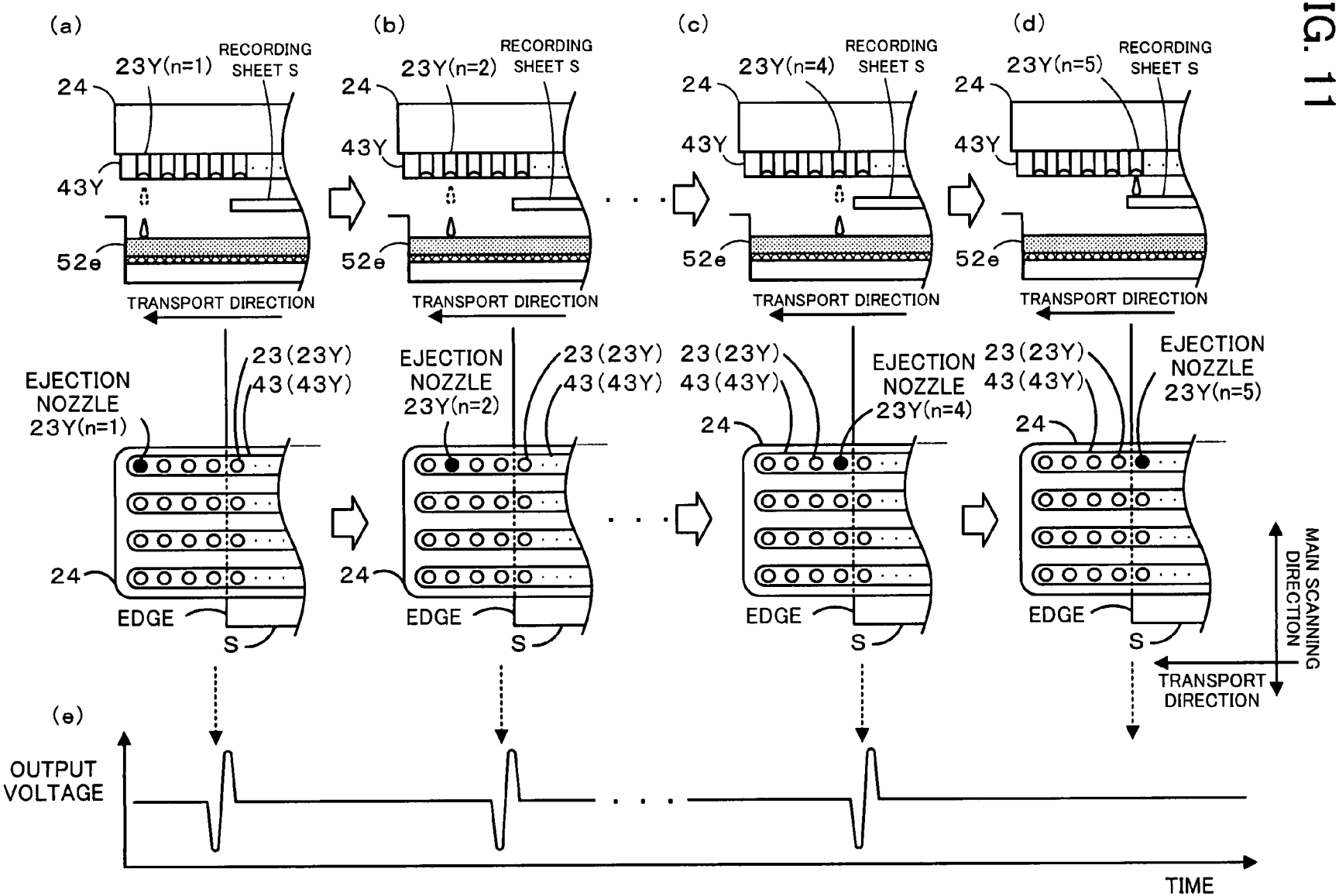
FIG. 11 is an illustrative diagram for determining a position of a front edge of a fixed recording sheet S.

The processes of steps S340 to S370 will now be described with reference to FIG. 11. FIG. 11 is an illustrative diagram for determining a position of a front edge of a recording sheet S. FIG. 11 (a) is a view illustrating a eject nozzle at the distance of offset three nozzles from the front edge. FIG. 11 (b) is a view illustrating a eject nozzle being at the distance of offset two nozzles from the front edge. FIG. 11 (c) is a view illustrating a eject nozzle at a distance of offset one nozzle from the front edge. FIG. 11 (d) is a view illustrating the eject nozzle on the front edge. In FIG. 11, the views on the top are illustrative diagrams of a print head 24 in a lateral direction as viewed from the side of the cap unit 40. The views in the middle are illustrative diagrams of a print head 24 as viewed from above. The views at the bottom are detection views of output voltages in the ink receiving area 52. In (a) to (d), the views on the top, those in the middle, and those at the bottom correspond to one another. As shown in FIG. 11 (a), ink droplets are ejected from a nozzle 23Y of n=1 among the array of nozzles 43Y. Then, as the voltage detection circuit 54 detects induced voltage of electrostatic induction resulting from the landing of ink droplets ejected onto the ink receiving area 52 (the bottom of FIG. 11 (a)), the CPU 72 determines that the nozzle Y of n=1 is located in an area separated from the front edge of the recording sheet S. Then, as shown in FIG. 11 (b), the current nozzle is changed to the nozzle 23Y of n=2, and then ink droplets are ejected. As induced voltage is detected in a similar manner (bottom of FIG. 11 (b), a determination is made that nozzle 23Y of n=2 is located in an area separated from the front edge of the recording sheet S. Thus, induced voltage in the voltage inspection circuits 54 can be detected by changing the nozzles that jet ink droplets. At this time, when induced voltage caused by ink droplets ejected from the nozzle 23Y of n=5 in FIG. 11 (d) are no longer detected (bottom of FIG. 11 (d)) after induced voltage caused by ink droplets ejected from the nozzle 23Y of n=4 have been detected in FIG. 11 (c), the CPU 72 determines that the position of the front edge of the recording sheet S exists between the nozzle 23Y of n=4 and the nozzle 23Y of n=5. Thus, by adding the length of nozzle pitch to the positions of nozzles 23Y (herein n=5) where no induced voltage has been detected (see the enlarged view of IG 12 to be discussed later) positions of the front edge of the recording sheet S can be determined as positions. In this manner any blank space can be prevented from being generated at the front edge of the recording sheet S as a result of the presence of nozzle pitch. Further, for the sake of convenience, the RAM 74 stores the number of the existing nozzle 23Y (n=5) as a position of the first front edge of the recording sheet S. Furthermore, in this context the position of the nozzle 23Y where induced voltage is no longer detected is considered the position of the front edge of the recording sheet S. However, it would be valuable when a position of the front edge of the recording sheet S and that of the print head 24 could be determined relatively, and that the last position where induced voltage is no longer detected be determined as a position of the front edge of the recording sheet S.

After step S370, CPU 72 causes the carriage motor 34 to move the carriage 22 to a second carriage position where a second point of a recording sheet S is detected, and sets the nozzle number n of the nozzle to eject ink to 1 (step S380). Now, the second carriage position is set to a position in the neighborhood (neighborhood of the second edge ink absorbing area 52b) of the left edge of a recording sheet S when a postcard sized recording sheet S is positioned along the reference guide, irrespective of the size of the recording sheet S that is actually fed (refer to FIG. 12 to be discussed later). In addition, CPU 72 moves the carriage 22 to the second carriage position based on a value of the linear type encoder 25. After moving the carriage 22 to the second carriage position, CPU 72 executes a process similar to the determination of the first front edge of the recording sheet S described above. In other words, it causes the nth nozzle 23Y to eject ink (step S390), and judges whether or not there is any voltage output by electrostatic induction resulting from ink droplets having reached the front/rear edge ink absorbing area 52*e* (step S400). When there is voltage output by electrostatic induction, it determines that the nozzle 23Y that ejected the ink droplets is not located on the front edge of the recording sheet S, and thus adds 1 to the nozzle number n (step S410). Here, the nozzle 23Y (nozzle of n=1) in the lowermost stream in the transport direction of the recording sheet S is set to be the nozzle 23Y that first ejects ink. In addition, when the nozzle 23Y is changed, the current nozzle is supposed to be the nozzle 23 which is one nozzle upstream from the last nozzle 23Y in the transport direction of the recording sheet S. Then, CPU 72 causes the nth nozzle to eject ink droplets (step S390), judges whether or not there is voltage output by electrostatic induction (step S400), and repeats the processes of steps S390 to S410 until it is judged in step S400 that there is no voltage output by electrostatic induction. On the one hand, when it is judged in step S400 that there is no voltage output by electrostatic induction, it considers that the nozzle 23Y that ejected ink this time is above the front edge of the recording sheet S, and that the recording sheet S prevented the ink droplets from reaching the ink receiving area 52, and stores in RAM 74 the number n of the nozzle 23Y as a position of the second front edge of the recording sheet S in RAM 74 (step S420). Then, CPU 72 determines inclination of the recording sheet S based on the position of the first front edge of the recording sheet S that was stored in RAM 74 in step S370 and the position of the second point of this recording sheet S (step S430).

Figure 12:
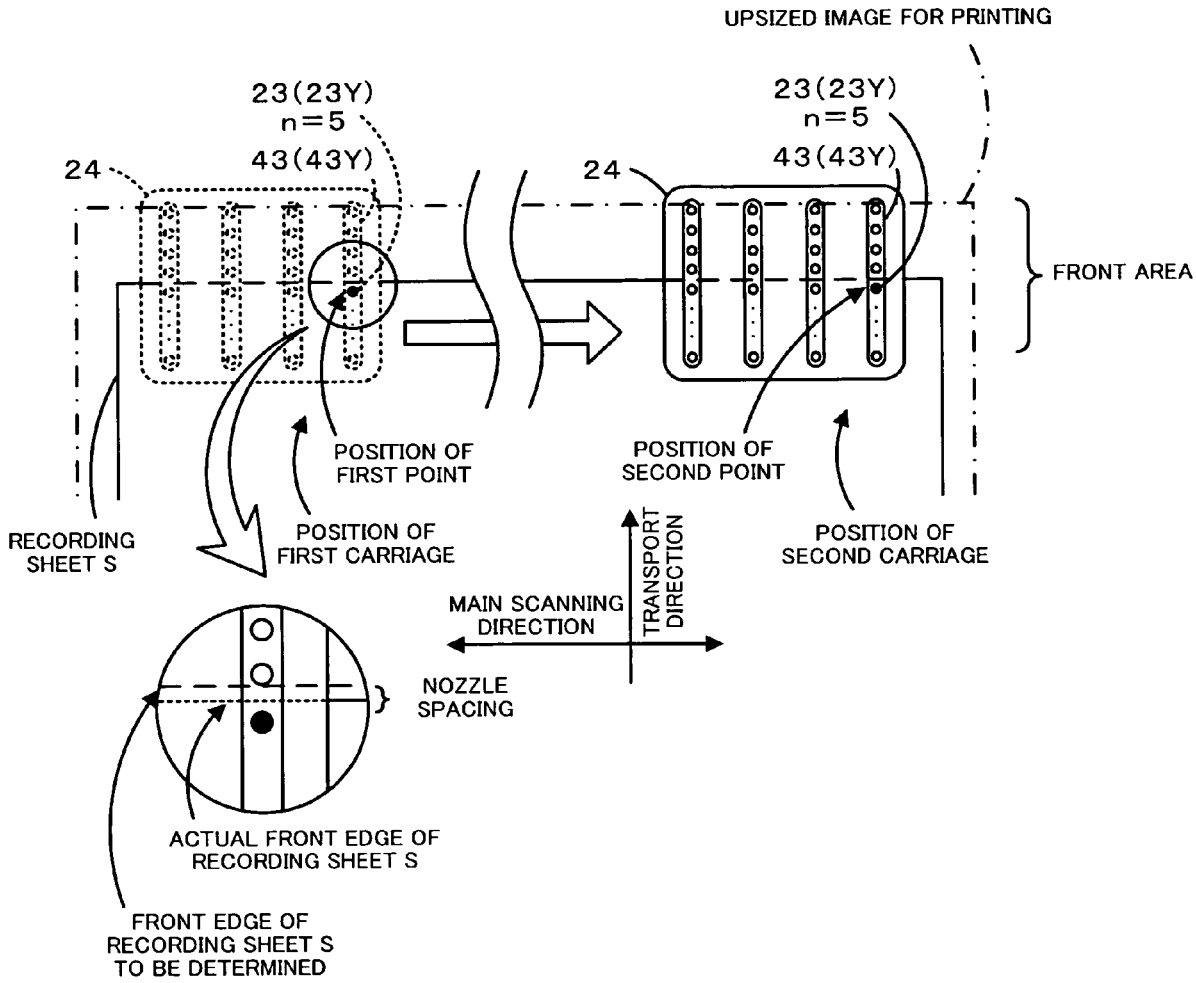
FIG. 12 is an illustrative diagram for determining a position of the front edge when a sheet is fed without being tilted.
Figure 13:
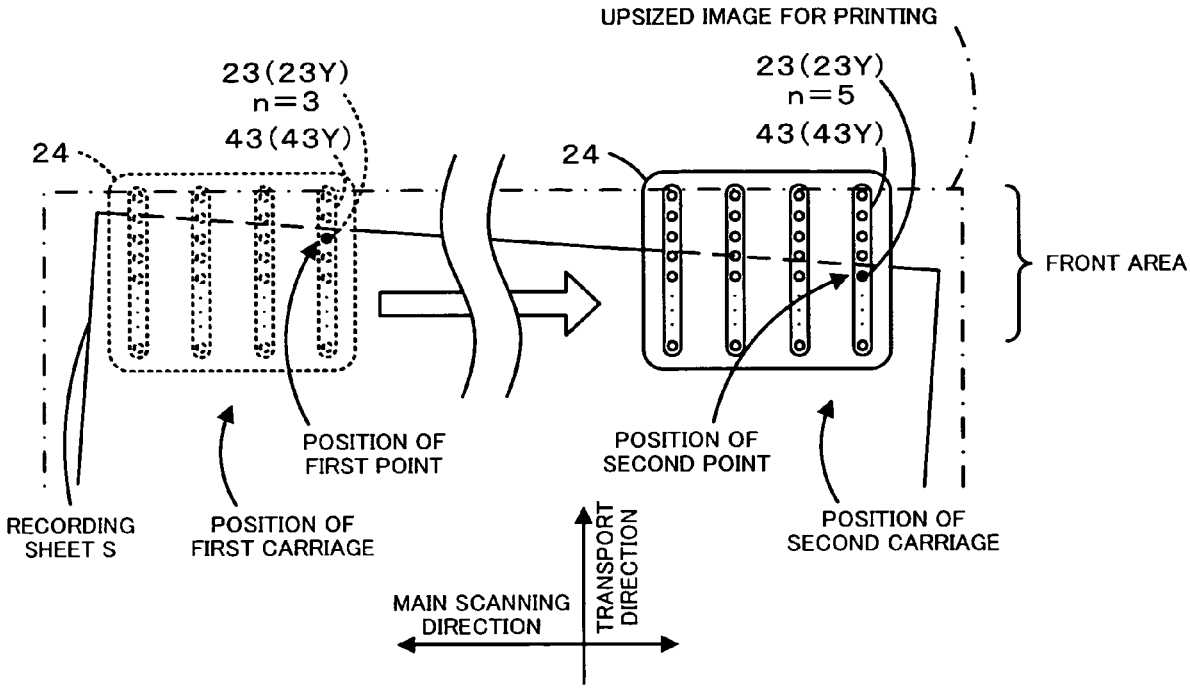
FIG. 13 is an illustrative diagram for determining a position of the front edge when a sheet is fed, in a tilted state.

Next will be described the processes of steps S330 to S430 with reference to FIGS. 12 and 13. FIG. 12 is an illustrative diagram of a recording sheet S being fed without being tilted. FIG. 13 is an illustrative diagram of a recording sheet being fed at an angle. As described above, the nozzle 23Y is changed in the vicinity of the right edge of the recording sheet S, which is the position of the first carriage position, and a position of the first point is determined by having the nozzle 23Y eject ink. After the determined position of the first point is stored in the RAM (see the dotted line), the carriage 22 is moved to the second carriage position. Then, the nozzle 23Y is changed in the vicinity of the left edge of the recording sheet S, and a position of the second point is determined by having the nozzle 23Y eject ink. The position of the second point thus determined is stored in the RAM 74. Next, determination of the inclination of the recording sheet S will be described. As shown in FIG. 12, as is known that when the number of the nozzles Y (n=5) corresponding to the position of the first point is the same as that of the nozzles 23Y (n=5) corresponding to the position of the second point the recording sheet can be fed without being tilted. Furthermore, as shown in FIG. 13, it can be seen that when the number of the nozzles 23Y (n=3) corresponding to the position of the first point differs from that of the nozzles 23Y (n=5) corresponding to the position of the second point the recording sheet is fed at an angle.

Next, the CPU 72 judges whether or not the recording sheet is at an angle (step S440). When the CPU 72 judges that the recording sheet is fed at an angle, as shown in FIG. 13, it executes an inclination correction process (step S450). The inclination correction process of step S450 is configured in such a way that by reversing the line feed roller 35 and the paper feed roller 36 a sheet that was fed at an angle onto the platen 44 can be redirection to the catch tray 14. Then, after the recording sheet has been returned to the catch tray 14 in step S450, the CPU 72 executes the processes of steps S300 to S440 for feeding again a recording sheet S and for checking the inclination thereof. Thus, the CPU 72 executes the inclination correction process in such a way that a recording sheet S fed at an angle can be fed straight in a transport direction.

On the one hand, when a judgment is made that the recording sheet S is not fed at an angle in step S440, CPU 72 moves the carriage 22 to an ink eject position, on the basis of the print data and by use of the front edge of the recording sheet S controls the piezoelectric device 48 or the carriage motor 34, and implements ink ejection control of the existing pass (step S460). Control should be effected in such a way that ink is ejected from the nozzle 23 on the side of the area covered by the recording sheet S, rather than the position of the front edge of the recording sheet S, and from the nozzle 23 on the side of the area separated from the recording sheet S proximate to the front edge of the recording sheet S, and any nozzles other than these nozzles will be prevented from ejecting ink. In an initial state, an ink eject position is a position in the vicinity of the right edge of the recording sheet when a recording sheet S is located along the reference guide. It is configured to be the position shifted to the left in FIG. 1 as a printing process proceeds. The process will now be described with reference to FIG. 12. The ink jet printer 20 is configured in such a way that the nozzle 23 (the nozzle of n=1) at the lowermost stream of each nozzle array 43 of the print head 24 matches a front edge of an upsized image data for printing. Furthermore, the front area should be the area onto which the nozzle array 43 can eject ink when the print head 24 makes one pass from the front edge of the image data. In other words, the front area is defined to be the area where ink ejected from the nozzles 23 can run over the front edge of the recording sheet S. The nozzles 23 of n=5 constitute the positions of the first and second points of the recording sheet S. First, the carriage 22 is moved to the side of the home position (left side in FIG. 12). Then, among the nozzles 23 in each array of nozzles 43, the nozzles 23 of n=5 onward are in the area where the recording sheet S is present, while the nozzles of n=4 are proximate to the front edge of the recording sheet S. Thus, on the basis of the print data, the piezoelectric device 48, etc., is controlled in such a way that the nozzles 23 of n=4 onwards eject ink. Since the nozzles of n=1 to 3 are separated from the position of the front edge of the recording sheet S, the piezoelectric device 48 is controlled in such a way that they will not eject ink. In other words, in the upsized images for printing, the image data is printed on the recording sheet S, by ejecting ink onto the area where the recording sheet is present and onto areas for preventing creation of any blank spaces, while limiting ejection of ink to the area separated from the front edge of the recording sheet S.

After step S460, on the basis of whether or not the limit on ink ejection of all the nozzles of the print head 24 has been removed, the CPU 72 judges whether or not printing of the front area has been completed, (step S470). When the CPU 72 judges that printing of the front area has not yet been completed, it executes the transport process of carrying the recording sheet S (step S480), and executes the process of step S460. As the nozzle located above the front edge changes when the recording sheet S is carried, in the second and subsequent processes of step S460, the nozzle number stored as the position of the front edge can be set to change as the front edge of the recording sheet S shifts. For instance, when the nozzles 23 (n=5) constitute the initial front edge position, and when the setting is such that in the course of one distance of transportation, the recording sheet S moves for a distance equivalent to only the distance between three nozzles, the nozzles 23 (n=2) will be at the front edge after transportation. On the other hand, when the CPU 72 judges that printing of the front area has been completed in step S470, the CPU 72 switches off the switch SW of the voltage application circuit 53 (step S490) and executes a normal print process (step S500). Then, after the normal print process, the CPU 72 judges whether or not any subsequent page needs to be printed. When any subsequent page needs to be printed, the CPU 72 executes the processes of steps S300 to S500 described above. When no subsequent page need to be printed, in step S510 the CPU 72 brings to an end the print process routine.

Next the relationship between the components of this embodiment and those of the present invention will be clarified. The ink receiving area 52 of this embodiment corresponds to the print recording liquid receiving area of the invention. The mask circuit 47, piezoelectric device 48, carriage belt 32 and carriage motor 34 correspond to the print head drive module. The voltage application circuit 53 corresponds to the potential difference generating module. The voltage detection circuit 54 corresponds to the electrical change detection module. The line feed mechanism 31 corresponds to the transport unit. The CPU 72 corresponds to the control module. In addition, ink of the embodiment corresponds to the print recording liquid of the invention, and the recording sheet S corresponds to the print medium. Furthermore, the description of how in this embodiment the ink jet printer operates, also constitutes one clear example of the image forming method of the present invention.

According to the ink jet printer 20 of this first embodiment as described above in detail, while a predetermined potential difference is being generated between the ink receiving area 52 and the print head 24, and in a state where ink prior to being ejected, any electrical change is detected when the print head 24 ejects ink from nozzles over the area extending from an area separated from the front edge of the recording sheet S to the area covered by the recording sheet S within the ink receiving area 52, and a position of the front edge of the recording sheet is determined on the basis of the electrical change detected. Thus, ink ejected from the nozzles 23 is directly used to determine a position of the front edge of the recording sheet S, and a position of the front edge of a recording sheet S can accordingly be determined with a greater degree of precision than by means of any method in which a front edge of a recording sheet is determined indirectly by use of anything other than ink. Furthermore, areas where ejected ink runs over the recording sheet S can also be reduced. Thus, when borderfree printing is executed, when the print data is upsized to any print data larger than the size of the recording sheet S, it is possible to reduce the degree of expansion of print data. Thus, post-printing images can be obtained that are more approximate to an images for which printing instructions have been given.

Further, as a front edge of a recording sheet S is determined while a recording sheet S is fixed, compared with an operation of determining a front edge of a recording sheet by moving the recording sheet S, it is a relatively faster operation to determine the position of the front edge of the recording sheet.

Furthermore, in borderfree printing, the area where ejected ink runs over the front edge of the recording sheet can also be reduced. Thus, in comparison with any method by which ink eject is controlled by use of anything other than ink and by then determining indirectly a front edge of a recording sheet S, in this embodiment consumption of ink can be controlled and contamination reduced as a result of ink mist inside the ink jet printer 20 that is caused by ejected ink running over the recording sheet S. In addition, since control is such that in the ink receiving area 52, the nozzle 23 on the side of the area covered by the recording sheet S, rather than the front edge position of the recording sheet S, and the nozzle 23 on the side of the area off the recording sheet S proximate to the front edge of the recording sheet S, eject ink, and since any nozzles 23 other than these nozzles do not eject ink, the formation of blank spaces on the recording sheet can be reliably prevented, and consumption of ejected ink running off the edge can be inhibited.

Furthermore, after a position of a first point of a recording sheet S has been determined at a first carriage position, the carriage 22 is moved in the main scanning direction, and a position of a second front edge of the recording sheet is determined at a second carriage position that is different from the first carriage position. As a judgment as to whether or not the recording sheet S is tilted is made on the basis of the positions of the first and second points that are determined, in the embodiment a determination can be made as to whether or not the recording sheet is tilted with a greater degree of precision than with any method in which use is made anything other than ink and the inclination of the recording sheet S determined indirectly. Furthermore, as the print head travels in the main scanning direction and the positions of the first and second points that are spaced to almost the same level as the horizontal width of the recording sheet S can be determined, inclination of the recording sheet can be determined with accuracy. In addition, after the recording sheet S that has been fed onto the platen 44 has been subjected to the inclination correction process of returning the recording sheet S to the catch tray 14, the recording sheet can be fed again, and this action can stabilize the posture of the recording sheet that is being fed again.

Additionally, among inks of various colors, as yellow ink that is not easily visible can be ejected to determine a front edge position of a recording sheet S, ink adhering to the recording sheet S can be made less perceptible when the front edge position of the recording sheet is determined. Furthermore, the ink receiving area 52 is formed over almost the entire printable area on the platen 44, and the voltage detection circuit 54 detects any electrical change across the entire printable area on the platen 44. Thus, a front edge position of the recording sheet can be determined over a wide area. Furthermore, for each of the plurality of nozzles 23 of the print head 24, a head check of whether the nozzles 23 normally eject ink can be done on the basis of the results detected by the voltage detection circuit 54 when ink is ejected toward the ink receiving area 52. Hence, an ink eject check and detection of a front edge of a recording sheet S can take place within the same ink receiving area 52, and thus there is no need to provide a new area for checking of ink eject.

Furthermore, the voltage application circuit 53 generates a predetermined potential difference between the print head 24 and the ink receiving area 52 when the print head 24 ejects ink from the nozzles 23 over the area extending from the front edge of the recording sheet S to the area covered by the recording sheet S within the ink receiving area 52, and charges the ink in advance of ejection from the nozzles 23. Thus, while it is detecting the front edge position of the recording sheet, the voltage application circuit 53 can reliably generate electrostatic induction as a result of ink eject.

Furthermore, as a head check routine and cleaning process are executed after print data has been received, all the nozzles 23 become available for ejecting ink. Since at such a time, determination of a front edge position of a recording sheet and printing of images take place, it thus becomes possible to determine the front edge position of the recording sheet reliably, and to inhibit quality degradation of post-printing images caused by the presence of nozzles that are incapable of ejecting ink normally.

Figure 14:
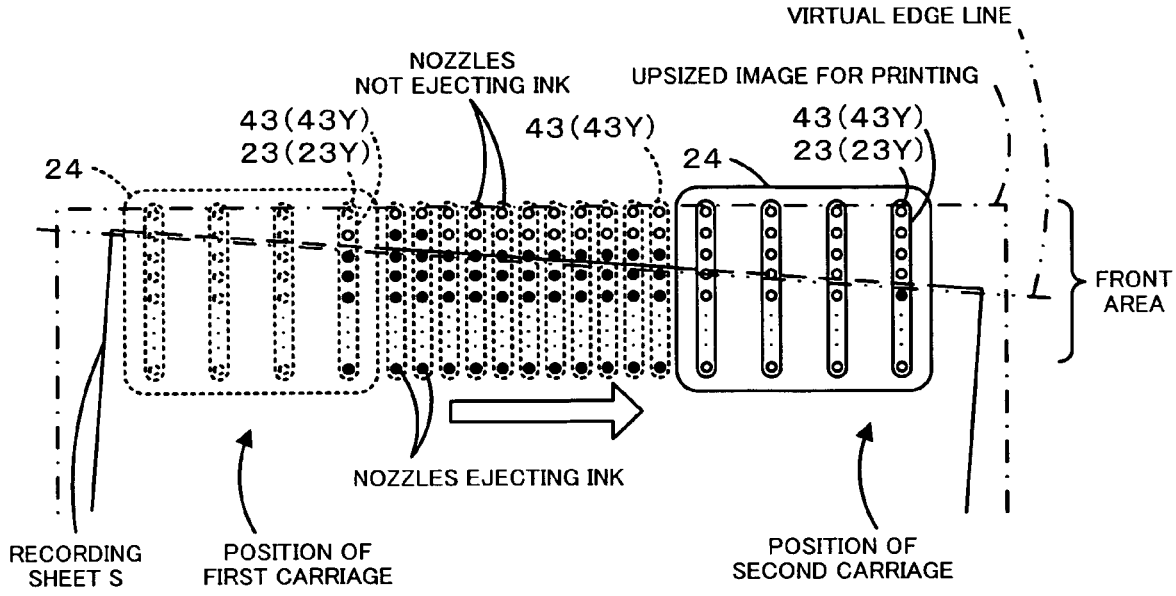
FIG. 14 is an illustrative diagram for performing a print operation on a recording sheets that is fed, in a tilted state.

In the first embodiment described above, the inclination correction process of step S490 of the print process routine is performed by reversing the line feed roller 35 and the paper feed roller 36, and by thereby returning to the catch tray 14 the recording sheets S that have been fed angularly onto the platen 44. However, alternatively, printing may take place on an angularly fed recording sheet so that ink is prevented from running off the front edge by the inclination correction process. More specifically, as shown in FIG. 14, a virtual front edge line connecting the position of the first front edge of the recording sheet S determined in step S370 to the position of the second front edge of the recording sheet S determined in step S420 can be obtained. At this time, on the basis of the print data, the piezoelectric device 48 or carriage motor 34, etc. can be controlled in such a way that the nozzle on the side of the area covered by the recording sheet S, rather than on the virtual front edge line and the nozzle 23 in the area separated from the front edge of the recording sheet S proximate to the virtual front edge line eject ink, while any nozzles 23 other than these nozzles 23 do not eject ink. Furthermore, in FIG. 14 illustrating an ink eject setting for the nozzle array 43 when the carriage 2 is moved in the main scanning direction, black circles represent nozzles, among the nozzles 23Y included in the nozzle array 43Y, that eject ink, while white circles represent nozzles that do not eject ink. In this way, consumption of ink at the front edge of an angularly fed recording sheet S can be controlled. Alternatively, by enabling the inclination correction process to determine the inclination of the recording sheet S from the angle of the virtual front edge line described above, and by processing print data stored in the RAM 74, printing may take place, in which images to be printed are tilted in line with recording sheets S that have been fed at an angle. In this way, consumption of ink can be controlled at the front edge of the recording sheet S and printing is possible on the angularly fed recording sheet S in accordance with printing instructions. Alternatively, as the inclination correction process, the paper ejection process may be performed, by means of an error message on a display (not shown) provided on the housing of the ink jet printer 20. Even with this purposes, printing can take place on a recording sheet S that is fed straight.

Figure 15:
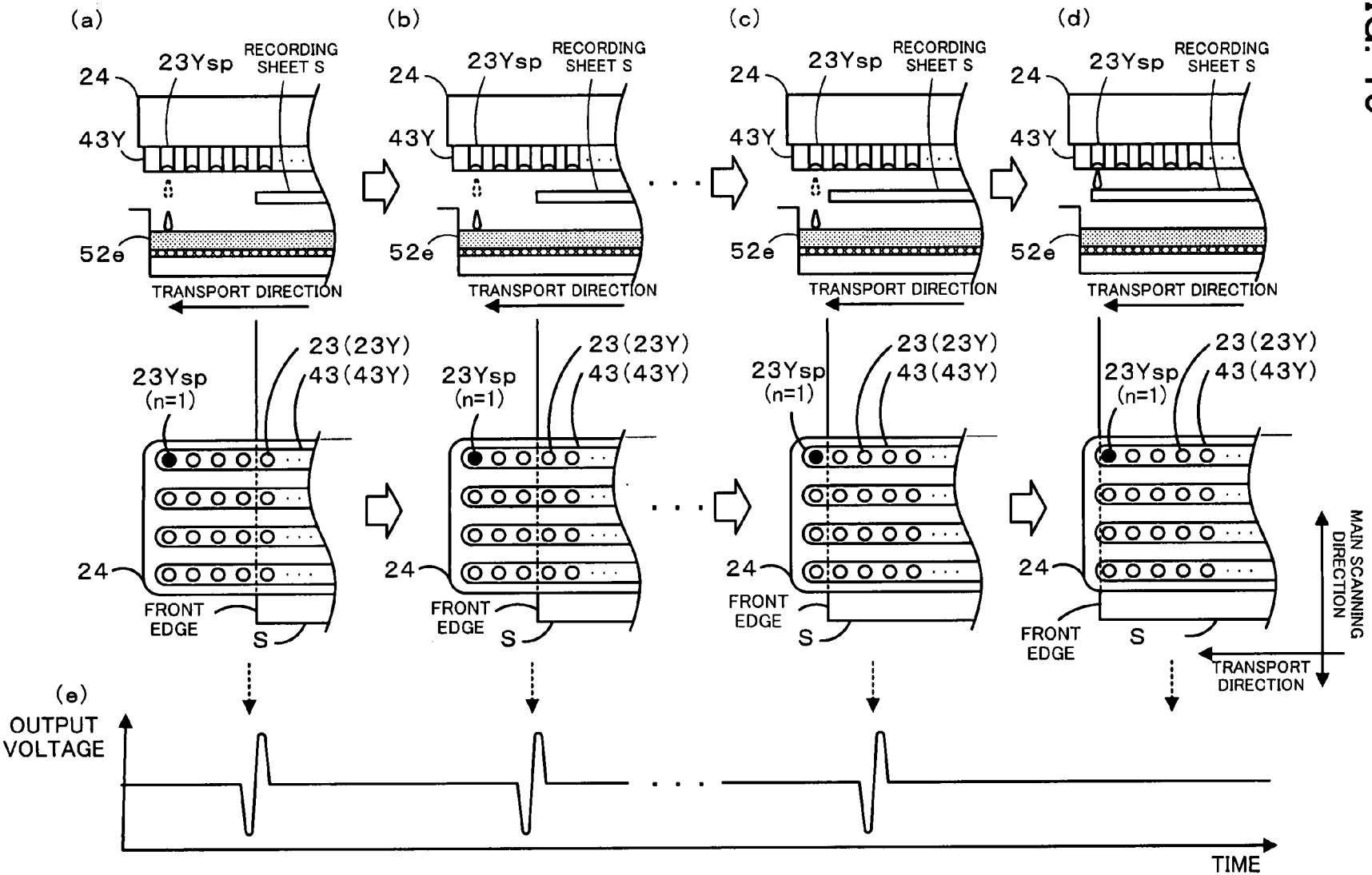
FIG. 15 is an illustrative diagram for transporting the recording sheet S and determining a position of the front edge of the recording sheet S.

In the first embodiment described above, while the recording sheet S is fixed above the front/rear edge ink absorbing area 52*e*, ink is ejected from the nozzle 23 Y over the area away from the front edge of the recording sheet S to the area covered by the recording sheet S within the ink receiving area 52, by changing the nozzles 23Y included in the array of nozzles 43Y sequentially from n=1, and enabling them to eject ink. As shown in FIG. 15, however, by fixing an ink ejecting nozzle to a specific nozzle 23 Ysp, and by carrying the recording sheet S in the transport direction, ink may be ejected from the nozzles 23 over the area extending from the front edge of the recording sheet S to the area covered by the recording sheet S within the ink receiving area 52. FIG. 15 is an illustrative diagram for determining a front edge position of a recording sheet S by carrying the recording sheet S. FIG. 15 (a) illustrates a ejecting nozzle offset from the front edge by a distance of three nozzles. FIG. 15 (b) illustrates a ejecting nozzle offset from the front edge by a distance of two nozzles. FIG. 15 (c) illustrates a ejecting nozzle offset from the front edge by a distance of one nozzle. FIG. 15 (d) illustrates a ejecting nozzle located on the front edge. More specifically, after the step S330 of the print process routine of FIG. 10, CPU 72 causes the specific nozzle 23 Ysp (e.g., the nozzle of n=1 in the lowermost stream in the transport direction) to eject ink, and judges whether or not any voltage output of electrostatic induction has occurred in the ink receiving area 52. When voltage output exists (FIG. 15 (a)), the CPU 72 carries the recording sheet S for a predetermined distance (for the length of one nozzle), and repeats the above processes until there is no voltage output (FIG. 15 (b) to (c)). When the CPU 72 detects that there is no voltage output (FIG. 15 (d)), it deems that the specific nozzle 23 Ysp has reached above the front edge of the recording sheet S. In other words, it starts printing on the assumption that the head of the recording sheet S has been located. In this manner, the front edge position of the recording sheet is always a position where ink ejected from the specific nozzle 23 Ysp in the lowermost stream in the transport direction of the recording sheet S lands, thus making it easy to start printing with an image that is to be printed aligned with the front edge of the recording sheet S. Further, since in this manner printing can be started with an image to be printed aligned with the front edge of the recording sheet S, in borderfree printing, printing processing of data larger than the size of the recording sheet S can be eliminated. Furthermore, printing may be started after the recording sheet has been carried for a distance of one nozzle, or a number of nozzles in a direction opposite to the transport direction. In this way the formation of blank spaces on the recording sheet can be reliably prevented by ejecting ink so that it runs off the edge by a distance of one nozzle, or a number of nozzles, and consumption of ink that is ejected and that runs off the edge can be restricted. In addition, as with the first embodiment described above, by use of this method, the position of the front edge of the recording sheet S may be determined at both the first carriage position and the second carriage position, thereby determining the inclination of the recording sheet S.

In the first embodiment described above, after the position of the first front edge of the recording sheet S has been determined at the first carriage position, the carriage is moved in the main scanning direction, and the position of the second front edge of the recording sheet S is determined at a second carriage position that is different from the position of the first point. At that time, although on the basis of the positions of the first and second points determined, a judgment is made as to whether or not the recording sheet is tilted, this process of determining the second point may be dispensed with. Even when this is done, in comparison with any method in which anything other than ink is used and the front edge of the recording sheet S determined indirectly, the position of the front edge of the recording sheet S can still be determined with a greater degree of accuracy. In addition, for instance, in comparison with any method in which in the case of border-free printing paper is fed with accuracy without tilting the recording sheet S, the level of consumption of ink can be reduced.

Figure 16:
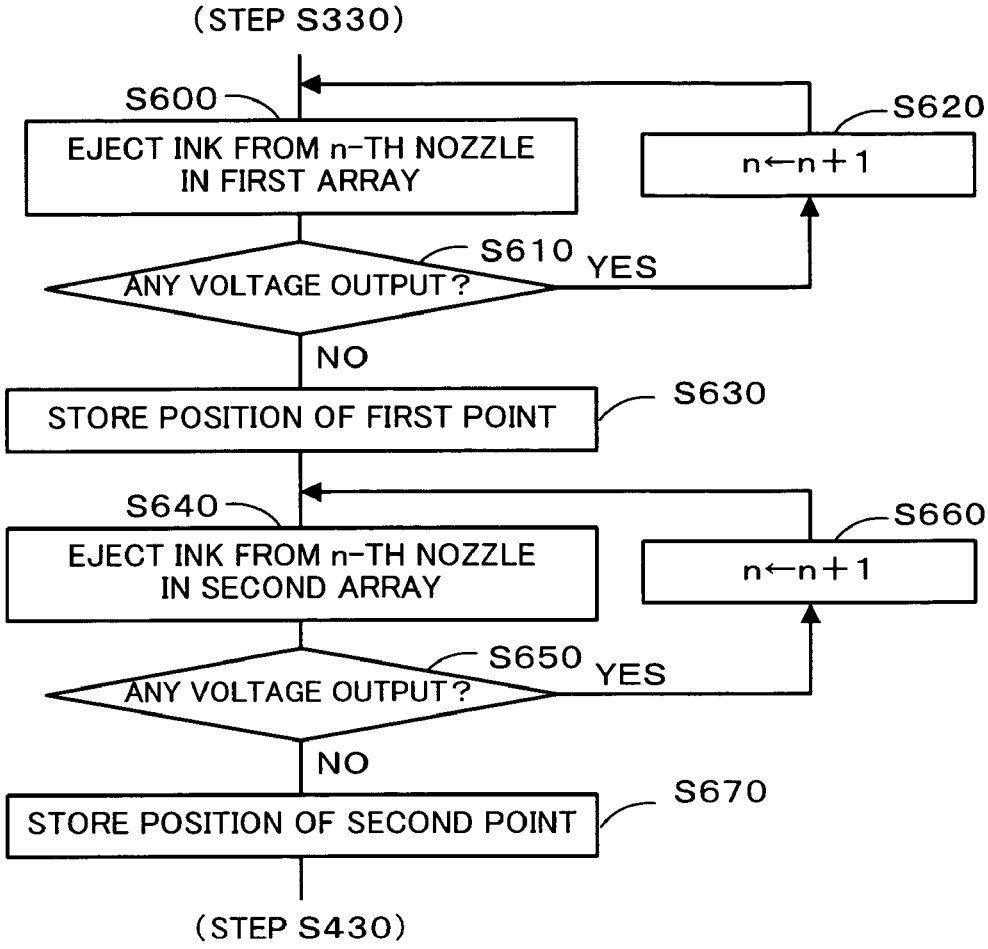
FIG. 16 is a flow chart of the print operation routine of another first embodiment.
Figure 17:
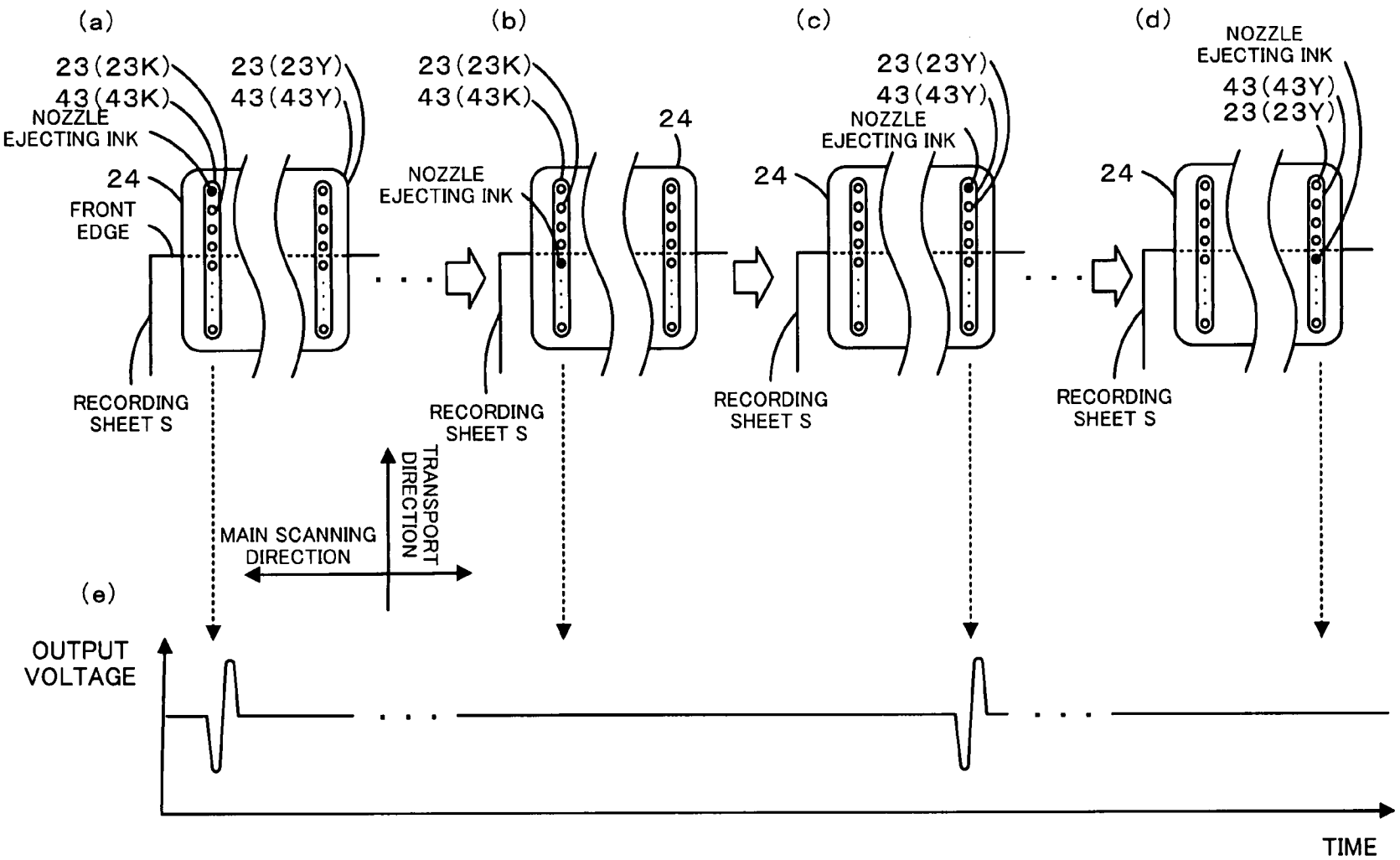
FIG. 17 is another illustrative diagram for determining a position of first and second points of a recording sheet S.

In the first embodiment described above, after the position of the first front edge of the recording sheet S has been determined at a first carriage position, the carriage is moved in the main scanning direction, and the position of the second front edge of the recording sheet S is determined at the second carriage position that is different from the position of the first point (step S340 to S420). As shown in FIG. 16 and FIG. 17, the position of the second front edge of the recording sheet S may be determined by use of a nozzle array 43 that is different from the nozzle array 43 used in determination of the position of the first front edge of the recording sheet S. FIG. 16 is a flow chart of another print process routine, while FIG. 17 is an illustrative diagram of methods for determining the positions of the first and second points with different nozzle arrays 43Y, 43K. FIG. 17 (a) illustrates the ejecting nozzles offset from the first point by a distance of three nozzles. FIG. 17 (b) illustrates the ejecting nozzles located on the first point. FIG. 17 (c) illustrates the ejecting nozzles offset from the second point by a distance of three nozzles. FIG. 17 (d) illustrates the ejecting nozzles being located on the second point. More specifically, as shown in FIG. 16, after step S330 of the print process routine in FIG. 10, the CPU 72 has nozzles (e.g., the nozzle of n=1 in an initial state) of the first nozzle array (e.g., nozzle array 43K) to eject ink (step S600) and judges whether or not voltage output of electrostatic induction occur in the ink receiving area 52 (step S610). When voltage output exists (FIG. 17 (a)), the CPU 72 changes the nozzle 23K to a subsequent nozzle by adding 1 to the nozzle number n (step S620), and repeats the processes of steps S600 to S620. When no voltage output occurs in step S610 (FIG. 17 (b)), the CPU 72 deems that the nozzle 23K that ejected ink droplets on this occasion is located above the front edge of the recording sheet S, and stores the number of this nozzle 23K (n=5 in this case) as the first point position. Then, the CPU 72 caused the nozzle (e.g., the nozzle of n=1 in the initial state) of the second nozzle array (e.g., the nozzle array 43Y) to eject ink (step S640), and judges whether or not voltage output of electrostatic induction exists (step S650). When voltage output exists (FIG. 17 (c)), the CPU 72 changes the nozzle 23Y to a subsequent nozzle by adding 1 to the nozzle number n (step S660), and repeats the processes of the steps S640 to S660.

When no output voltage occurs in step S650 (FIG. 17 (d)), the CPU 72 deems that the nozzle 23Y that ejected ink droplets on this occasion is located above the front edge of the recording sheet S, stores the number of nozzles 23Y (n=5 in this case) as the second point position (step S670), and repeats the processes of the step S430 onwards. Thus, as use of different nozzle arrays 43K, 43Y enables determination of the positions of the first and second points without involving movement of the print head 24, a determination of whether or not a recording sheet is tilted can be made relatively promptly. In addition, the first nozzle array is preferably spaced away from the second nozzle array as far as possible, so as to determine inclination of the recording sheet S.

In the first embodiment described above, control is such that in the ink receiving area 52, by use of the front edge position of the recording sheet S determined by means of the ejecting of nozzle 23Y, ink is ejected from the nozzle 23 on the side of the area covered by the recording sheet S, rather than the front edge position of the recording sheet S, and from the nozzle 23 in the area separated from the recording sheet S proximate to the front edge position of the recording sheet S, while ink is not ejected from any nozzles other than these two nozzles 23. However, alternatively, after the front edge position of the recording sheet has been determined by means of the ejecting of the nozzle Y, a transport process may take place in such a way that the front edge position determined is just under the desired nozzle 23. In this manner, the front edge position of the recording sheet S is always the position where ink ejected from the desired nozzle 23 lands, and printing can accordingly be started easily with the image to be printed in line with the front edge of the recording sheet S. At this time, for instance, the recording sheet S may be carried in such a way that the front edge position of the recording sheet S is just under the nozzle 23 of n=1. In this manner, as the ink eject position of the nozzle 23 (n=1) in the lowermost stream in the transport position is the front edge position of the recording sheet S, printing may easily be initiated with the image to be printed in a single layer aligned with the front edge of the print medium.

In the first embodiment described above, control is such that in the ink receiving area 52, by use of the front edge position of the recording sheet S determined by means of the ejecting of nozzle 23Y, ink is ejected from the nozzle 23 on the side of the area covered by the recording sheet S, rather than the front edge position of the recording sheet S, and from the nozzle 23 in the area separated from the recording sheet S and proximate to the front edge position of the recording sheet S, while ink is not ejected from any nozzles other than these two nozzles 23. However, alternatively, by use of the front edge position of the recording sheet S determined from ejecting of the nozzle 23Y, control may be such that in the ink receiving area 52, ink is ejected from the nozzle 23 at the area covered by the recording sheet S, rather than on the front edge position of the recording sheet S, while, rather than the position of the front edge of the recording sheet S, ink is not ejected from the nozzle 23 on the side of the area separated from the recording sheet S. When the nozzles are controlled in such a way, it is preferable that the spacing (nozzle pitch) of the nozzles 23 included in the nozzle array 43 is sufficiently narrow. With such a method, as ink is not ejected, and accordingly does not run over the front edge of the recording sheet S, consumption of ink can be further inhibited.

In the first embodiment described above, when the front edge position of the recording sheet S is determined, yellow ink that is not easily visible is used. However, the embodiment is not necessarily limited to this, and light cyan ink, light magenta ink, etc., can still be used, or a clear and colorless liquid such as water or clear ink for producing glaze used. In addition, in the first embodiment described above, although ink ejected to determine a front edge position of a recording sheet S is confined to yellow ink, this may be ink ejected onto the recording sheet S on the basis of the print data in actual printing. In other words, as shown in FIG. 12, in this first embodiment, since it can be known in advance what ink of the respective nozzles is to be ejected at which position in order to print an upsized image for printing, ink to be ejected in actual printing is ejected when the front edge position of the recording sheet S has been determined. In this way, at the time of determining the front edge it becomes possible to prevent the ink droplets ejected from having a negative effect on post-printing images.

Second Embodiment

Figure 18:
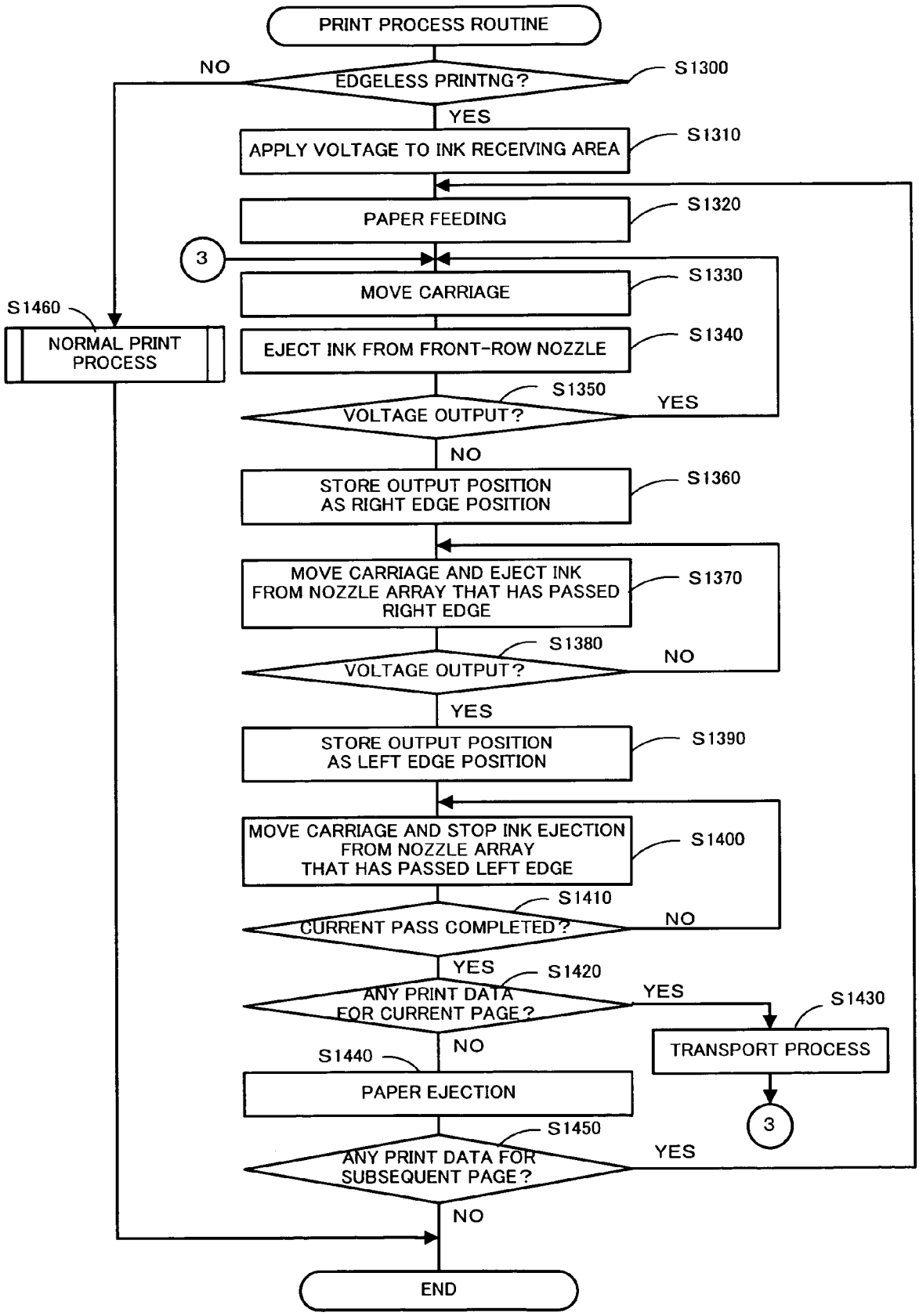
FIG. 18 is a flow chart of the print operation routine of a second embodiment.

Next, as a second embodiment, ink ejection control at an end of a side edge of a recording sheet S will be described. FIG. 18 is a flow chart of a print process routine for detecting a side edge of a recording sheet S. The print process is to execute a process for determining a side edge of a recording sheet S in borderfree printing while printing print data. A case is mainly described in which a user selects borderfree printing of a postcard-sized recording sheet S, wherein image data contained in the print data has data in yellow on its one side. When the print process routine is started, the CPU 72 judges first whether or not the print data is data for borderfree printing (step S1300). The judgment as to whether or not the print data is data for borderfree printing should be made on the basis of information about printing conditions included in the print data. Moreover, when a user selects borderfree printing, a user PC 10 upsizes the image data, for which a print instruction has been issued, into image data that is larger than the size of the recording sheet S so that no edge is generated on the recording sheet S, and the user PC 10 then transmits to the ink jet printer 20 printing data including this image data and the information that is data for borderfree printing.

When the print data is not data for borderfree printing in step S1300, CPU 72 executes the normal print process (step S1460) described above, and ends the print process routine. On the other hand, when the print data is data for borderfree printing in step S1300, the CPU 72 causes the voltage application circuit 53 to apply voltage between the print head 24 and the ink receiving area 52 (step S1310) and executes the paper feed process described above (step S1320). Then, the CPU 72 causes the carriage motor 34 to move the carriage 22 to an ink eject position (step S1330). In this context a position where ink eject starts should correspond to a position in the side edge of the print data upsized by the user PC 10. Next, on the basis of the print data, the CPU 72 enables the front-row nozzle array in the main scanning direction of the carriage 22 (in this case, the nozzle array 43Y that is the array of nozzles proximate to the recording sheet S) to eject ink (step S1340), and judges whether or not voltage output of electrostatic induction has been caused by ink droplets reaching the ink receiving area 52 (in this case, the first side ink absorbing area 52*a*) (step S1350). When voltage output of electrostatic induction has occurred, the CPU 72 deems that the front-row nozzle array 43Y has not yet reached the side edge of the recording sheet S, and repeats the processes of moving the carriage 22, having the nozzle array 43Y eject ink, and judging whether or not voltage output has occurred in the ink receiving area 52 (steps S1300 to S1350). In other words, only the front-row nozzle 43Y ejects ink until the front-row nozzle array 43Y reaches the area covered by the recording sheet S of the ink receiving area 52 from the area separated from the side edge of the recording sheet S.

On the other hand, when no voltage output of electrostatic induction occurs in step S1350, the CPU 72 deems that the front-row nozzle array 43Y has reached the print surface of the recording sheet S and that the recording sheet S has prevented ink droplets from reaching the ink receiving area 52, and the CPU 72 stores in the RAM 74 the up-to-date position of the carriage 22 as the right end of the recording sheet (step S1360). As the position of the right end of the recording sheet, a value of coordinates in the horizontal direction of the linear type encoder 25 is stored that corresponds to the position of the nozzle array 43Y. Then, the CPU 72 moves the carriage 22, and controls the piezoelectric device 48 so that ink is ejected from the nozzle array 43 that has gone past the position of the right end of the recording sheet (step S1370).

Figure 19:
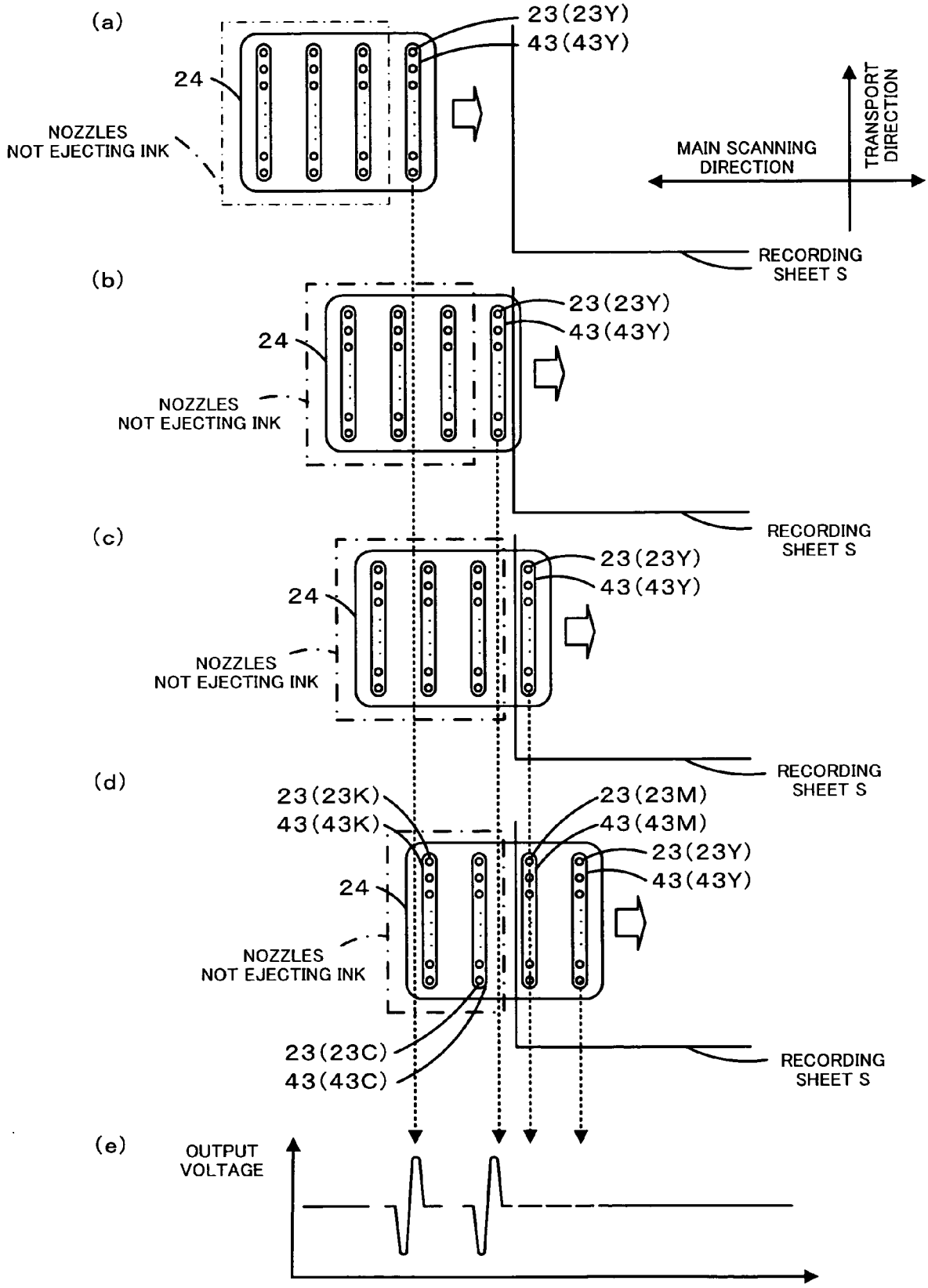
FIG. 19 is an illustrative diagram of ink ejecting control in the vicinity of the right edge of a recording sheet S.

The processes of steps S1320 to S1370 will now be described with reference to FIG. 19. FIG. 19 is an illustrative diagram of ink ejection control in the vicinity of the right end of the recording sheet S. FIG. 19 (a) illustrates the print head being offset from the right end. FIG. 19 (b) illustrates the print head in the vicinity of the right end. FIG. 19 (c) illustrates the nozzle array 43Y having reached the right end. FIG. 19 (d) illustrates the nozzle array 43M having reached the right end. The right end vicinity of the recording sheet S is located on the first side ink absorbing area 52*a*. First, as illustrated in FIG. 19 (a), CPU 72 applies voltage between the print head and the ink receiving area 52, charges ink in the print head, and on the basis of the print data causes the front-row nozzle array 43Y to eject the ink that has been charged. Then, electrostatic induction electrostatic voltage generates, and the voltage detection circuit 54 detects the generated induced voltage (FIG. 19 (e)). In other words, the fact that ink droplets have reached the ink receiving area 52 can be seen. At this time no ink is allowed to be ejected from the nozzle arrays 43K, 43C, and 43M. Next, as shown in FIG. 19 (b), CPU 72 moves the carriage 22 and causes the nozzle array 43Y to eject the charged ink droplets. Then, as shown in FIG. 19 (c), when the nozzle array 43Y is placed on the print surface of the recording sheet S, the ink droplets ejected from the nozzle array 43Y reach the recording sheet S, but do not reach the ink receiving area 52. Thus, electrostatic induction does not generate any induced voltage in the ink receiving area 52, and the voltage detection circuit 54 no longer detects the induced voltage (FIG. 19 (e)). Then, the CPU 72 stores in the RAM 74 as the position of the right end of the recording sheet S a value of the linear type encoder 25 corresponding to the position of the nozzle array 43Y. Then, as illustrated in FIG. 19 (d), the CPU 72 moves the carriage 22 and when the nozzle array 43M reaches the right end of the recording sheet S causes the next nozzle array 43M to start ejecting ink droplets on the basis of the print data. Similarly, when the following nozzle array 43C reaches the right end of the recording sheet S, the CPU 72 causes the nozzle array 43C to start ejecting ink droplets on the basis of the print data, and when the nozzle array 43K reaches the right end of the recording sheet S, the CPU 72 also causes the nozzle array 43K to start ejecting ink droplets on the basis of the print data. Then, when all the nozzle arrays 43 have passed the right end of the recording sheet S, the CPU 72 causes all the nozzle arrays 43 to eject ink droplets, and the image data contained in the print data is printed on the recording sheet S.

Then, after moving the carriage 22 and causing the nozzle array 43 that passed the right end of the recording sheet S to eject ink, the CPU 72 judges whether or not voltage output of electrostatic induction has been caused by ink droplets having reached the ink receiving area 52 (step S1380). In other words, the CPU 72 judges whether or not ink droplets ejected from the nozzle array 43Y at the left end of the recording sheet S could reach the ink receiving area 52. When there is no voltage output of electrostatic induction has occurred, the CPU 72 executes the process of step S137, i.e. that of moving the carriage 22 and causing the nozzle array 43 that passed the right end of the recording sheet S to eject ink. On the other hand, when voltage output of electrostatic induction has occurred, the CPU 72 deems that the front-row nozzle array 43Y has moved away from the print surface of the recording sheet S and that the ink droplets ejected from the nozzle 23Y have reached the ink receiving area 52, and the CPU 72 stores in the RAM 74 the position of the up-to-date carriage 22 as the position of the left end of the recording sheet S (step S1390). As the position of the left end of the recording sheet S, the CPU 72 stores values of the coordinates in the horizontal direction of the linear type encoder 25 corresponding to the position of the nozzle array 43Y relative to the position of the front-row nozzle array 43Y. Then, the CPU 72 moves the carriage 22 and controls the piezoelectric device 48 in such a way that the nozzle array 43 that has passed the left end position of the recording sheet S stops ejecting ink droplets (step S1400).

Figure 20:
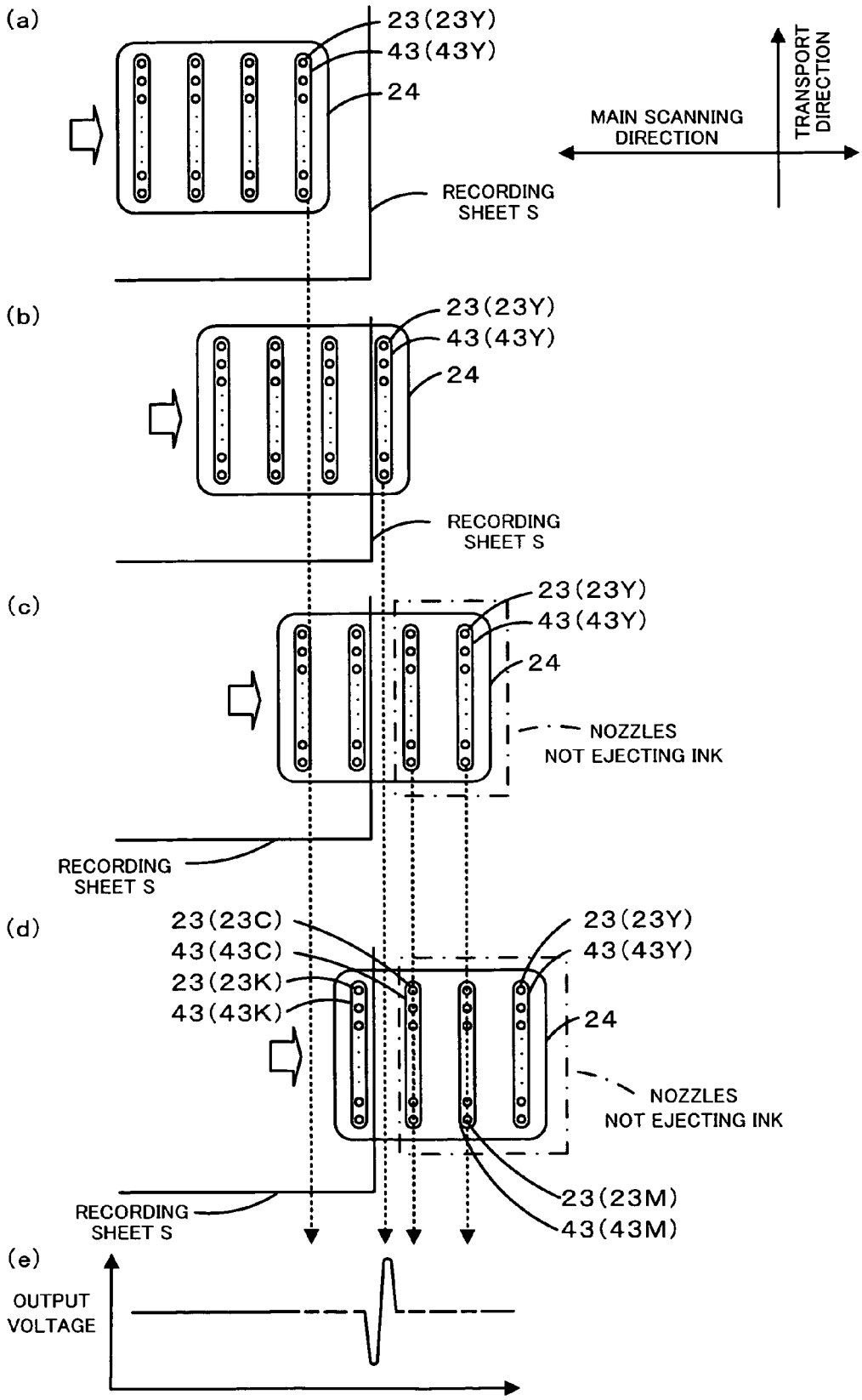
FIG. 20 is an illustrative diagram of ink ejection control in the vicinity of the left edge of a recording sheet S.

The processes of steps S1370 to S140 will now be described with reference to FIG. 20. FIG. 20 is an illustrative diagram of ink ejection control in the vicinity of the left end of the recording sheets. FIG. 20 (a) illustrates the print head 24 being located on the recording sheet S. FIG. 20 (b) illustrates the nozzle array 43Y separated from the left end. FIG. 20 (c) illustrates the nozzle array M separated from the left end. FIG. 20 (d) shows the nozzle array 43C being away from the left end. Now, the left end vicinity of the recording sheet S is located in the second side ink absorbing area 52*b*. First, as shown in FIG. 20 (a), the CPU 72 moves the carriage 22, causes the nozzle array 43 to eject ink and prints on the recording sheet S image data contained in the print data. Then, since all of the ink droplets ejected from the nozzle 23 reach the recording sheet S, the voltage detection circuit 54 does not detect induced voltage (FIG. 20 (e)). Then, as shown in FIG. 20 (b), when the nozzle 43Y has moved away from the print surface of the recording sheet because the carriage 22 moved, the ink droplets ejected from the nozzle 23Y reach the ink receiving area 52. Thus, electrostatic induction generates induced voltage, and the voltage detection circuit 54 detects the induced voltage (FIG. 20 (e)). The CPU 72 stores in the RAM 74 as the left end position of the recording sheet S a value of the linear type encoder 25 corresponding to the position of the nozzle array 43Y. Then, as shown in FIG. 20 (c), the CPU 72 moves the carriage 22, and when the nozzle array 43M reaches the left end of the recording sheet S stops the nozzle array 43M from ejecting ink droplets. Similarly, when the next nozzle array 43C reaches the left end, the CPU 72 stops the nozzle array 43C from ejecting ink droplets (FIG. 20 (d9), and when the nozzle array 43K reaches the left end of the recording sheet S, the CPU 72 stops the nozzle array 43K from ejecting ink droplets. Then, when all the nozzle arrays 43 pass the left end of the recording sheet S, the CPU 72 stops all the nozzle arrays 43 from ejecting ink droplets.

Then, after step S1400, the CPU 72 judges whether or not the current pass in which the carriage 22 moves one row in the main scanning direction has been completed (step S1410). When the current pass has not been completed, the CPU 72 executes the process of step S1400. When the current pass has been terminated, the CPU 72 judges whether or not any print data to be printed exists on the recording sheet S that is then being printed (step S1420). When any such print data to be printed on the recording sheet that is then being printed exists, the CPU 72 executes the transport process of rotating and driving the line feed roller 35 so as to carry the recording sheet by a predetermined distance (step S1430), and executes the processes of steps S1330 to 1430 described above. On the other hand, when no print data to be printed on the recording sheet that is now being printed exists, the CPU 72 executes the paper ejection process of rotating and driving the paper eject roller 37 so as to eject the recording sheet onto the paper eject tray (step S1440), and the CPU 72 judges whether or not any subsequent page need to be printed (step S1450). Then, when there is a subsequent page to print, the CPU 72 executes the processes of steps S1320 to S1450, while, when there is no subsequent page to print, the CPU 72 ends the print process routine.

According to the ink jet printer 20 of the second embodiment described above in detail, a predetermined potential difference is generated between a ink receiving area 52 and a print head 24, and while ink prior to being ejected, the print head 24 travels in a main scanning direction from the area separated from the side edge of a recording sheet S to the area covered by the recording sheet, or from the area covered by the recording sheet S to the area separated from the side edge of the recording sheet S within the ink receiving area 52, and, in the process of controlling, the print head 27 detects any electrical change so that ink is ejected from the nozzles. Then, a position of the side edge of the recording sheet S is determined, on the basis of the electrical change detected by the voltage detection circuit 54, and control is exercised so that by utilizing the determined position of the side edge of the recording sheet S the print head 24 ejects ink from the nozzle 23 and executes borderfree printing onto the recording sheet S. Thus, a position of the side edge of the recording sheet S is determined by using directly ink ejected from the nozzles 23. Thus, according to the embodiment a position of the side edge of the recording sheet can be determined with a greater degree of precision with than any method in which anything other than ink is used and in which the side edge of the recording sheet S is determined indirectly. In addition, as the nozzle arrays 43 other than the front-row nozzle array 43Y can reduce the area onto which ink is ejected and runs over the side edge of the recording sheet S so as to prevent any blank spaces from being formed on the recording sheet S, consumption of ink can be inhibited to a greater degree that with any method in which ink eject on the edge of the recording sheet is controlled by use of anything other than ink. In this way, as the amount of the ink ejected onto the area off the side edge of the recording sheet can be reduced, it is possible to reduce contamination resulting from ink mist inside the ink jet printer 20 that is caused by ejected ink running over the recording sheet S. In addition, when borderfree printing is executed, it is possible to reduce the degree of expansion of print data when the print data is upsized to any print data larger than the size of the recording sheet S. Thus, it is possible to alleviate any possible dissatisfaction with images for which printing instructions has been issued and with the images printed onto the recording sheet S.

Furthermore, when the print head 24 travels over the area where the recording sheet S is not present to the area within the ink receiving area 52 where the recording sheet S is present and when the print head 24, in order to eject ink from the nozzles 23, causes the nozzle 23 Y included in the front-row nozzle array 43Y in the main scanning direction to eject ink, a position where the voltage detection circuit 54 no longer detects an electrical change is determined as a right end position of a recording sheet S, and control is effected in such a way that ink is ejected from the nozzle 23 included in other nozzle array 43 rather than the position of the right end of the recording sheet S that has been determined. Thus, consumption of ink from the next and subsequent nozzles 23 can be controlled by utilizing the right end position of the recording sheet S that was obtained by causing the nozzle 23Y of the front row array to eject ink.

Furthermore, when the print head 24 travels over the area where the recording sheet S is not present to the area within the ink receiving area 52 where the recording sheet S is present and when control is exercised in such a way that the print head 24 causes the nozzles 23 to eject ink, a position where an electrical change is detected by the voltage detection circuit 54 when the nozzle 23Y included in the front-row nozzle array 43Y in the main scanning direction is caused to eject ink is determined as the left end position of the recording sheet S. Since control is such exercised that the nozzles 23 included in the front-row nozzle array 43Y and other nozzle arrays 43 do not eject ink according to the determined left end position of the recording sheet, consumption of ink from the next and subsequent nozzles 23 can be controlled by utilizing the left end position of the recording sheet S that was obtained by causing the front-row nozzle 23 to eject ink.

Furthermore, since the ink receiving area 52 is formed across almost the entire printable area on the platen 44 and the voltage detection circuit 54 detects any electrical change across almost the entire printable area on the platen 44, it is possible to determine positions of side edges of various sizes of recording sheet.

Moreover, for each of the plurality of nozzles 23 of the print head, a check is made as to whether or not ink is being ejected normally from the nozzle 23, on the basis of the results detected by the voltage detection circuit 54 at a time when the piezoelectric device 48, etc., is controlled in such a way that ink is ejected toward the ink receiving area 52. Accordingly, a check of ink eject from the print head 24, and detection of the side edge of the recording sheet S, can be implemented within the same ink receiving area. Thus, there is no need to provide a new area for the ink eject check.

Additionally, when the print head 24 travels in the main scanning direction over the area where the recording sheet S is not present to the area within the ink receiving area 52 where the recording sheet S is present, or, alternatively, over the area where the recording sheet S is present to the area where the recording sheet is not present, the voltage application circuit 53 generates a predetermined potential difference between the print head 24 and the ink receiving area 52 and charges ink in advance of ejection from the nozzles 23. Thus, when a position of the side edge of the recording sheet is detected, electrostatic induction resulting from ink eject can be caused with a degree of certainty.

In the second embodiment described above, a right end position of a recording sheet S is determined for every one pass of the print head, on the basis of electrostatic voltage caused by ink eject. Alternatively, by utilizing the right end position of a recording sheet S that was on the previous occasion determined as the position of the side edge of the recording sheet S at that time, the piezoelectric device 48 may be driven and controlled so that the print head 24 ejects ink from the nozzle 23 on the basis of this right end position of the recording sheet S. In this way, because the right end position of the recording sheet S that was determined on the previous occasion can be used, it becomes possible to eliminate the latest process of determining the right end of the recording sheet S, thus enabling the burden of the process of determining the right end to be reduced. At this time, the right end position of the recording sheet S that was determined by ejecting ink on the first occasion may be used until printing has been completed on that page; or the process of determining the right end of the recording sheet S by ejecting ink and the process of determining the right end of the recording sheet that was on the previous occasion determined as the right end for the latest occasion may alternately be repeated; or the right end of the recording sheet S may be determined by ejecting ink on every occasion that the number of passes of the print head 24 reaches a preset number of occasions, and the right end position determined previously may be used in other passes.

In the second embodiment described above, when the right end of the recording sheet is determined, ink was ejected only from the nozzle 23Y included in the front-row nozzle array 43Y. However, for instance, when a limit is placed on ejecting of ink from the nozzle 23 included in the front-row nozzle array 43 such as when data to be printed does not contain a color of ink (yellow) to be ejected from the front-row nozzle array 43Y, ink may also be ejected from the next nozzle array 43M. In addition, when a limit is also placed on ejecting of ink from the nozzle 23M included in the next nozzle array 43M, ink may be ejected from the nozzle 23C included in the next but one nozzle array. In this way determination of the right end position of the recording sheet S can even be guaranteed when ink cannot be ejected from the nozzle 23Y included for example, in the front-row nozzle array 43Y. In addition, this process can also be applied to determination of the left end position of the recording sheet S.

In the second embodiment described above, when the right end of the recording sheet was determined, all the nozzles 23Y included in the front-row nozzle array 43Y were confined to nozzles 23Y ejecting ink. Alternatively, however, the right end of the recording sheet S may be determined by causing one or a number of specific nozzles 23Y from among the plurality of nozzles included in the front-row nozzle array 43Y to eject ink over the area extending from the area separated from the right end of the recording sheet S to the area covered by the recording sheet S of the ink receiving area 52. In this manner, consumption of ink from the front-row nozzle array 43Y can be reduced.

In the second embodiment described above, a position where ink droplets ejected from the nozzle 23Y included in the front-row nozzle array 43Y reach the recording sheet S, and thus output of induced voltage is no longer detected from the ink receiving area 52, was determined as the right end position of the recording sheet S, and rather than from the position determined ink eject started from the nozzle 23 included in other nozzle array 43. Alternatively, ink eject may start from another nozzle array 43, somewhat closer than the right end position of the recording sheet S that was determined. In other words, for the right end of the recording sheet S, although only the front-row nozzle array 43 is caused to eject ink to the ink receiving area 52 so as to run over the recording sheet S, any nozzle arrays 43 other than the front-row array may also eject a few droplets of ink onto the ink receiving area 52 so as to run over the recording sheet S. In this way, during borderfree printing it becomes possible to control reliably formation of blank spaces at the right end of the recording sheet S to be reliably controlled. In addition, for the left edge of the recording sheet S, although only the front-row nozzle array 43Y is caused to eject ink onto the ink receiving area 52, any nozzle array 43 other than the front-row nozzle array may, for instance, eject a few droplets of ink onto the ink receiving area 52 so as to run over the side edge of the recording sheet S, and in these circumstances all the nozzle arrays 43 may be inhibited from ejecting ink. In this manner during borderfree printing control can be ensured of the formation of a blank spaces on the left end of the recording sheet S. In addition, in subsequent printing processes, on the basis of a side edge position that has once determined, a range (margin) of ejected ink running over the side edge of the recording sheet S may be defined, and borderfree printing may take place by ejecting ink within that defined range. In this way, it becomes possible, during borderfree printing, to inhibit formation of blank spaces on the side edge of the recording sheet S and control consumption of ink in the side edge, because the side edge of the recording sheet S can be determined directly by ejecting ink and a finer margin can be set, compared with any method in which the side edge of the recording sheet is determined with anything other than ink, and a margin set.

In the second embodiment described above, the print process routine executes the process of determining the side edge of the recording sheet S while printing the print data. However, the process of determining the side edge of the recording sheet S may take place as a process independent of the printing of the print data. More specifically, for instance, after the top edge of the recording sheet S has been detected, as described above, does the print head 24 move from the position separated from the right end of the recording sheet S, and the nozzle 23Y included in the front-row nozzle array is caused to eject ink. A position where the ink droplets that are ejected reach the recording sheet S and voltage output is no longer detected from the ink receiving area 52 is determined as a right end position of the recording sheet S. Furthermore, on the basis of the sheet size contained in the print data, the ink receiving area 52 moves the print head 24 to a position covered by the left end of the recording sheet S. The print head 24 travels from this position to the area separated from the left end of the recording sheet S, and the nozzle 23Y included in the front-row nozzle array 43Y is caused to eject ink. A position where the ink droplets that are ejected reach the ink receiving area 52, and voltage output at this time detected, is determined as a right end position of the recording sheet. Further, on the basis of the positions of both ends of the recording sheet S determined, an ink eject range of each nozzle array 43 at both ends of the recording sheet S where no blank spaces are created is defined, and borderfree printing takes place within this ink eject range so that ink is ejected from the nozzle 23. In this manner eliminated the need to detect both ends during a printing operation can be, and the process thereby simplified.

Figure 21:
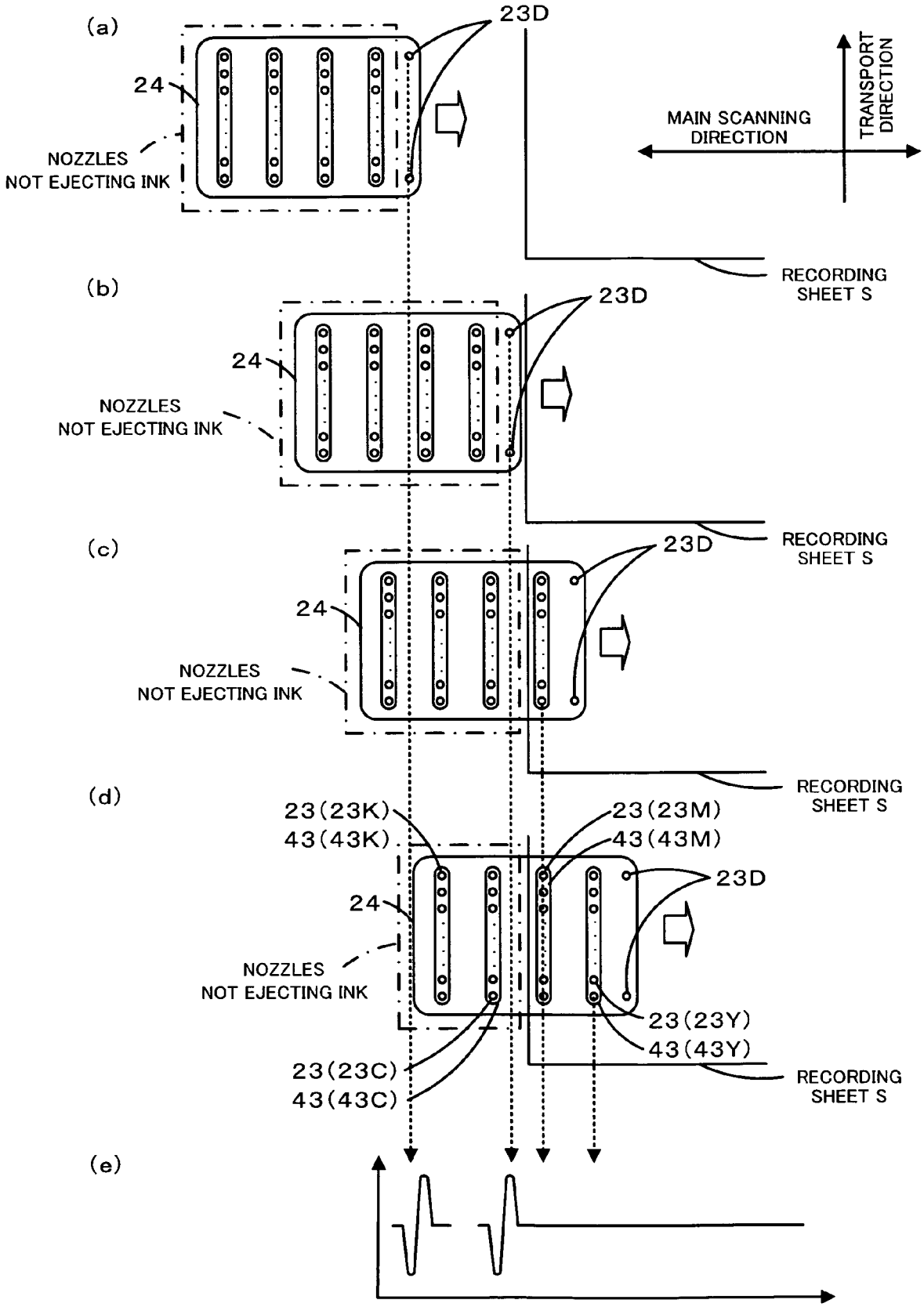
FIG. 21 is an illustrative diagram for ink ejection control at another print head 24.

In the second embodiment described above, ink droplets ejected from the nozzle 23Y included in the front-row nozzle array 43Y were used to determine a side edge position of the recording sheet S. However, the following process is also possible. As shown in FIG. 21, in addition to the above-described nozzle arrays 43Y, 43M, 43C, and 43K used for printing, the print head 24 may comprise a plurality of side edge detection nozzles 23D arranged at a position more upstream than the nozzle arrays 43 in the main scanning direction. FIG. 21 is an illustrative diagram of ink ejection control performed by another print head 24. FIG. 21 (a) illustrates the print head 24 separated from the right end. FIG. 21 (b) illustrates the nozzle 23 located in the vicinity of right end. FIG. 21 (c) illustrates the nozzle 23D having reached the right end. FIG. 21 (d) illustrates the nozzle array M having reached the right end. Liquid to be ejected by the nozzle 23 D may be ink of color that is not easy to perceive (such as yellow or light cyan, etc.), or transparent (such as clear ink or water). Then, as shown in FIG. 21 (8*a*), voltage is applied between the print head 24 and the ink receiving area 52 so as to charge ink of the print head 24, and the charged ink is caused to be ejected in the main scanning direction from the front-row nozzles 23D. Then, electrostatic induction generates induced voltage and the voltage detection circuit 54 detects the induced voltage generated (FIG. 21 (e)). In addition, the nozzle arrays 43Y, M, C, and K do not at this time eject ink. Next, as shown in FIG. 21 (b), the carriage 22 is moved, and the charged ink droplets are ejected from the nozzle 23D. Then, as shown in FIG. 21 (c), when the nozzle 23D lies in the upper part of the recording sheet S, the ink droplets ejected from the nozzle 23D reach the recording sheet S, although they does not reach the ink receiving area 52. Thus, the voltage detection circuit 54 no longer detects induced voltage (FIG. 21 (e)). Then, a value of the linear type encoder corresponding to the position of the nozzle 23D is stored in the RAM 74 as the right end position of the recording sheet S. Then, as shown in FIG. 21 (d), the carriage 22 is moved and when the nozzle array reaches the right end position, the nozzle array 43Y starts ejecting ink droplets on the basis of the print data. Similarly, when the next nozzle array 43M reaches the right end position, the nozzle array 43M starts ejecting ink droplets on the basis of the print data, and when the nozzle arrays 43C and 43K reach the right end positions, the nozzle arrays 43C and 43K start ejecting ink droplets on the basis of the print data. In this way, ejecting and stopping of ink from the nozzles 23Y, 23M, 23C and 23K becomes possible on the basis of the results of detection of electrical change when the side edge detection nozzle 23D ejects, thereby further reducing the consumption of ink. In addition, since the side edge detection nozzle 23D ejects liquid that is not easy to view, when the side edge is detected it becomes possible to reduce the effects of a color of ink to be ejected on an item of printed matter. In addition, the process on the left end of the recording sheet S can be done in a similar way to the processes described above, by using the side edge detection nozzle 23D described above.

Third Embodiment

Figure 22:
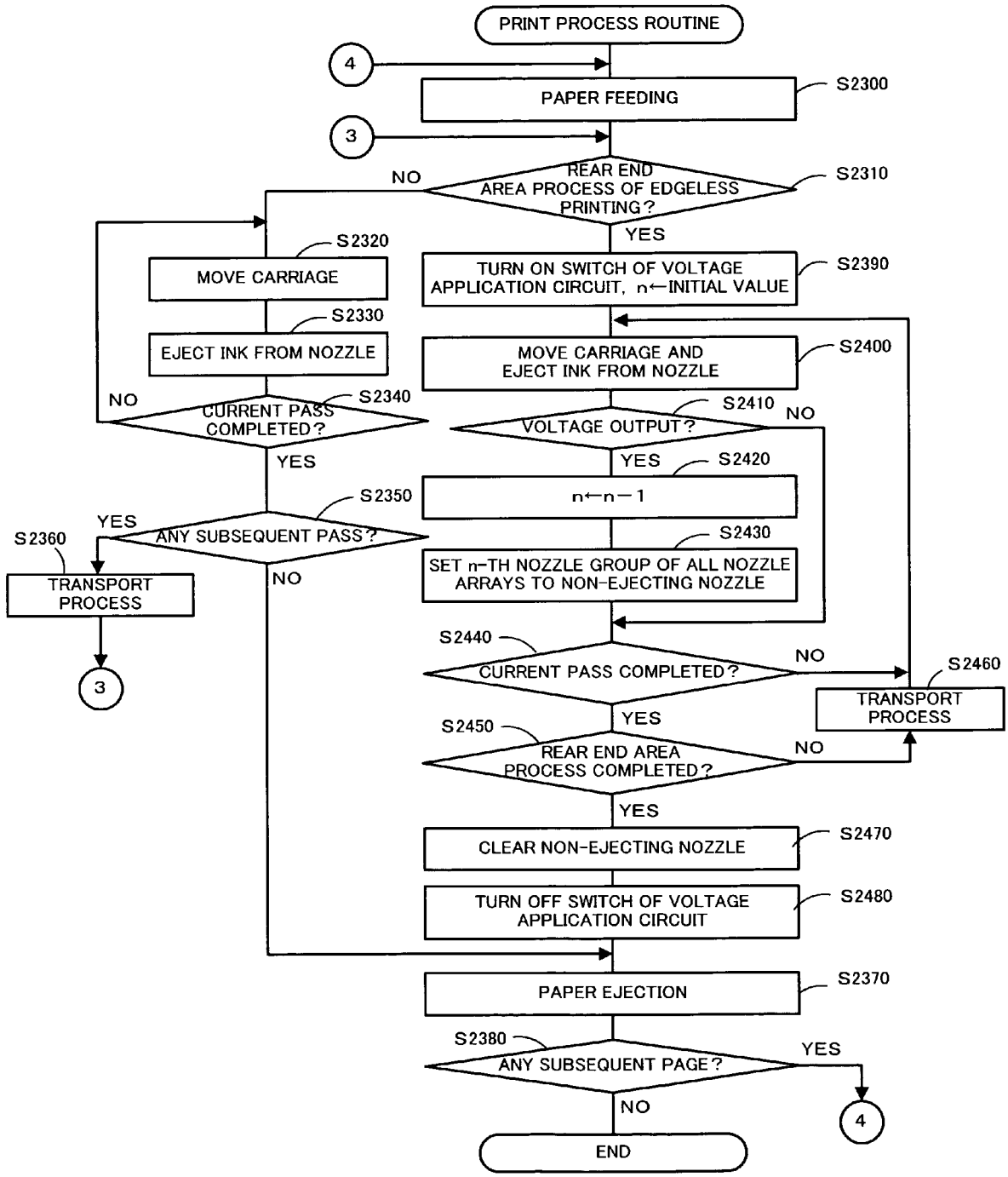
FIG. 22 is a flow chart of the print operation routine of a third embodiment.

Next, as a third embodiment, ink ejection control at a rear edge of a recording sheet S will be described. FIG. 22 is a flow chart of a print process routing for detecting a rear edge of a recording sheet S. In this context, a case is mainly described in which a user selects borderfree printing of a postcard sized recording sheet S. When the print process routine is started, the CPU 72 first executes the paper feed process described above (step S2300). Then, the CPU 72 determines whether or not the latest process is a rear edge area process of a recording sheet S (step S2310). Now "a rear edge area process of a recording sheet S", which will be described in detail later, is a process of controlling ejection of the ink during print operation onto an area separated from a rear edge of a recording sheet S, at the rear edge area of the recording sheet S (see FIG. 23 to be described later) and that in border free printing is positioned below the print head 24. According to the setting, a judgment as to whether or not the latest process is a rear edge area process of the recording sheet S is made on the basis of whether or not print data is data for borderfree printing, and whether or not a rear edge area of the recording sheet S is located below the print head 24. The judgment as to whether or not the print data is data for borderfree printing should be made on the basis of information regarding print conditions contained in the print data. In this context, a position of a recording sheet S may be slightly misaligned as a result of a slip of the paper feed roller 36 during feeding. Thus, when a user selects borderfree printing the user PC 10 upsizes the image data for which printing instructions has been issued into image data that is larger in size than the size of the recording sheet S so that no edge is formed on the recording sheet S. The PC 10 transmit then to the ink jet printer 20 printing data including this image data and the information that is data for borderfree printing. In addition, a judgment as to whether or not a rear edge area of the recording sheet is located down below the print head 24 needs to be based on the information about the size of the recording sheet S contained in the print data, and the extent of feed remaining on the line feed roller after feeding of the recording sheet. The rear edge of the recording sheet S is determined to be on area at the rear edge of the recording sheet that is almost equivalent to one row of the nozzle array. In other words, the rear edge area of the recording sheet S is defined as an area in which ink that has been ejected may reach any area separated from the rear edge of the recording sheet within the ink receiving area 52.

When the latest process is not the rear edge area process of the recording sheet S, i.e., when the print data is not for borderfree printing or when the latest process is for printing on any area other than the rear edge of the recording sheet S even though the print data is for border free printing, the CPU 72 executes the normal print process of steps S2320 to S2360.

More specifically, the CPU 72 first moves the carriage 22 to a position so as to eject ink onto the recording sheet S (S2320). The configuration is such that an initial position of the carriage 22 is a position at the right end vicinity (above the first side ink absorbing area 52*a*) of the recording sheet at a time when the recording sheet S is placed along the reference guide, and that will be shifted to the left, as illustrated in FIG. 5, as printing progresses. In addition, the CPU 72 moves the carriage 22 to the ink eject position on the basis of a value of the linear type encoder 25. Next, the CPU 72 drives the piezoelectric device 48 on the basis of the print data so as to eject ink onto the recording sheet S (step S2330), and judges whether or not the current pass has been completed (step S2340). When the current pass has not been completed in step S2340, in step S2320 the CPU 72 moves the carriage 22 to the ink eject position, at which time ink is ejected onto the recording sheet S. On the other hand, when the current pass has been completed in step S2340, the CPU 72 judges whether or not there exists any data of a subsequent pass to print (step S2350). When any data of a subsequent pass to print exists, the CPU 72 executes the transport process of rotating and driving the line feed roller 35 and carrying the recording sheet S by a predetermined distance (step S2360). The CPU 72 executes the above-mentioned processes (steps S2320 to S2350), i.e. of moving the carriage 22 to eject ink onto the recording sheet, judging whether or not the current pass has been completed and whether or not there is a subsequent pass, until in step S2310 the latest process becomes the rear edge area process of the recording sheet S. In this context, when the print data is data for borderfree printing, the rear edge area process is executed in step S2310 without restoring to the negative judgment in step S2350. When the print data is not for borderfree printing, the normal print process is executed until printing has been completed without going through the positive judgment in step S2310. When there is no data to print for the subsequent pass in step S2350, the CPU 72 executes the paper ejection process of rotating and driving the paper eject roller 37 and ejecting the recording sheet S onto the catch tray (step S2370), and judges whether or not any subsequent page to print exist (step S2380). When any subsequent page to print exists, the CPU 72 judges in step S2310 whether or not the latest process is the rear edge process of the recording sheet S. When the latest process is not the rear edge area process of the recording sheet S, the XPU 72 repeats steps S2300 to S2380, while, when there is no subsequent page to print, the CPU 72 terminates the print process routine.

On the other hand, when the latest process is the rear edge area process of the recording sheet S in step S2310, the CPU 72 executes the rear edge area process of the recording sheet S (step S2390 to S2480). More specifically, by switching on the switch SW of the voltage application circuit 53, the CPU 72 causes the voltage application circuit 53 to generate a predetermined potential difference between the print head 24 and the ink receiving area 52 and sets to an initial value the number n of non-ejecting nozzles 23*ph* that do not need to eject ink, (step S2390). Here the initial value of the nozzle number n is defined to be n=181. In practice, as the number of nozzles can reach 180, no non-ejecting nozzle is set in an initial state. Next, the CPU 72 moves the carriage 22 to a position in which it can eject ink onto the recording sheet S and enables any nozzles 23 other than the non-ejecting nozzles 23*ph* to eject ink (step S2400). The configuration is such that, in a similar manner to that of the normal print process, an initial position of the carriage 22 is the position in the right end neighborhood of the recording sheet S when the recording sheet S is placed along the reference guide, and as can be seen in FIG. 1, the position will be shifted to the left, as the printing process progresses.

After step S2400, the CPU 72 judges whether or not voltage output of electrostatic induction has been caused by ink droplets having reached the rear edge ink absorbing area 52*e* within the ink receiving area 52 (step S2410). The judgment as to whether or not voltage output of electrostatic induction exists is on the basis of whether or not a maximal value of voltage outputted from the voltage detection circuit 54 exceeds a threshold Vthr. The threshold Vthr is an empirically defined value so that during the printing process amplitude of an output signal can be exceeded when ink is ejected onto the ink receiving area 52. When a judgment is made that voltage output of electrostatic induction exists, the CPU 72 deems that ink droplets ejected from the nozzles 23 has run over the rear edge of the recording sheet S, and have reached the front/rear edge ink absorbing area 52*e*. Then the CPU 72 subtracts 1 from the nozzle number n (step S2420), and sets as the non-ejecting nozzles 23*ph*, the nth nozzle group (any nozzles 23 other than the non-ejecting nozzles 23*ph* that are arranged in the uppermost stream in the transport direction), nozzles 23 that are arranged in the main scanning direction (step S2430). Thus, when voltage output of electrostatic induction is first detected, the nozzle group of the nozzle number n=180 is set to the non-ejecting nozzles 23*ph*. Information on the non-ejecting nozzles 23*ph* is stored in a predetermined area of the RAM 74. In this context, when ink is ejected in the area between the area separated from the right end of the recording sheet, i.e., a home position as can be viewed in FIG. 5, and the right end of the recording sheet, within the ink receiving area 52 irrespective of whether ink runs over the rear edge, power output can be detected. Thus, in this third embodiment, a margin is provided between the home position and the right end of the recording sheet whereby no non-ejecting nozzles 23*ph* are set in the area separated from the right end of the recording sheet, and it has been determined that a non-ejecting nozzle 23*ph* can be set only when the carriage 22 passes this margin. The margin is set in the anticipation that a recording sheet S will be offset from the reference guide and fed.

After step S2430, or after in step S2420 it is judged that no voltage output of electrostatic induction exists (i.e, after a judgment has been made that ink droplets ejected from the nozzle 23 do not run over the rear edge of the recording sheet S and thus that there is no need to set non-ejecting nozzles 23*ph*, the CPU 72 judges whether or not the current pass has been completed (step S2440). When the current pass has not been completed, the CPU 72 repeats the processes of steps S2400 to S2440 until in step S2440 it is judged that the current pass has been completed. In other words in step S2400, the CPU 72 moves the carriage 22 to the ink eject position and causes any nozzle 23 other than the non-ejecting nozzles 23*ph* to eject ink onto the recording sheet S, and in step S2410 judges whether or not there is voltage output of electrostatic induction exists. When voltage output of electrostatic induction exists, the CPU 72 subtracts 1 from the nozzle number set to the latest non-ejecting nozzle 23*ph*, in step S2430 sets as the non-ejecting nozzle 23*ph* the nth nozzle group arranged in the main scanning direction, and in step S2440 judges whether or not the current pass has been completed.

Figure 23:
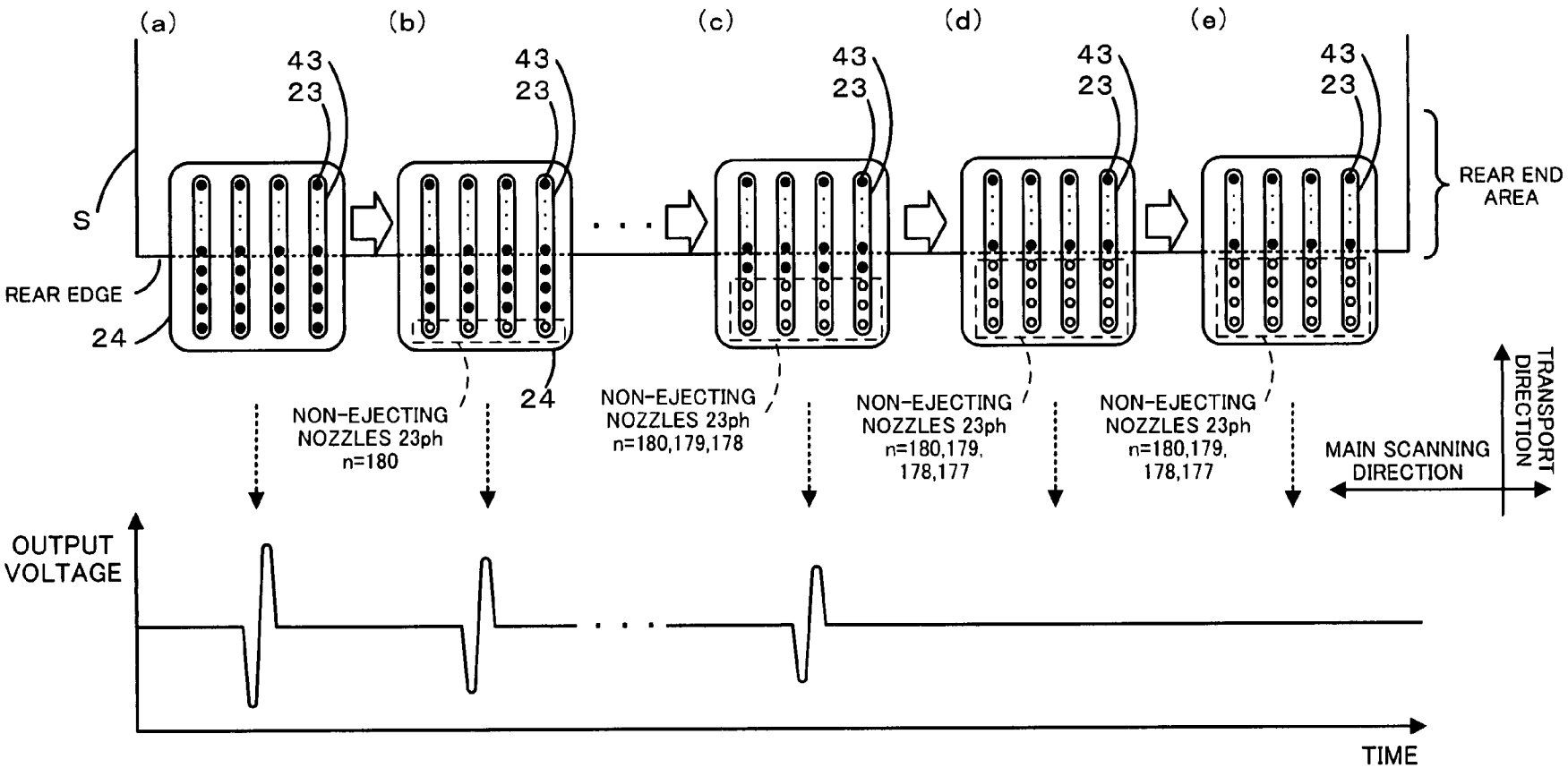
FIG. 23 is an illustrative diagram of a rear edge process of a recording sheet S.

Next, the processes of steps S2400 to S2440 will be described with reference to FIG. 23, an illustrative diagram of the rear edge area process of the recording sheet S. FIG. 23 (*a*) is a view before the non-ejecting nozzle 23*ph* is set. FIG. 23 (*b*) illustrates the nozzle group of n=180 being set to the non-ejecting nozzle 23*ph*. FIG. 23 (*c*) illustrates the nozzle group of n=178 set to the non-ejecting nozzle 23*ph*. FIGS. 23

(*d*) and (*e*) illustrate the nozzle group of n=17 set to the non-ejecting nozzle 23*ph*. The upper column of FIG. 23 is an illustrative diagram of an occasion when the print head 24 is viewed from above, while the lower column is a view of output voltage detection at the ink receiving area 52. In (a) to (e), the upper column views and the lower column views correspond to one another. In FIG. 23 and subsequent figures, any of the nozzles 23 other than the non-ejecting nozzle 23*ph* among the nozzles 23 are represented by the black symbols, while the non-ejecting nozzle 23*ph* is represented by an outline symbol. In the rear edge area process of the recording sheet S, ink ejected from the nozzles 23 of the print head can reach both the area separated from the rear edge of the recording sheet S and the area covered by the recording sheet S of the front/rear edge ink absorbing area 52*e*. Then, on the basis of the print data, ink is in the first place ejected onto the recording sheet S from all the nozzles 23. Next, as shown in FIG. 23 (*a*), after passing the area separated from the right end of the recording sheet S, ink droplets ejected from the nozzles 23 run over the rear edge of the recording sheet S and reach the front/rear edge ink absorbing area 52*e*. Then, as shown in the lower column of FIG. 23 (*a*), the voltage detection circuit 54 detects output voltage resulting from electrostatic induction caused by the ink droplets running over the rear edge of the recording sheet S. Then, as shown in FIG. 23 (*b*), the CPU 72 sets as the non-ejecting nozzle 23*ph* any nozzle group 23 other than the non-ejecting nozzles 23 ph (nozzle group of n=180 in this case) arranged in the uppermost stream in the transport direction (FIG. 23 (*b*)). Next, as shown in FIG. 23 (*b*), the CPU 72 moves the carriage 22 and causes any nozzles 23 other than the non-ejecting nozzles 23*ph* that has been set to eject ink. Then, when output voltage resulting from electrostatic induction is detected in the front/rear edge ink absorbing area 52*e* (lower column of FIG. 23 (*b*)), the CPU 72 sets as the non-ejecting nozzles ph any nozzle 23 group (nozzle group of n=179 in this case) arranged in the further uppermost stream in the transport direction other than the non-ejecting nozzles 23*ph*, and executes the above operations (FIG. 23 (*c*)). Thus, the CPU 72 ejects ink onto the recording sheet S while setting non-ejecting nozzles that do not need to eject ink droplets. Then, after setting as the non-ejecting nozzle 23*ph* in FIG. 23 (*c*), nozzles with the nozzle numbers n=177 to 180, and when in FIG. 23 (*d*) output voltage caused by electrostatic induction is no longer detected in the front/rear edge ink absorbing area 52*e*, CPU 72 deems that ink droplets ejected from the nozzles 23 are not running over the rear edge of the recording sheet S. Then, as shown in FIG. 23 (*c*), the CPU 72 enables ink be ejected on the basis of the latest setting of the non-ejecting nozzle 23 ph. In this manner, the CPU 72 controls ink eject at the rear edge of the recording sheet S. In addition, although, for the sake of convenience in preparing the drawings, FIG. 23 (*a*) to (*d*) create an impression that the non-ejecting nozzles 23*ph* were set as the print head 24 moved of substantial intervals, impractical, the non-ejecting nozzle 23*ph* described above is set every time the print head moves one pixel.

When in step S2440 the current pass has been completed, on the basis of whether or not all the nozzles 23 have been set as the non-ejecting nozzles 23*ph*, the CPU 72 judges whether or not the rear edge area process of the recording sheet S has been completed, namely, whether or not ejection of ink onto the rear edge of the recording sheet S has been completed (step S2450). When the rear edge area process of the recording sheet S has not been completed, the CPU 72 executes the transport process because data exists for printing during a subsequent pass (step S2440), and executes the processes of steps S2400 to S2450. Predetermined intervals (so-called nozzle pitch) exists among a plurality of nozzles 23 arranged in the transport direction of the recording sheet, and thus ink has to be ejected into spaces on the recording sheet S caused by the nozzle pitch. Thus, a number of passes of ink eject take place during printing on the rear edge of the recording sheet S. In the rear edge area process, the extent to which the recording sheet S should be transported is defined to be any value that guarantees that no blank spaces are formed in the rear edge area of the recording sheet S as a result of gaps among the nozzles, and in this instance is set to a length of the distance of one nozzle. In addition, when the operation of ejecting ink for a few passes has thus been completed, there is no need to eject ink from the non-ejecting nozzles 23*ph*, even though the recording sheet is carried in the transport direction. Thus, the last setting for the non-ejecting nozzles 23*ph* can continue. Then, when in step S2450 the rear edge area process of the recording sheet S comes to an ends, the CPU 72 clears information of the non-ejecting nozzles 23*ph* stored in the RAM 74 (step S 2470). The CPU 72 switches off the SW of the voltage application circuit 53 (step S2480), executes the paper ejection process described above (step S2370), and judges whether or not any subsequent page needs to be printed (step S2380). When any subsequent page needs to be printed, the CPU 72 repeats the processes of steps S2300 to S2460. When there is no page to print in step S2380, the CPU 72 directly terminates the print process routine.

According to the ink jet printer 20 of this third embodiment described in detail above, a predetermined potential difference is generated between the ink receiving area 52 and the print head 24, and while ink prior to being ejected, the print head 24 ejects ink from the nozzles 23 onto both the area separated from the rear edge of the recording sheet and the area covered by the rear edge of the recording sheet S within the ink receiving area 52. At this time, every time that voltage output is detected in the ink receiving area 52, among nozzles 23 that are able to eject, the nozzle 23 group in the uppermost stream in the transport direction of the recording sheet S that are arranged in the main scanning direction are set as non-ejecting nozzles 23*ph*. Then, on the basis of the setting, the print head ejects ink onto the rear edge of the recording sheet S. In other words, voltage output in the ink receiving area 52 is detected by using directly ink ejected from the nozzles 23, and on the basis of the results of detection non-ejecting nozzles at the rear edge of the recording sheet can be set with accuracy. Thus, unlike any method by which anything other than ink is used and non-ejecting nozzles at the rear edge of the recording sheet S indirectly set, the embodiment does not have to provide a wide area onto which ink can run over the rear edge of the recording sheet so as to avoid the formation of blank spaces on the recording sheet S. Thus, in borderfree printing, consumption of ink at the rear edge of the recording sheet S can be better controlled. This method also contributes to reduction of possible contamination inside the ink jet printer 20 resulting from to ink mist caused by ejected ink running over the recording sheet S. In addition, in the rear edge area process, as many opportunities, to set non-ejecting nozzles 23*ph* whenever the nozzles eject ink and voltage output is detected in the ink receiving area 52, it is possible to control consumption of ink even more. In addition, as a plurality of nozzles 23*ph* is decided upon as a nozzle group when voltage output is detected within the ink receiving area 52, this also makes it possible to control consumption of ink even further. In addition, since the number of areas onto which ink is ejected, and from which ink runs over the recording sheet S, can be reduced (since areas of the recording sheet S can be reduced onto which ink is ejected and off the edge of which ink runs off), the degree of expansion of the image data can be reduced during borderfree printing or printing even become possible without upsizing image data. It is thus possible to obtain post-print images that are more approximate to on an image for which printing instructions have been issued.

In addition, as the ink receiving area 52 is formed across almost the entire printable area on the platen 44, and the voltage detection circuit 54 detects voltage output across the entire printable area on the platen 44, it is possible to set non-ejecting nozzles 23*ph* at the rear edge of recording sheets S of various sizes. Furthermore, as a check is undertaken within the ink receiving area 52 as to whether or not ink is normally ejected, the ink eject check from the print head 24, and the detection of a rear edge of a recording sheet S, can take place within the same ink receiving area 52, thereby eliminating the need for providing a new area for the check of ink eject. In addition, when the piezoelectric device 48, etc., is controlled in such a way that the print head 24 ejects ink from the nozzles 23 onto both the area separated from the rear edge of the recording sheet S and the area covered by the rear edge of the recording sheet S within the ink receiving area 52, the voltage application circuit 53 generates a predetermined potential difference between the print head 24 and the ink receiving area 52, and charges ink in advance of ejection from the nozzles 23. Thus, when the rear edge of the recording sheet is detected, it is possible to generate without fail electronic induction resulting from ink eject.

Figure 24:
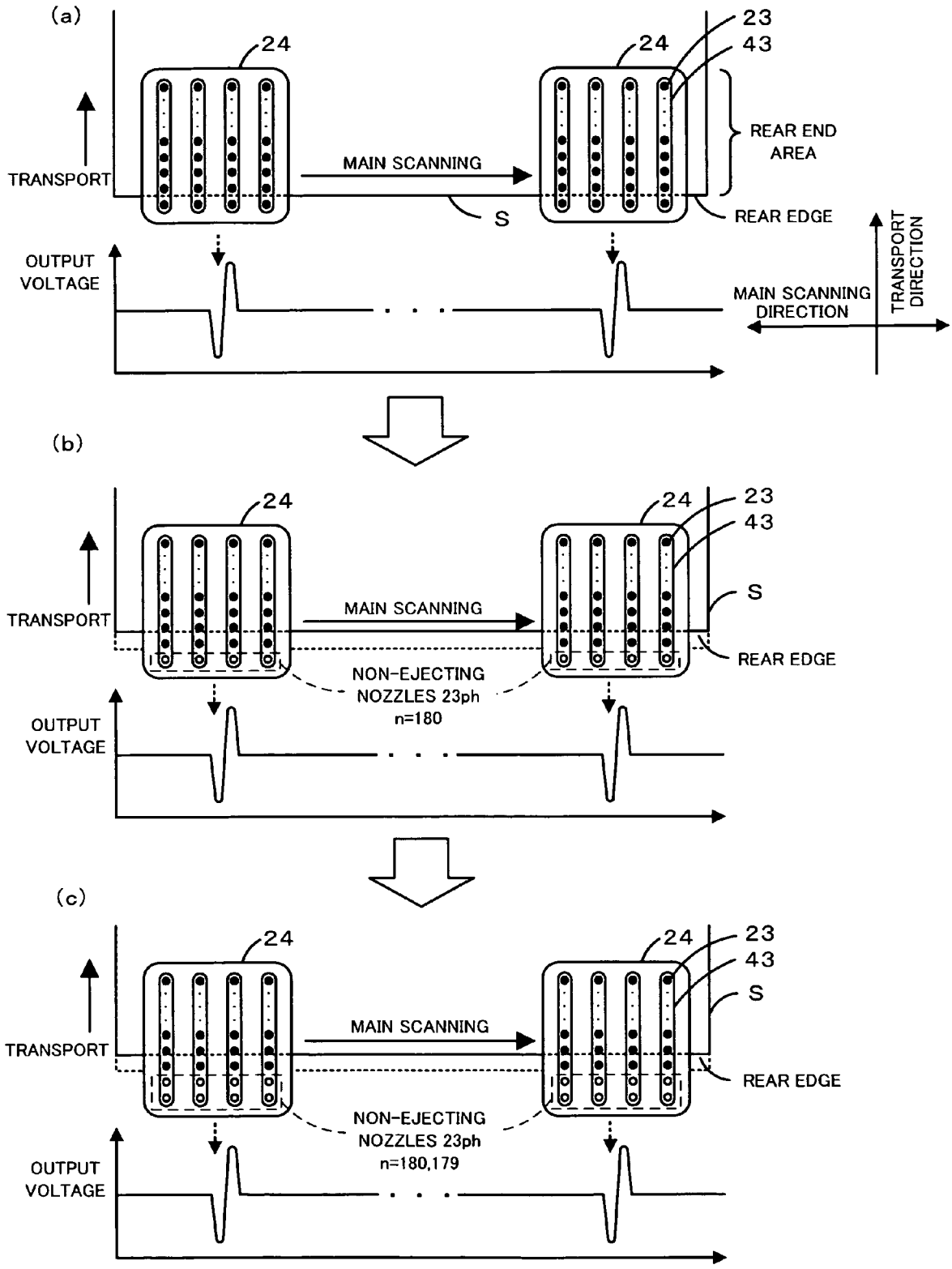
FIG. 24 is an illustrative diagram of a rear edge operation of another recording sheet S.

In the third embodiment described above, in the rear edge area process of the recording sheet S, whenever in one pass, the print head 24 ejects ink from the nozzles 23 and voltage output is detected within the ink receiving area 52, non-ejecting nozzles 23*ph* are set and ink is ejected on the basis of the setting. However, as shown in FIG. 24, after non-ejecting nozzles 23*ph* have been set, when the print head 24 ejects ink from the nozzles 23 and voltage output is detected within the ink receiving area 52, ink eject in a pass following the subsequent transport process may be undertaken by means of the setting. FIG. 24 is an illustrative diagram of another rear edge area process. FIG. 24 (*a*) is a view before the non-ejecting nozzle 23*ph* is set. FIG. 24 (*b*) sows the nozzle group of n=180 being set to the non-ejecting nozzle 23*ph*. FIG. 24 (*c*) illustrates the nozzle group of n=179 set to the non-ejecting nozzle 23*ph*. As illustrated in FIG. 24 (*a*), in the rear edge area process of the recording sheet S, ink is ejected onto the recording sheet S. Then, when ink droplets run over the rear edge of the recording sheet S and reach the front/rear edge ink absorbing area 52*e*, the voltage detection circuit 54 detects output voltage resulting in electrostatic induction, as shown in FIG. 24 (*a*) below. Then, the CPU 72 sets the nozzle 23 group (nozzle group of n=180 in this case) other than the non-ejecting nozzles 23*ph* that are arranged in the uppermost stream in the transport direction. However, in the current pass, ink is ejected directly from the nozzles 23. Next, as illustrated in FIG. 24 (*b*), the CPU 72 carries the recording sheet S for a predetermined distance, and executes the current pass so that ink is ejected from the nozzles 23 other than the non-ejecting nozzles 23*ph* that were determined on the previous occasion. At that time, when ink droplets runs over the rear edge of the recording sheet S and reach the front/rear edge ink absorbing area 52*e*, output voltage resulting from electrostatic induction is detected, as shown in the lower view of FIG. 24 (*b*). Then, although the CPU 72 sets the nozzle 23 group (nozzle group of n=179 in this case) other than the non-ejecting nozzles 23 ph that are arranged in the uppermost stream in the transport direction, the current pass directly enables the nozzle 23 to eject ink. Similarly, as shown in FIG. 24 (*c*), ink is ejected from the nozzles 23 other than the last non-ejecting nozzles 23*ph* that were determined on the previous occasion. When output voltage resulting from electrostatic induction is detected in the front/rear edge ink absorbing areas 52*e*, the CPU 72 will set as the non-ejecting nozzle 23*ph* the nozzle 23 group other than the non-ejecting nozzles 23*ph* arranged in the uppermost stream in the transport direction. In this manner the latest setting of the non-ejecting nozzles 23 is reflected in the next transport of the recording sheet S and ejection of ink, thereby controlling the consumption of ink. In addition, as a plurality of non-ejecting nozzles 23*ph* is firmly set as a nozzle group when voltage output is detected in the ink receiving area 52, consumption of ink can be further controlled. In this context, depending on the setting of a transport distance of the recording sheet S, a position where non-ejecting nozzle 23*ph* is set may be offset from a moving position of the rear edge. Thus, the non-ejecting nozzles 23*ph* should be set as appropriate in accordance with the transport distance. For instance, when the transport distance of the recording sheet S is greater than the intervals (nozzle pitch) between nozzles 23 arranged in the nozzle array 43, the set position of a non-ejecting nozzle 23 will be behind the moving rear edge position, thus increasing the number of nozzle groups (numbers of arrays) set to the non-ejecting nozzle 23*ph*. On the other hand, when the transport distance of the recording sheet S is smaller than the size of nozzle, after voltage output is detected in the front/rear edge ink absorbing area 52*e* and the non-ejecting nozzle 23*ph* is set, ink may be ejected by means of the setting after the sheet has been carried for a distance of one nozzle.

Figure 25:
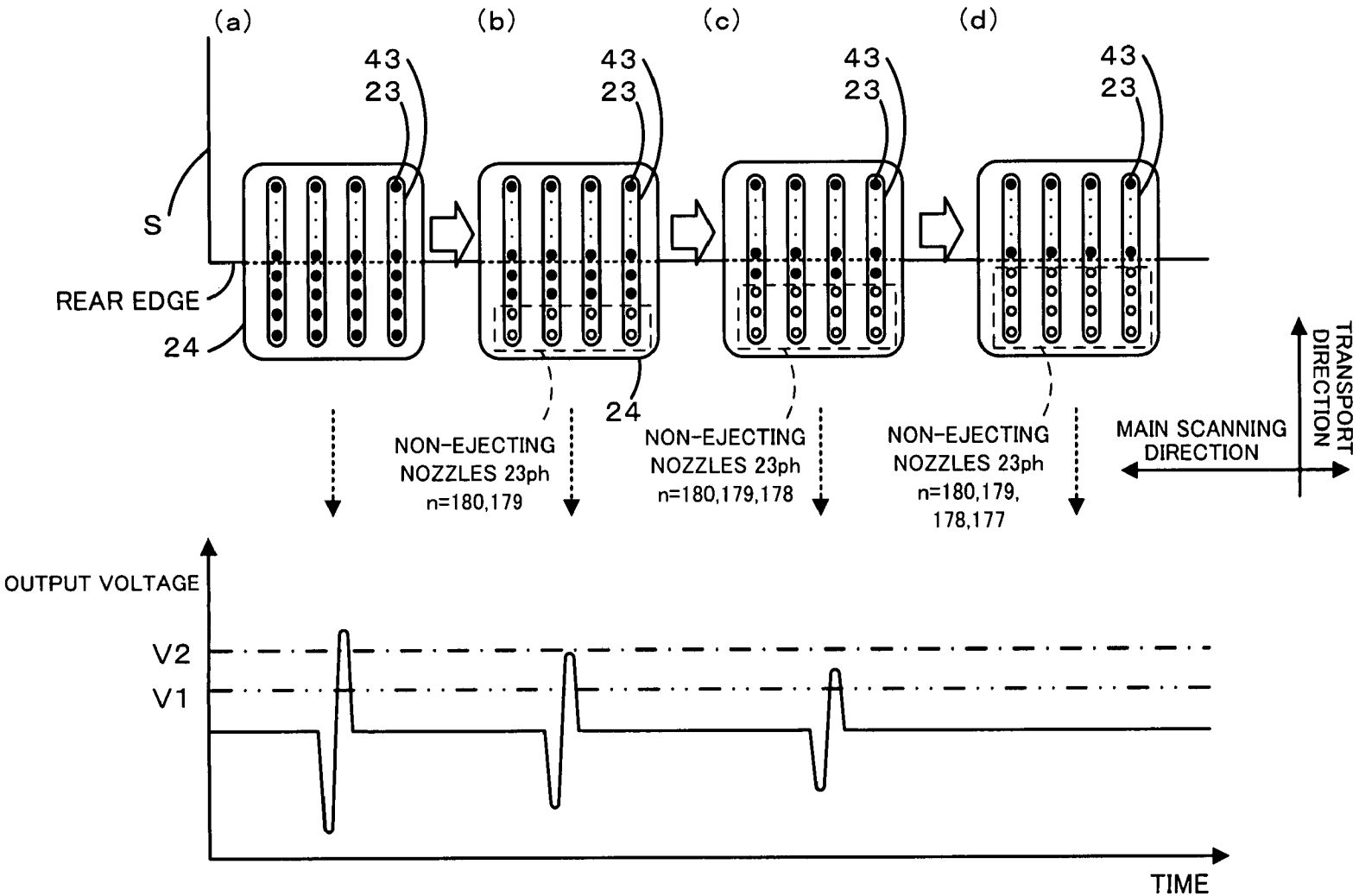
FIG. 25 is an illustrative diagram for setting the non-ejecting nozzle 23 ph on the basis of output voltage.

In the third embodiment described above, when the print head 24 ejects ink from the nozzles 23 and voltage output is detected within the ink receiving area 52, among the nozzles 23, the nozzle 23 group in the uppermost stream in the transport direction of the recording sheet S is set as the non-ejecting nozzles 23*ph*. However, as illustrated in FIG. 25, the number of nozzles set as non-ejecting nozzles 23*ph* may be set on the basis of magnitude of voltage output detected within the ink receiving area 52, i.e, on the basis of the amount of ink that runs over the recording sheet S. FIG. 25 is an illustrative diagram for setting a non-ejecting nozzle 23*ph* on the basis of output voltage. FIG. 25 (*a*) is a view before the non-ejecting nozzle 23 ph is set. FIG. 25 (*b*) illustrates nozzle groups of n=180, 179 set as non-ejecting nozzle 23*ph*. FIG. 25 (*c*) illustrates a nozzle group of n=177 set as non-ejecting nozzles 23*ph*. More specifically, a relationship between the magnitude of output voltage detected within the ink receiving area 52 and the number of nozzle groups ejecting ink that reaches the ink receiving area 52 separated from the rear edge of the recording sheet S is empirically determined, and a threshold of output voltage that satisfies the relationship determined needs to be defined. The threshold should be set in such a way that as output voltage detected by the voltage detection circuit 54 rises the number of nozzle groups set as non-ejecting nozzles 23*ph* increases. For instance, as shown in the lower figure of FIG. 25, a threshold V2 of output voltage that sets as non-ejecting nozzles 23*ph*, two arrays of nozzles arranged in the uppermost stream in the transport direction, and a threshold V1 of voltage that is lower than the threshold V2 and sets only one front-row array of nozzles 23*ph* that are able to eject in the transport direction of the recording sheet S, are defined. Moreover, in the rear edge area process of the recording sheet S of the print process routine, when the output voltage exceeds the threshold V2 (FIG. 25 8*a*)), the two front row arrays in the transport direction should be set to the non-ejecting nozzles 23*ph* (FIG. 25 (*b*)). When the output voltage is lower than the threshold V2 and exceeds the threshold V1 (FIG. 25 (*b*)), only the front row in the transport direction should be set as non-ejecting nozzles 23*ph* (FIG. 25

(*c*)). In this manner, the number of arrays of non-ejecting nozzles 23*h* can be set on the basis of the amount of ink that runs over the rear edge of the recording sheet S, consumption of ink in the rear edge area process of the recording sheet S can thereby be efficiently controlled.

In the third embodiment described above, the print head 24 ejects ink from the nozzles, and whenever voltage output is detected within the ink receiving area 52, non-ejecting nozzles 23*ph* are set and ink is ejected on the basis of this setting. However, the print head 24 may eject ink from the nozzle 23, a right end position of the recording sheet S may be determined on the basis of the voltage output detected within the ink receiving area 52, non-ejecting nozzles 23 ph may be set on the basis of the rear edge position determined, and ink may be ejected on the basis of the setting. More specifically, the CPU 72 executes steps S2300 to S2410 of the print process routine as shown in FIG. 22 above, sets the nth nozzle group as the non-ejecting nozzle 23*ph* (n=177 in this case) and ejects ink. When voltage output resulting from electrostatic induction is no longer detected within the ink receiving area 52 (step S2410), a determination can be made that there is a rear edge position of the recording sheet S between the number of nozzles (n=177) of the latest non-ejecting nozzles 23*ph* and the last number of nozzles (n=176 in this case). Then, by utilizing the rear edge position determined, the CPU 72 resets the non-ejecting nozzles 23*ph*. Moreover, the CPU 72 resets them in such a way that among the non-ejecting nozzles 23*ph*, a nozzle 23 (n=177 in this case) proximate to the rear edge of the recording sheet S ejects ink. In other words, the CPU 72 sets the nozzles with the nozzle numbers n=178 to 180 as the non-ejecting nozzles 23*ph*. Then, ink is ejected on the basis of this setting. In other words, ink is ejected, so as to run over the recording sheet S for a distance of one nozzle from the rear edge position of the recording sheet S. In this manner, the rear edge of the recording sheet S is determined by using directly ink ejected from the nozzles 23, and, in comparison with any method in which anything other than ink is used and the rear edge position of the recording sheet S is indirectly determines, this method makes it possible to determine the rear edge of the recording sheet S with a greater degree of accuracy. In addition, use of a rear edge position determined with accuracy enables better control of the consumption of in at the rear edge of the recording sheet. Moreover, this also inhibits with a degree of certainty the formation of blank spaces during borderfree printing. Furthermore, in this context, although ink is ejected so as to run over the recording sheet S for a distance of one nozzle from the rear edge position of the recording sheet S, ink may be ejected so as to run over the recording sheet S for a distance of a few nozzles.

Figure 26:
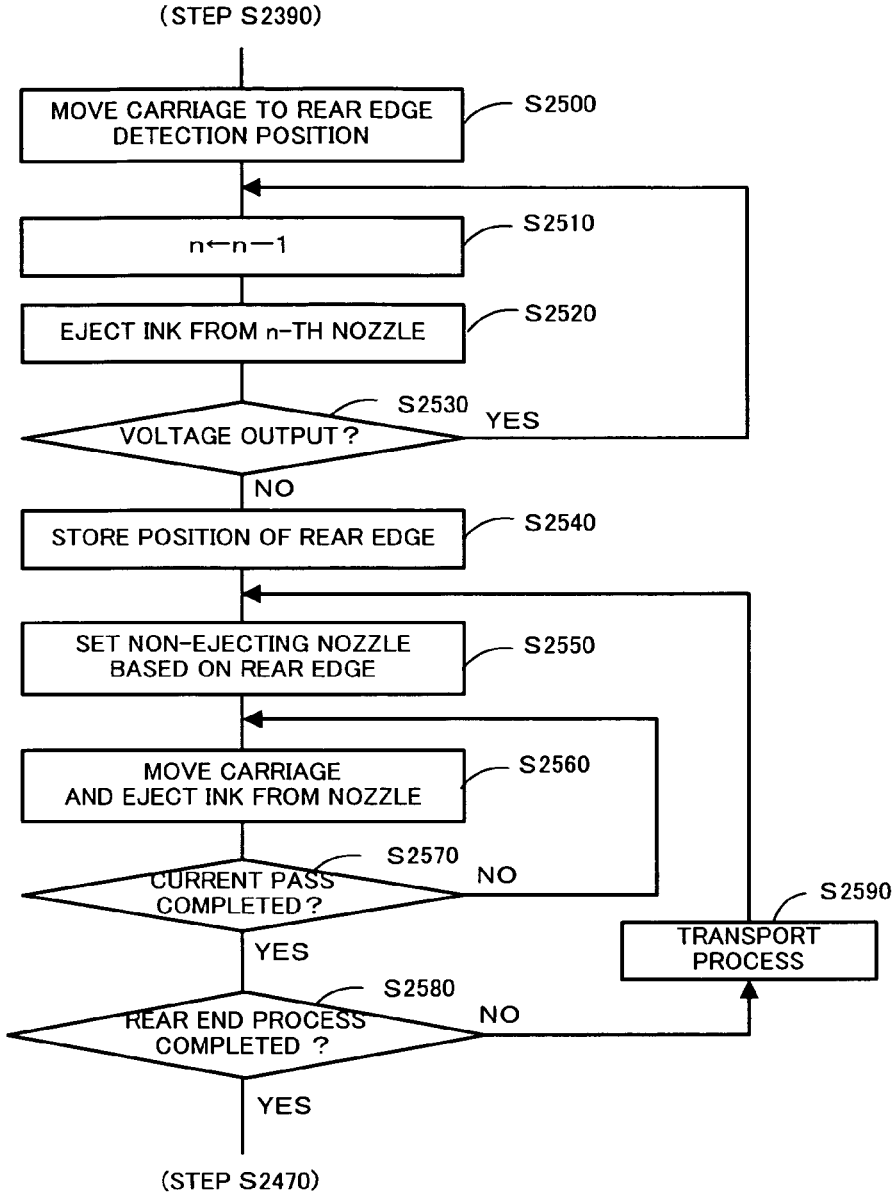
FIG. 26 is a flow chart of the print operation routine of another third embodiment.
Figure 27:
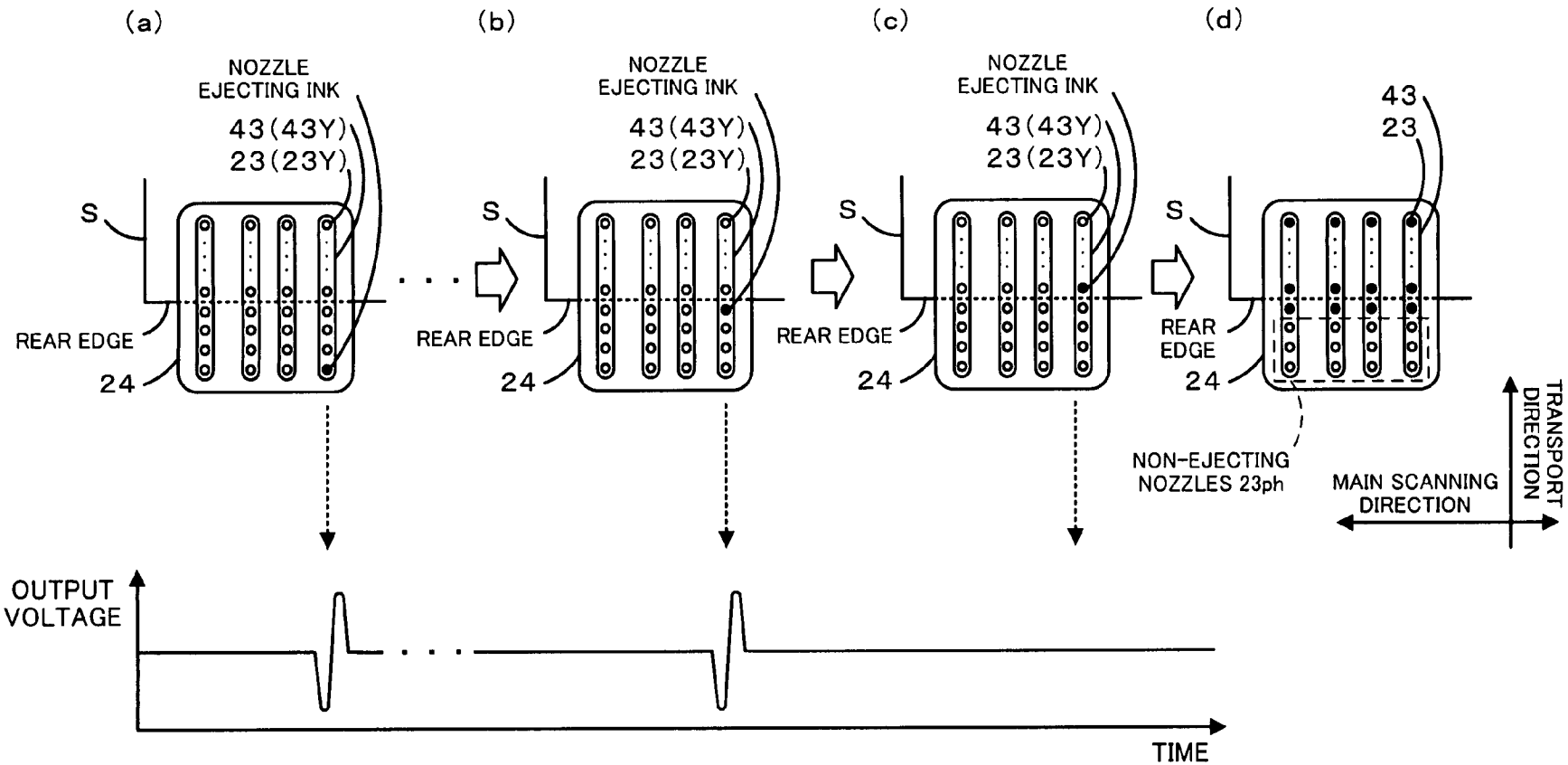
FIG. 27 is an illustrative diagram of a determination process of a rear edge position of a recording sheet S.

In the third embodiment described above, in the rear edge area process of the recording sheet S, the print head 24 ejects ink from the nozzles 23, and whenever voltage output is detected within the ink receiving area 52, a non-ejecting nozzle 23 ph is set, and ink is ejected by means this setting. However, as shown in FIG. 26 and FIG. 27, in the rear edge area process of the recording sheet S, the CPU may abort the print operation, execute a process of determining the rear edge position of the recording sheet S, set non-ejecting nozzles 23*ph* on the basis of the rear edge position determined, and eject ink on the basis of the setting. FIG. 26 is a flow chart of another print process routine. FIG. 27 is an illustrative diagram of the process of determining the rear edge position of the recording sheet S. FIG. 27 (*a*) illustrates a eject nozzle offset from the rear edge by a distance of three nozzles. FIG. 27 (*b*) illustrates a eject nozzle being offset from the rear edge by a distance of one nozzle. FIG. 27 (*c*) illustrates a eject nozzle located at the rear edge. FIG. 27 (*d*) illustrates a non-ejecting nozzle 23*ph* being set. More specifically, instead of steps S2400 to S2460 of the print process routine of FIG. 22 described above, the CPU 72 executes the following process. After the rear edge area process of the recording sheet S in step S2390, while ink ejected from the nozzle 23 included in the nozzle array 43 is able to reach the area separated from the rear edge of the recording sheet S and the are a covered by the recording sheet S, the CPU 72 fixes the recording sheet S and moves the carriage 22 to the rear edge position detected (step S2500). It should be noted that the rear edge position detected is set above the first side ink absorbing area 52*a*. Next, the CPU 72 subtracts 1 from the nozzle number, namely, sets the nozzle number ton=180 (step S2510), and enables the nth nozzle 23 to eject ink (step S2520). In this context, a setting is made such that ink droplets are ejected from the nozzle 23Y of the nozzle array 43Y in yellow, a color of ink that is not easy to view. Furthermore, the number of ejects of the ink droplets is set at 24 shots (8 segments). The number of ink ejects may be the number of ejects that enables a correct detection of the landing of ink droplets on the ink receiving area 52, and preferably smaller than 24 shots. In FIG. 27 ink ejecting nozzles are annotated by black circles. Next, the CPU 72 judges whether or not any voltage output resulting from electrostatic induction exists in the front/rear edge ink absorbing area 52*e* (step S2530). When any voltage output resulting from electrostatic induction exists (the lower column of FIG. 27 (*a*)), the CPU 72 deems that the nozzle 23Y that ejected ink droplets is not at the rear edge of the recording sheet S, and subtracts one from the nozzle number n. Thus, it changes to a latest nozzle that is a distance of one nozzle further downstream from the last nozzle 23Y in the transport direction of the recording sheet S. Then, the CPU 72 causes the nth nozzle 23Y to eject ink droplets (step S2520), and repeats the processes of steps S2510 to S2530 until in step S2520 there is no longer any voltage output resulting from electrostatic induction. On the other hand, when it is judged that no voltage output resulting from electrostatic induction has occurred (the lower column of FIG. 27 (*c*)) in step S2530, the CPU 72 deems that the nozzle 23Y that ejected ink droplets on this occasion is located above the rear edge of the recording sheet S, and that the recording sheet S prevented ink droplets from reaching the ink receiving area 52. Then, the CPU 72 determines that the rear edge position of the recording sheet S exists between the latest nozzle number (n=176) and the last nozzle number (n=177). Then, the CPU 72 stores in the RAM 74 as the rear edge position of the recording sheet S the number (n=176) of nozzles 23Y that ejected ink droplets on this occasion (steps S2540). Then, the CPU 72 sets the non-ejecting nozzles 23*ph* on the basis of the position of the rear edge of the recording sheet S determined (steps S2550). Here, as shown in FIG. 27 (*d*), the CPU 72 sets as the non-ejecting nozzles 23*ph* any nozzles other than nozzles 23 lying closer to the recording sheet S than the rear edge position of the recording sheet S and nozzles 23 proximate to the rear edge position on the side separated from the rear edge of the recording sheet S. Thus no blank spaces are formed during borderfree printing. Then, the CPU 72 moves the carriage 22 to the ink eject position and causes the nozzle 23 that has been set to eject ink (step S2560), and judges whether or not the current pass has been terminated (step S2570). When the current pass has not been terminated, the CPU 72 executes the processes of steps S2560 to S2570. When the current pass has been terminated, on the other hand, the CPU 72 judges whether or not the rear edge area process has been completed (step S2580). When the rear edge area process has not been completed, the CPU 72 executes the transport process (step S2590) and executes the processes of the above steps S2550 to S2590. Since the rear edge position of the recording sheet S moves when the recording sheet S is carried, every time that it executes the transport process in step S2590, the CPU 72 sets a non-ejecting nozzle 23*ph*, etc., on the basis of the rear edge position that has moved (step S2550). On the other hand, when the rear edge area process in step S2580 has been completed, the CPU 72 executes the processes of step S2470 and onwards in the print process routine illustrated in FIG. 22. In this manner, as the rear edge of the recording sheet S is determined by using directly ink ejected from the nozzle 23, the rear edge position of the recording sheet S can be determined with a greater degree of accuracy than with any method in which anything other than ink is used and in which the rear edge position of the recording sheet is indirectly determined. In addition, use of a rear edge position determined with accuracy enables better control of the consumption of ink at the rear edge of the recording sheet S. In addition, as the CPU 72 fixes the recording sheet and executes the operation of determining the rear edge position of the recording sheet S, the rear edge position of the recording sheet S can be determined more accurately than with any method in which the operation of determining the rear edge position of the recording sheet S is executed by moving the recording sheet S. In this context, although yellow ink that is not easy to view is used, light cyan ink, light magenta ink, etc., or a clear and colorless liquid such as water or clear ink, etc., for putting a glaze may be used. Alternatively, in actual printing ink ejected to determine the rear edge position of the recording sheet S may also be ink ejected onto the recording sheet S on the basis of the print data. In this way it becomes possible to prevent ink droplets ejected to determine the rear edge from having an adverse affect on post-print images.

Figure 28:
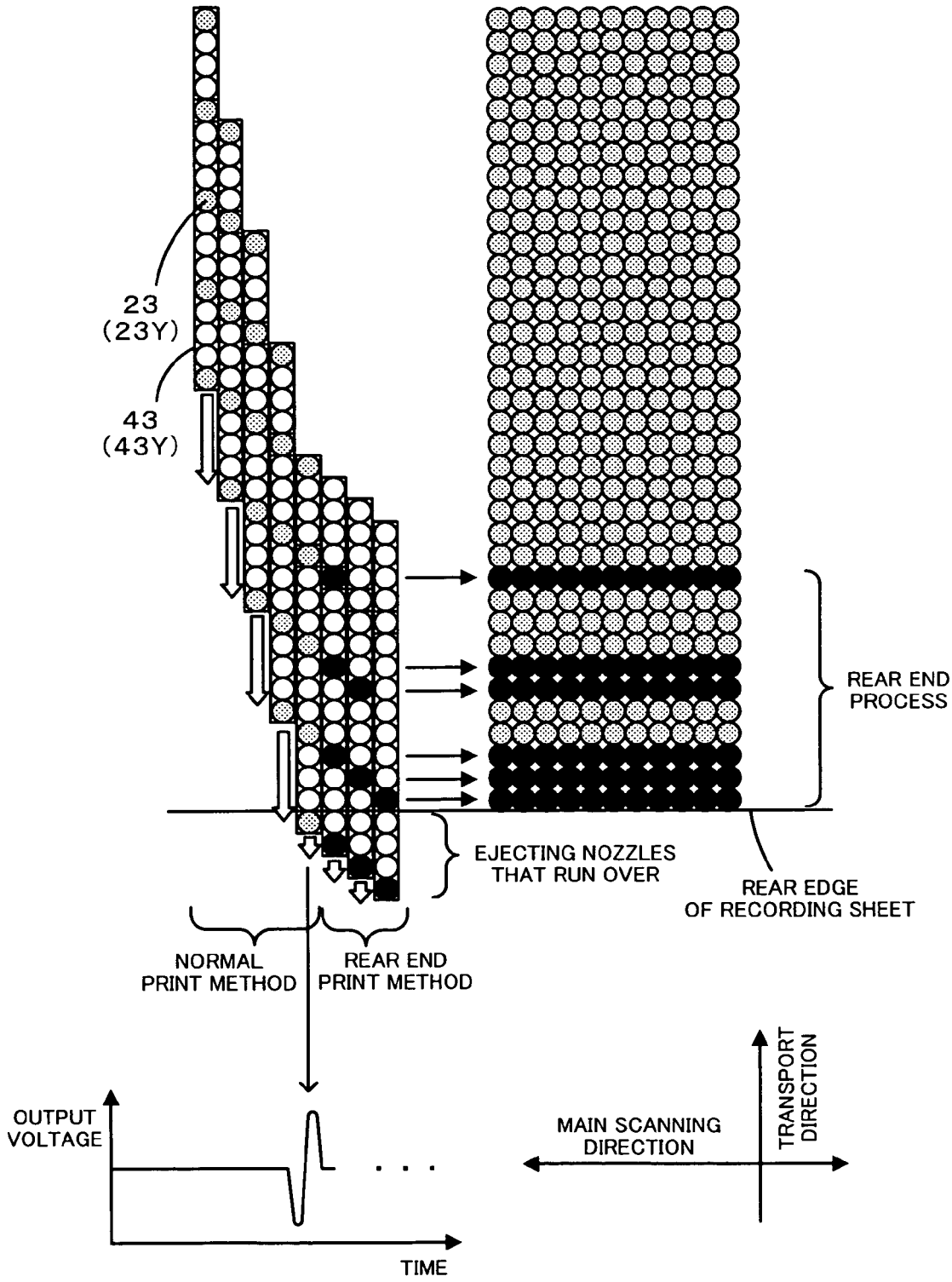
FIG. 28 is an illustrative diagram for switching a print method at the rear edge of a recording sheet S.

In the third embodiment described above, in the rear edge area process of the recording sheet S, the print head 24 ejects ink from the nozzles 23, and on the basis of voltage output detected within the ink receiving area 52, a rear edge position of the recording sheet S is determined, and a non-ejecting nozzle 23*ph* is set. However, as shown in FIG. 28, in the rear edge area process of the recording sheet S, the print head 24 ejects ink from the nozzles 23 and on the basis of the voltage output detected within the ink receiving area 52, the normal print method in any area other than the rear edge of the recording sheet S and the print method at the rear edge of the recording sheet S may be reversed. FIG. 28 is an illustrative diagram of the switching of the print method at the rear edge of the recording sheet S. In this Figure, nozzle 23 that ejects ink by means of the normal print method is hatched, a nozzle 23 that ejects ink by means of the rear edge print method is represented by a black circle, and white circles are assigned among respective nozzles so that intervals between nozzles can be seen. In addition, although in reality the recording sheet S is carried and moved, in FIG. 28, for convenience of description, the nozzle array 43 is shown as moving relative to the recording sheet S. In any areas other than the rear edge of the recording sheet S, ink is ejected by means of the interlace method wherein ink ejected from the nozzles is spaced at regular intervals, and the recording sheet S is carried with a predetermined amount of feed. In the interlace method, pixels to be printed and pixels adjacent thereto in its sub-scanning direction are printed by different nozzles. Here, the microwave print method is adopted, wherein a predetermined amount of feed should be an intervals between nozzles plus the length of one pixel. Then, when voltage output is detected within the ink receiving area 52, the CPU 72 deems that the print head 24 is performing the print process at the rear edge area of the recording sheet S, and switches to the rear edge print method wherein an amount of feed equivalent to one pixel is carried, and ink is ejected from a predetermined nozzle 23. Next, since a nozzle 23 separated from the rear edge inhibits the formation of blank spaces at the rear edge, ink is ejected so as to run over the rear edge of the recording sheet. In this manner it becomes possible to use ink directly and to detect voltage output within the ink receiving area 52, and on the basis of the results of detection, to modify the method of ejecting ink at the rear edge of the recording sheet S, thereby enabling modification of ink eject methods at the rear edge of the recording sheet S at the appropriate time. At this time, instead of the microwave print method adopted as the normal print method, the full overlap print method of ejecting ink from a plurality of nozzles 23 onto one raster (line) may be adopted, or, alternatively, the part line overlap print method, may be adopted wherein the full overlap print is executed only at positions in the microwave print method where banding of ink eject is highly visible. Any other printing method may also be adopted. In addition, although ink is ejected from a nozzle 23 separated from the rear edge of the recording sheet S, a nozzle 23 (a nozzle 23 for which voltage output is detected in the ink receiving area 52) that is separated from the rear edge may be set as the non-ejecting nozzle 23*ph*, and thus ink need not be ejected. In this manner, consumption of ink in terms of ink eject can be controlled at the rear edge area. Alternatively, it is possible for only a nozzle 23 in a predetermined area of the rear edge of the recording sheet S to eject ink. In this manner, it becomes possible to inhibit the formation of blank spaces at the rear edge of the recording sheet S, and consumption of ink can be controlled. In addition, when the normal print method is pursued until the end, without any modification to the rear edge print method, the rear edge of the recording sheet needs to be carried to a position close to the nozzle 23 in the lowermost stream of the transport direction of the recording sheet S, before printing is completed. Thus, it becomes easy for the area in the vicinity of the rear edge of the recording sheet to float relative to the platen 44, and this may cause change in a distance between the print head 24 and the recording sheet S, or bring the print head into contact with the recording sheet S, thus degrading print picture quality. In contrast, according to this embodiment, at the rear edge of the recording sheet S, printing is completed at a position close to the uppermost nozzle 23 in the transport direction of the recording sheet S, thereby enabling inhibition of any degradation in the quality of pictures of prints.

In the embodiments described above, when borderfree printing takes place, printing is controlled by detecting landing of ink onto the ink receiving area 52, and thus determining a position of a front edge, side edges, and a rear edge of a recording sheet S However, the present invention may be applied not only to borderfree printing, but also to any cases in which there is a preference for printing wherein ink is used directly to determine an end of a recording sheet S.

In the embodiments described above, although printing by unidirectional printing has been described in which ink is ejected when the print head travels in a single direction, the invention may also be applied to cases in which printing is done by bidirectional printing in which ink is ejected when the print head 24 travels outward and homeward in a horizontal direction. In particular, in order to determine a position of the side edge of a recording sheet S in bidirectional printing of the print head, after moving the print head 24 from the right end to the left end of the recording sheet S so as to determine the respective side edges, with steps S1300 to S1410 of the print process routine as shown in FIG. 18 and by executing outward printing, homeward printing can be executed by moving the print head 24 from the left end to the right end of the recording sheet S so as to determine the respective side edges. Even when this method is used, a position of the end of the recording sheet can be determined with a greater degree of accuracy than with any method in which light, etc. is used, and an end of a recording sheet S is indirectly determined.

In the embodiments described above, although the voltage detection circuit 54 is connected to the ink receiving area 52 so as to detect changes in voltage in the ink receiving area 52, the voltage detection circuit 54 may also be connected to the print head 24, for instance on a nozzle plate on which the nozzle 23 is formed, and in which changes in voltage at the print head 24 may be detected. At this time, the recording sheet S should have a potential (e.g., ground potential or insulation, etc.) that is different from the ink receiving area 52. Even in these circumstances, it can be confirmed that while no changes in voltage is detected when ink ejected from the nozzle 23 lands on the recording sheet S, changes in voltage can be detected at the print head 24, when ink ejected from the nozzle 23 lands on the ink receiving area 52. Thus, compared with any method in which anything other than ink is used and a position of the recording sheet S indirectly determined, an end position of a recording sheet can be determined with a greater degree of accuracy.

In the embodiments described above, in order for that the electrode member 57 to be a positive electrode, and for the print head to be a negative electrode, and in order for the ink receiving area 52 to have a predetermined measured potential, the voltage application circuit 53 electrically connects the two by way of an electrode material 57 and a resistance element. However, the voltage application circuit 53 may also electrically connect both by way of a DC power supply and a resistance element so that the electrode member 57 is a negative electrode while the print head 24 is a positive electrode, and the print head 24 has a predetermined measured potential. In such circumstances, the line feed roller or paper feed roller 36, and the paper eject roller 37 included in the paper handling mechanism 31 should carry the recording sheet S at a potential that is different from the print head 24 or the ink receiving area 52, for instance, at a position isolated from the housing. Even with such arrangements, as changes in voltage may be generated, depending on whether or not there is ejecting of ink, it is still possible to detect ink eject checks and the ends of the recording sheet S.

In the embodiment described above, the ink receiving area 52 utilizes an upper ink absorber 55 and a lower ink absorber 56. This is not necessarily essential and a configuration is possible in which a potential difference can be generated at least with the print head, by providing an electrode member 57 that can detect voltage resulting from the ejection of ink droplets, and with which ink can be prevented from flowing out. In such a case, the configuration may be such that ink droplets land directly on the electrode member 47. In addition, when an ink absorber is used in the ink receiving area 52, it should preferably have a permeable solid content. In addition, as a predetermined potential difference with the print head 24 is generated by the electrode member 47, the upper ink absorber 55 may be formed of nonconductive materials and made to be conductive upon touching liquid, or a check may be carried out while the ink absorber itself is dry and insulated.

In the embodiment described above, although an ink eject check takes place in an ink receiving area 52 where an end of a recording sheet is detected, a check area for conducting ink eject check may be provided separately from the ink receiving area 52 formed on the platen 44. In such a way, it is possible to reduce the solid content of ink deposited in the ink receiving area 52. In these circumstances, the check area may be arranged within the flashing area 42, or inside the cap unit 40. In these cases, the electrode member 57 is provided on the ink receiving area in a place where the check area is arranged. In particular, when the ink receiving area 52 is provided inside the cap unit 40, the print head 24 can be placed in proximity to the ink receiving area 52, and this is preferable in terms of precision at the time of the ink eject check. Since the head check process and the cleaning process can be implemented at the home position without moving the print head 24, the times required for the entire ink eject check and for the print process both can be reduced.

In the embodiments described above, although an end of a recording sheet S is detected by using a color that is not easy to view (yellow), any other color (such as light cyan or light magenta, cyan, magenta, black, blue, red, clear ink, etc.) may be used. In addition, a liquid (e.g., water) dedicated to detection of an end of a recording sheet S may also be used. Even with arrangements of this kind, it is possible to detect directly an end of a recording sheet through ink eject.

In the embodiment described above, although printing takes place by moving the print head 24 by means of the carriage belt 32 and the carriage motor 34, the embodiment may also be applied to a case in which the print head 24 does not travel in the main scanning direction. More specifically, a print head (so-called line ink jet head, see Japanese Patent Application Laid-Open (Kokai) No. 2002-200779) provided with nozzle arrays of respective colors arranged in lengths equal to, or greater than, the width of the recording sheet S, in the main scanning direction orthogonal to the transport direction of the recording sheet S may be applied to any model that ejects ink onto the recording sheet S. Even in these circumstances, the positions of a front edge, side edges and a rear edge can be determined with accuracy, thus enabling better control of the consumption of ink of the front edge, side edges, and rear edge of the recording sheet.

In the embodiment described above, after data for border free printing has been received, the voltage application circuit 53 applies predetermined voltage between the print head 24 and the ink receiving area 52 until printing has been completed in a front edge area in the case of determination of the front edge, until printing of all printing data has been completed at a side edge in the case of determination of a side edge, or until printing has been completed in the rear edge area in the case of determination of the rear edge. However, the voltage application circuit 53 may apply a predetermined voltage between the print head 24 and the ink receiving area 52 only when the print head 24 is in the vicinity of the end of the recording sheet S, i.e., only when a position of the end of the recording sheet S has been determined. Thus, as voltage is applied only when the end of the recording sheet S is being detected, power consumption can be reduced. In addition, a judgment as to whether or not the print head 24 is in the vicinity of the side edge of the recording sheet S may be made by using information about paper size contained in the print data or a value of the linear type encoder, etc. In order to make a judgment, information on a side edge position of a recording sheet S that was determined on the previous occasion may be used as the side edge position of the recording sheet S on the latest occasion.

In the embodiment described above, the instruction execution timing of the head check routine should follow (step S100) a time in the main routine when any data awaiting printing exists. However, the instruction execution timing of the head check routine may be such that the number of movements of the carriage 22 reaches a certain number of occasions (for instance, after 100 passes, etc.) or at predetermined intervals (e.g., every other day or every other week, etc). Furthermore, the head check routine may be omitted.

In the embodiment described above, although a full-color ink jet printer 20 with an ink jet method adopted has been described, this may be a multifunction printer equipped with a scanner, or a complex printer such as a FAX machine or a copier.

In the embodiment described above, detection of a position of a top edge, a position of a side edge, and a position of the rear edge were described separately. However, an end position may be detected by combining all of them, or the end of the recording sheet S may be detected by combining any one or more of them. In addition, for detection of the position of the top edge, a side edge, and a rear edge of the recording sheet S, a detection approach to any end position may be applied to the detection of other end positions within an applicable range.

It goes without saying that the present invention should not be limited to the embodiments described above, but can be implemented in various aspects as long as such implementation remains within the technical aspects of the invention.

In the present specification, Japanese Patent Application No. 2005-257953 filed on Sep. 6, 2005, Japanese Patent Application No. 2005-287220 filed on Sep. 30, 2005, Japanese Patent Application No. 2005-287221 filed on Sep. 30, 2005, and Japanese Patent Application No. 2006-190812 filed on Jul. 11, 2006 are incorporated herein by reference, and all of the specifications, drawings, claims, etc. that have been respectively disclosed are hereby incorporated.

What is claimed is:

1. An image forming method for forming an image on a print medium by use of an image forming apparatus including a print head that ejects a print recording liquid from a plurality of nozzles onto the print medium, a print head drive module that causes the print head to eject the print recording liquid from one of the nozzles, and a print recording liquid receiving area over which the print medium passes and which the print recording liquid ejected from the nozzles can reach, said image forming method comprising steps of:

(a) generating a predetermined potential difference between the print recording liquid receiving area and the print head, and controlling the print head drive module so that the print head ejects the print recording liquid, which is charged in advance of ejection, from the nozzles to a specific area of the print recording liquid receiving area, which includes an exterior range outside an edge of the print medium and an interior range over the print medium, and then detecting electrical change in the print recording liquid receiving area or the print head; and (b) determining position of the edge of the print medium based on the electrical change detected in step (a).

2. The image forming method of claim 1, further comprising a step of: (c) setting a non-ejecting nozzle that does not eject the print recording liquid based on the electrical change detected in step (a), and controlling the print head drive module based on the setting.

3. The image forming method of claim 1, further comprising a step of:

(h) controlling the print head drive module so that the print head ejects the print recording liquid from the nozzles based on the electrical change detected in step (a), so as to allow borderfree printing on the print medium.

4. The image forming method of claim 1, wherein the print head accommodates the print recording liquid in a variety of colors, and step (a) controls the print head drive module so that the print head ejects the print recording liquid of a specific color that is not easy to view, when ejecting the print recording liquid from the nozzles to the specific area of the print recording liquid receiving area, which includes the exterior range outside the edge of the print medium and the interior range over the print medium.

5. The image forming method of claim 1, wherein step (a) detects electrical change when the print head ejects the print recording liquid from the nozzles to a predetermined area of the print recording liquid receiving area, which includes the interior range over the print medium and an immediate exterior range adjacent to a rear edge of the print medium, and step (b) determines position of the rear edge of the print medium based on the detected electrical change.

6. The image forming method of claim 5, further comprising a step of:

(g) switching between a normal print method of ejecting the print recording liquid to any area other than a rear area of the print medium based on the electrical change detected in step (a) and a rear area print method of ejecting the print recording liquid onto the rear area of the print medium, in order to control the print head drive module.

7. The image forming method of claim 1 wherein step (a) generates the predetermined potential difference between the print recording liquid receiving area and the print head, and detects electrical change when the print head ejects the print recording liquid, which is charged in advance of ejection, from the nozzles to a predetermined area of the print recording liquid receiving area, which includes an immediate exterior range adjacent to a front edge of the print medium and the interior range over the print medium; and step (b) determines position of the front edge of the print medium based on the electrical change detected in step (a).

8. The image forming method of claim 7, wherein the print head includes a nozzle array in which the plurality of nozzles is arranged in a transport direction of the print medium, and step (a) controls to fix the print medium in a state that the print recording liquid ejected from the nozzles included in the nozzle array can reach the predetermined area, which includes the immediate exterior range adjacent to the front edge of the print medium and the interior range over the print medium, and controls the print head drive module to sequentially switch the nozzles in the nozzle array, from which the print recording liquid is ejected, in the direction from a nozzle above the immediate exterior range adjacent to the front edge of the print medium to a nozzle above the interior range over the print medium, and to eject the print recording liquid onto the fixed print medium; and step (b) determines the position of the front edge of the print medium based on position where electrical change has ceased to be detected in the control in step (a).

9. The image forming method of claim 7 wherein:

the image forming apparatus includes a transport unit capable of carrying the print medium in a transport direction, and step (a), in the course of controlling the print head drive module so that the print head ejects the print recording liquid from the nozzles to the predetermined area, which includes the immediate exterior range adjacent to the front edge of the print medium and the interior range over the print medium, controls the transport unit to carry the print medium toward a position where a print recording liquid ejected from a specific nozzle among the plurality of nozzles reaches the print recording liquid receiving area, and controls the print head drive module to eject the print recording liquid from the specific nozzle; and step (b) determines the position of the front edge of the print medium based on position where electrical change has ceased to be detected in the control in the step (a).

10. The image forming method of claim 7, further comprising a step of:

(d) determining a first point on the front edge of the print medium by controlling the print head drive module so that the print head ejects the print recording liquid from the nozzles to the predetermined area, which includes the immediate exterior range adjacent to the front edge of the print medium and the interior range over the print medium, determining a second point on the front edge of the print medium by controlling the print head drive module so that the print head ejects the print recording liquid from the nozzles to a preset area, which does not include the first point and includes the immediate exterior range adjacent to the front edge and the interior range over the print medium, and determining an inclination of the print medium based on the determined first and second points.

11. The image forming method of claim 1, wherein step (a) generates a predetermined potential difference between the print recording liquid receiving area and the print head, and detects electrical change when the print head ejects the print recording liquid, which is charged in advance, from the nozzles to a predetermined area of the print recording liquid receiving area, which includes an immediate exterior range adjacent to a side edge of the print medium and the interior range over the print medium, in either direction of from the immediate exterior range toward the interior range and from the interior range toward the immediate exterior range, and step (b) determines position of a side edge of the print medium based on the electrical change detected in step (a).

12. The image forming method of claim 11, wherein the print head includes at least two arrays of nozzles in each of which the plurality of nozzles is arranged in a transport direction of the print medium, and step (b) determines the position of the side edge of the print medium based on position where electrical change has ceased to be detected in step (a) when the print recording liquid is ejected from a nozzle included in a front array of nozzles in a main scanning direction orthogonal to the transport direction of the print medium, while controlling the print head drive module so that the print head ejects the print recording liquid to the predetermined area of the print recording liquid receiving area, in the direction from the immediate exterior range toward the interior range, said image forming method further comprising a step of:

(e) controlling the print head drive module so that the print recording liquid is ejected from nozzles included in other nozzle array, based on the position of the side edge of the print medium determined in step (b).

13. The image forming method of claim 11, wherein the print head includes at least two arrays of nozzles in each of which the plurality of nozzles is arranged in a transport direction of the print medium, and step (b) determines the position of the side edge of the print medium based on position where electrical change has started to be detected in step (a) when the print recording liquid is ejected from the nozzle included in a front array of nozzles in a main scanning direction orthogonal to the transport direction of the print medium, while controlling the print head drive module so that the print head ejects the print recording liquid to the predetermined area of the print recording liquid receiving area, in the direction from the interior range toward the immediate exterior range, said image forming method further comprising a step of:

(e) controlling the print head drive module so that no print recording liquid is ejected from the nozzles included in the front array or the nozzles included in other nozzle array, based on the position of the side edge of the print medium determined in step (b).

14. The image forming method of claim 11, further comprising a step of:

(f) setting the determined position of the side edge of the print medium as a position of a side edge of a following print medium to be subsequently printed on, and controlling the print head drive module in the subsequent printing so that the print head ejects the print recording liquid from the nozzles based on the set position of the side edge of the following print medium.

15. An image forming method for forming an image on a print medium by use of an image forming apparatus including a print head that ejects a print recording liquid from a plurality of nozzles onto a print medium, a print head drive module that causes the print head to eject the print recording liquid, and a print recording liquid receiving area over which the print medium passes and which the print recording liquid ejected from the nozzles can reach, said image forming method comprising steps of:

(a) generating a predetermined potential difference between the print recording liquid receiving area and the print head, and controlling the drive head drive module so that the print head ejects the print recording liquid, which is charged in advance of ejection, from the nozzles to a specific area of the print recording liquid receiving area, which includes an exterior range outside an edge of the print medium and an interior range over the print medium, and then detecting electrical change in the print recording liquid receiving area or the print head; and (b) setting a non-ejecting nozzle that does not eject the print recording liquid based on the electrical change detected in step (a), and controlling the print head drive module based on the setting.

16. The image forming method of claim 15, wherein step (a) generates the predetermined potential difference between the print recording liquid receiving area and the print head, and detecting electrical change when the print head ejects the print recording liquid, which is charged in advance of ejection, from the nozzles to both of an immediate exterior range adjacent to a rear edge of the print medium and the interior range over the print medium at almost the same time, and step (b) sets the non-ejecting nozzle that does not eject the print recording liquid based on the electrical change detected in step (a) and controls the print head to eject the print recording liquid from the nozzles onto the print medium based on the setting.

17. The image forming method of claim 16, wherein:

step (b), in response to detection of electrical change when nozzles other than the non-ejecting nozzle ejects the print recording liquid to both of an immediate exterior range adjacent to a rear edge of the print medium and the interior range of the print medium, sets at least one nozzle other than the non-ejecting nozzle in the uppermost stream in the transport direction of the print medium as non-ejecting nozzle.

18. The image forming method of claim 16, wherein step (a) controls the print head drive module so that the print head ejects the print recording liquid from the nozzles to both of an immediate exterior range adjacent to a rear edge of the print medium and the interior range of the print medium, and step (b), each time that electrical change is detected at the time of controls in step (a), sets at least one group of nozzles that are not the non-ejecting nozzles and are arranged in a main scanning direction, which is orthogonal to a transport direction, in the uppermost stream of a transport direction, as the non-ejecting nozzle. based on the setting.

19. The image forming method of claim 16, wherein:

the image forming apparatus includes a transport unit that carries the print medium in a transport direction, step (a) controls the print head drive module so that the print head ejects the print recording liquid from the nozzles, while controlling the transport unit to carry the print medium, and step (b), in response to detection of electrical change in the control in step (a), sets at least a group of nozzles that are not the non-ejecting nozzles and are arranged in a main scanning direction, which is orthogonal to the transport direction, in the uppermost stream of the transport direction, as the non-ejecting nozzles, and controls the transport unit the print head drive module to carry a print medium and eject the print recording liquid for the subsequent printing based on the setting.

20. An image forming apparatus comprising:

a print head that ejects print recording liquid from a plurality of nozzles onto a print medium;

a print recording liquid receiving area over which the print medium passes and which the print recording liquid ejected from the nozzles can reach;

a print head drive module that controls the ejection of the print recording liquid from the nozzles;

an electrical change detection module that detects electrical change in the print recording liquid receiving area or in the print head; and a control module that generates a predetermined potential difference between the print recording liquid receiving area and the print head, controls print head drive module so that the print head eject the print recording liquid, which is charged in advance of ejection, from the nozzles to a specific area of the print recording liquid receiving area, which includes an exterior range outside an edge of the print medium and an interior range over the print medium, and controls the electrical change detection module to detect electrical change, and determines position of an edge of the print medium based on the detected electrical change.

* * * * *